US010258896B2

(12) United States Patent
Ornstein et al.

(10) Patent No.: US 10,258,896 B2
(45) Date of Patent: Apr. 16, 2019

(54) MAGNETIC BUILDING TILES

(71) Applicant: Box Tiles LLC, Highland Park, IL (US)

(72) Inventors: Noah J. Ornstein, Highland Park, IL (US); Joseph M. Kelley, Highland Park, IL (US)

(73) Assignee: Box Tiles LLC, Highland Park, IL (US)

( * ) Notice: Subject to any disclaimer, the term of this patent is extended or adjusted under 35 U.S.C. 154(b) by 103 days.

(21) Appl. No.: 15/066,141

(22) Filed: Mar. 10, 2016

(65) Prior Publication Data

US 2016/0184727 A1 Jun. 30, 2016

Related U.S. Application Data

(63) Continuation-in-part of application No. 14/022,793, filed on Sep. 10, 2013, now Pat. No. 9,314,707, and (Continued)

(51) Int. Cl.
*A63H 33/08* (2006.01)
*A63H 33/04* (2006.01)

(52) U.S. Cl.
CPC ..... *A63H 33/046* (2013.01)

(58) Field of Classification Search
None
See application file for complete search history.

(56) References Cited

U.S. PATENT DOCUMENTS 1,863,995 A * 6/1932 Ponstingl ..... A63H 33/082 403/295
2,951,311 A 9/1960 Luther
(Continued)

FOREIGN PATENT DOCUMENTS

CN 201591981 U 9/2010
KR 200414572 4/2006
(Continued)

OTHER PUBLICATIONS

International Search Report dated Jan. 7, 2015 for PCT/US2014/054902.
(Continued)

*Primary Examiner* — Melba Bumgarner
*Assistant Examiner* — Urszula M Cegielnik
(74) *Attorney, Agent, or Firm* — Fitch, Even, Tabin & Flannery LLP

(57) ABSTRACT

A building system includes a plurality of building tiles and/or connecters that are magnetically and releasably connectable to one another. The magnetic building tiles are comprised of a tile frame and a tile panel. The tile frame, by one approach, is comprised of two connectable frame portions or elements having magnets embedded therein. The first frame element and the second frame element are connectable to one another through a snap, clip, or another similar connection mechanism. The first and second frame elements are connectable around or into the tile panel, which is removable from the magnetic building tile. The tile panel or the tile frame has a channel into which the other of the tile panel or tile frame extends to secure the two pieces together. In another approach, the tile frame is a single element and the tile panel may snap or attach thereto, such as, for example, through fasteners or friction.

13 Claims, 95 Drawing Sheets

Related U.S. Application Data a continuation-in-part of application No. PCT/US2014/054902, filed on Sep. 10, 2014, which is a continuation-in-part of application No. 14/022,793, filed on Sep. 10, 2013, now Pat. No. 9,314,707.

(60) Provisional application No. 61/901,876, filed on Nov. 8, 2013.

(56) References Cited

U.S. PATENT DOCUMENTS 2,968,118 A * 1/1961 Paulson ..... A63H 33/084 446/105
3,661,689 A 5/1972 Spanier
3,902,291 A 9/1975 Zucht
3,998,004 A 12/1976 Ehrlich
4,192,083 A * 3/1980 Rebbeck ..... G09B 25/06 108/64
4,193,221 A * 3/1980 Beck ..... A63H 33/044 446/105
4,227,337 A * 10/1980 Murray ..... A63H 33/044 446/102
4,255,837 A 3/1981 Holtz
4,258,479 A 3/1981 Roane
4,334,870 A 6/1982 Roane
4,334,871 A 6/1982 Roane
4,561,223 A 12/1985 Gold et al.
4,884,988 A 12/1989 McMurray
5,009,625 A 4/1991 Longuet-Higgins
5,021,021 A * 6/1991 Ballard ..... A63H 33/046 335/285
5,134,812 A 8/1992 Hoffman et al.
5,161,827 A 11/1992 Grosso
5,222,902 A * 6/1993 Piersch ..... A63H 33/062 403/345
5,230,172 A * 7/1993 Hsu ..... A47G 1/06 248/497
5,417,603 A * 5/1995 De Chazal ..... A63F 9/001 108/62
5,482,491 A * 1/1996 Kichijyo ..... A63H 33/08 446/112
5,803,146 A * 9/1998 Boon ..... E04B 2/7416 160/135
5,830,032 A 11/1998 Campbell
5,860,264 A * 1/1999 Gephart ..... E06B 3/88 52/204.71
5,871,384 A * 2/1999 Kichijo ..... A63H 33/062 446/112
5,888,114 A 3/1999 Slocum et al.
6,032,590 A * 3/2000 Chen ..... A47B 3/06 108/158.12
6,113,203 A * 9/2000 Chen ..... A47B 43/00 312/258
6,298,591 B1 10/2001 Healy
6,431,936 B1 * 8/2002 Kiribuchi ..... A63H 33/046 446/129
6,488,346 B2 * 12/2002 Chen ..... A47B 47/0075 312/111
6,500,007 B2 12/2002 Pupulin
6,824,440 B2 11/2004 Brener
6,969,294 B2 11/2005 Vicentelli
7,004,082 B2 * 2/2006 Yang ..... A47B 37/04 108/50.12
7,066,778 B2 6/2006 Kretzschmar
7,154,363 B2 12/2006 Hunts
7,273,404 B2 9/2007 Kowalski et al.
7,364,487 B2 * 4/2008 Evans ..... A63H 33/008 446/108
7,373,748 B2 5/2008 Pitcher et al.
7,520,080 B2 4/2009 Pitcher et al.
7,559,821 B2 7/2009 Pacheco
7,743,541 B2 6/2010 Suciu et al.
7,833,078 B2 11/2010 Kretzschmar
7,922,417 B2 4/2011 Jimenez
8,282,438 B2 * 10/2012 Tamulewicz ..... A63H 33/26 446/129
8,850,683 B2 10/2014 Haughey et al.
8,875,427 B2 11/2014 Valiulis
8,904,688 B1 12/2014 Rue et al.
9,314,707 B2 4/2016 Ornstein
D784,938 S * 4/2017 Wang ..... D13/183
D789,312 S * 6/2017 Wang ..... D13/183
9,734,733 B2 * 8/2017 Murtagh ..... G09B 25/04
2001/0004817 A1 6/2001 Auer
2001/0010992 A1 * 8/2001 Brazier ..... A63H 33/04 446/108
2002/0193046 A1 12/2002 Zebersky
2005/0241197 A1 11/2005 Ternovits et al.
2006/0166590 A1 7/2006 Ishikawa
2009/0013576 A1 1/2009 Jake et al.
2009/0217560 A1 9/2009 Topcuoglu
2010/0192437 A1 * 8/2010 Fallander ..... A47G 1/06 40/790
2010/0251659 A1 10/2010 Hughes
2011/0039473 A1 2/2011 Kretzschmar
2012/0200561 A1 * 8/2012 Bando ..... H04N 13/359 345/419
2013/0072086 A1 3/2013 Saneshige
2013/0095722 A1 4/2013 Cochella
2014/0109448 A1 * 4/2014 Lehrkamp ..... G09F 15/0012 40/606.09
2014/0202054 A1 * 7/2014 Valentine ..... G09F 15/0012 40/600
2014/0227934 A1 8/2014 Rudisill
2015/0367247 A1 * 12/2015 Kosmo ..... A63H 33/42 446/71

FOREIGN PATENT DOCUMENTS

KR 1020120082517 7/2012
KR 101415746 B1 7/2014
WO 2011139013 A1 11/2011
WO 2015038581 A1 3/2015
WO 2015123119 A1 8/2015
WO 2015141927 A1 9/2015

OTHER PUBLICATIONS

Magformers XL Cruisers Construction Set, available at http://www.amazon.com/Magformers-XL-Cruisers-Construction-Set/dp/B008EGIIEM, available Apr. 23, 2013 according to archive.org/web.
PCT App. No. PCT/US2017/019120; International Search Report and Written Opinion dated May 5, 2017; pp. 1-48.

* cited by examiner

MAGNETIC BUILDING TILES

RELATED APPLICATIONS

This application is a continuation-in-part of U.S. patent application Ser. No. 14/022,793, filed Sep. 10, 2013, now allowed, which is incorporated herein in its entirety. This application also is a continuation-in-part of International Application No. PCT/US2014/054902, filed Sep. 10, 2014, which is a continuation-in-part of U.S. patent application Ser. No. 14/022,793, filed Sep. 10, 2013, and also claims priority to a provisional application, U.S. Patent Application No. 61/901,876, filed Nov. 8, 2013, all of which are incorporated herein in their entirety.

TECHNICAL FIELD

This disclosure relates generally to toy building elements.

BACKGROUND

Kits to create models of buildings, vehicles, and other structures are popular with children, parents, and hobbyists. Such kits may engage and encourage a child's imagination. One type of kit provides a model or replica of a specific larger structure such as, e.g., a castle or a log cabin. Another type of kit includes pieces that may be used to build a variety of different structures.

Kits that create impressive and realistic replicas of specific structures may limit or inhibit a child's creative play by their inherent design. For example, the materials in such kits are typically printed and/or shaped to correspond closely to the original structure (or a child's typical interpretation of such a structure) such that these materials are not easily repurposed or reconfigured into other structural elements. In addition, many of these kits do not provide an easily changeable, customizable, or adjustable structure.

Kits that can easily be used to create a variety of structures include building elements that can be repurposed or reimagined. These kits, however, do not necessarily allow the user the ability to customize the building elements to help the structure resemble another known structure, or even just to personalize the buildings or structures created, which also may limit imaginative play. For example, some building sets have pieces with only a small number of shapes and colors. Further, the colors of the individual pieces are somewhat arbitrary and the pieces are not typically designed to coordinate or replicate known structures or provide children the opportunity to develop imagined structures. Moreover, the individual pieces are not readily alterable or customizable by children.

SUMMARY

A toy building kit or system comprised of magnetic building tiles is provided. The magnetic building tiles are magnetically connectable with one another and are comprised of a frame and a removable panel or insert. The frame, by one approach, is comprised of at least two connectable portions or elements having magnets embedded therein. The frame elements may be connectable to one another through one or more snaps, clips, or other connection mechanisms. In another approach, the frame is a single unit or has a one-piece design configured to retain a panel with a snap fit, friction fit and/or other securement mechanism. In addition, a frame with a one-piece configuration may be manufactured in multiple steps as outlined below.

By one approach, the tile panel has a channel around its edge in which the first and second frame elements, or portions thereof, are received to secure the panel relative to the frame. In another approach, the first and second frame elements are designed to extend externally around an edge of the tile panel, rather than being wholly or partially within a channel of the panel. In such a configuration, the frame elements may have channels in which edges of the panels are received. In another example, the tile panel may have openings through which a set of fasteners or extension pegs from the frame extend to secure the tile panel and the frame to one another.

By yet another approach, the tile panel and frame may have a snap fit and/or friction fit securing the two elements together. In this manner, the frame may have a unitary configuration with a central opening into which the panel may snap. The frame may include an interior wall with curvature, channels, extensions, a protrusion, and/or other features such that the frame securely receives at least a portion of the panel therein. In one illustrative configuration, the interior wall of the frame permits the panel to be attached to either side of the frame such that the panel may attach to a front or back of the frame. When mated together, the panel may be inset into the frame such that each of the frame and panel have an exterior surface that is generally flush with the other. Alternatively, as discussed below, the panel may have features that create additional dimension or thickness of the panel beyond the exterior surface of the frame.

In one configuration, the tile panel and frame generally form a square when viewed from the front. In other configurations, the building tiles may form triangular, rectangular, oval or other shapes.

To provide a user with the ability to customize the kit, the kit may permit the user to easily insert and remove or attach and detach the panels from the frames such that the panels are interchangeable. The kit may include a plurality of such interchangeable panels capable of insertion and removal from a frame to create tiles with different appearances. Further, a user can color, paint, or otherwise decorate certain of the panels. In addition, the files and frame may be connected to one another to build a structure, such as a play house, teepee, theater, castle, car, boat, farm stand, kitchen, elephant, floor puzzle, race track, ball run, maze, train track, or mural, to note a few of the endless options. Further, once a user is finished with the design of a particular panel, it can be easily removed from the frame and replaced with a different panel. Also, pre-decorated or designed panels may be used with the frames. For example, to enable a user to build a model of a brick house, tile panels with a brick motif may be inserted into the tile frames. The panels may be comprised of one or more materials such as cardboard, paperboard, composite materials, plastic, metals or other light and rigid materials safe for handling by children.

The kit may include magnetic and/or magnetic and mechanical connectors. In one illustrative embodiment, the magnetic, mechanical connector (hereinafter referred to as a "mechanical connector") includes a frame element with magnets disposed therein, a pair of extension elements extending from the frame element in a substantially parallel arrangement, and a pair of wings flexibly connected to the pair of extension elements, arranged between the extension elements, extending from distal edges of the extension elements toward the frame element. By one approach, a plurality of friction elements is disposed on the pair of wing surfaces facing one another such that the friction elements may engage and securely attach the mechanical connector to a sheet of material such as a cardboard cutout. The mechanical connector may have a hinge disposed between the extension elements and the frame element to provide for relative movement, e.g., pivoting of the two pieces. In another configuration, the mechanical connector includes a frame element with a rounded face such that the frame element has a nearly semi-circular configuration. The rounded face of the frame element permits the entire mechanical connector to be rotated on the rounded face of the frame element. A mechanical connector with a hinge or rounded face can be used together with another connector or tile to provide for a portion of a structure that moves relative to another portion of the structure. For example, to enable a user to build a structure with structural elements that move relative to one another, such as a model of a house with a door, or an animal with a sweeping tail, or a fort with a drawbridge, one or more mechanical connector elements with hinges may be employed. Other mechanical connectors may include frame elements with magnets disposed therein and one or more pegs, protrusions, or fasteners disposed thereon such that one or more panels may attach thereto.

The kit also may include a plurality of three-dimensional architectural, design, or building elements or panels. (As used herein a three-dimensional panel is one having a thickness that extends beyond the exterior surface of the frame such that the frame and panel are no longer flush with one another.) For example, the tile panels may include architectural elements such as bay windows, tunnels, turrets, tent or tent supports, towers, bridges, or castle sections, among others. Other three-dimensional panels may include elements resembling features of animals, furniture, robots, food or kitchen-themed supplies, decorations, such as holiday-themed supplies or home decorations, vehicles, such as cars, trucks, planes, busses, and boats, and superheroes, among many others. In another example, the tile panels including the three-dimensional panels may include connection elements that permit the user to design a maze or ball run with the panels. In another example, the three-dimensional architectural panel may be formed into a race track for use with racing vehicles, such as diecast toy cars. By one approach, such three-dimensional panels may be used with the other kit elements such as the frame or the mechanical connectors.

In another illustrative approach, the magnetic building tiles may be employed with a bridge clip that strengthens the magnetic connection between adjacent building tiles. For example, the bridge clip may snap into position around a portion of two distinct or separate building tiles that are disposed adjacent one another. The clip may include a pair of flanges configured to engage a portion of the two adjacent panels. In one illustrative approach, the flanges may include structure to engage the interior wall of two adjacently disposed frames. The flanges, in one exemplary approach, are disposed parallel to one another and the flanges snap into position around a portion of two adjacent building tiles.

Elements in the figures are illustrated for simplicity and clarity and have not necessarily been drawn to scale. The terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
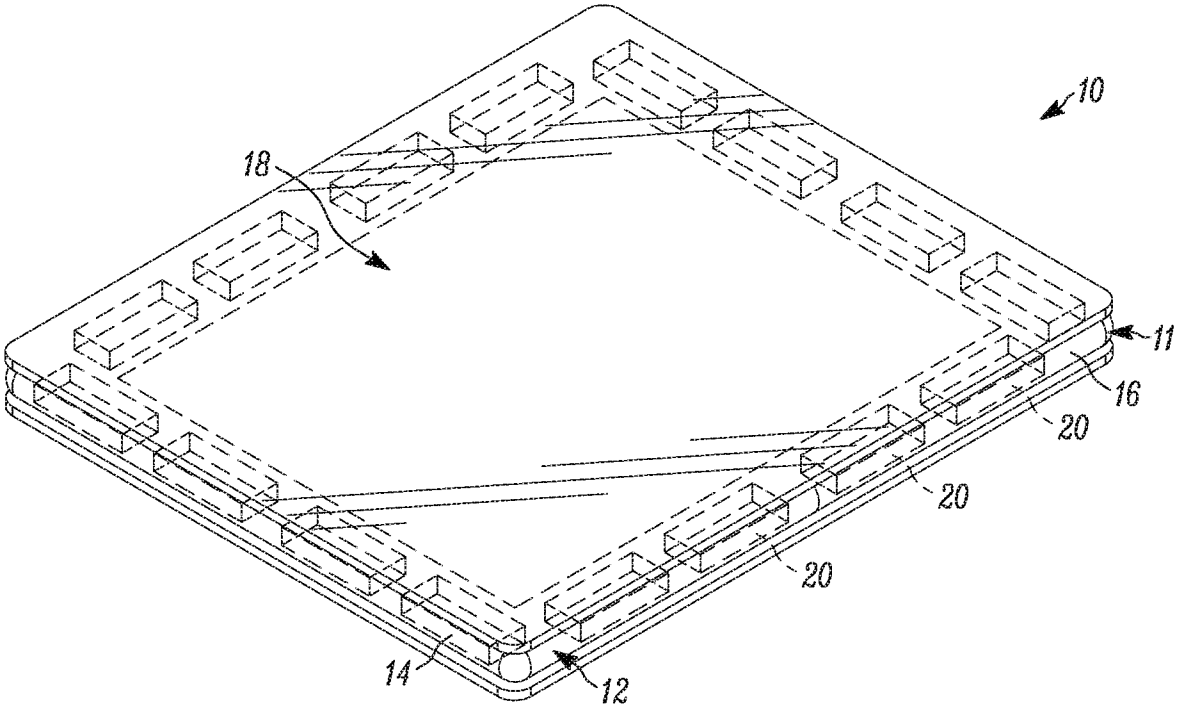
FIG. 1 is a perspective view of a magnetic building tile.
Figure 31:
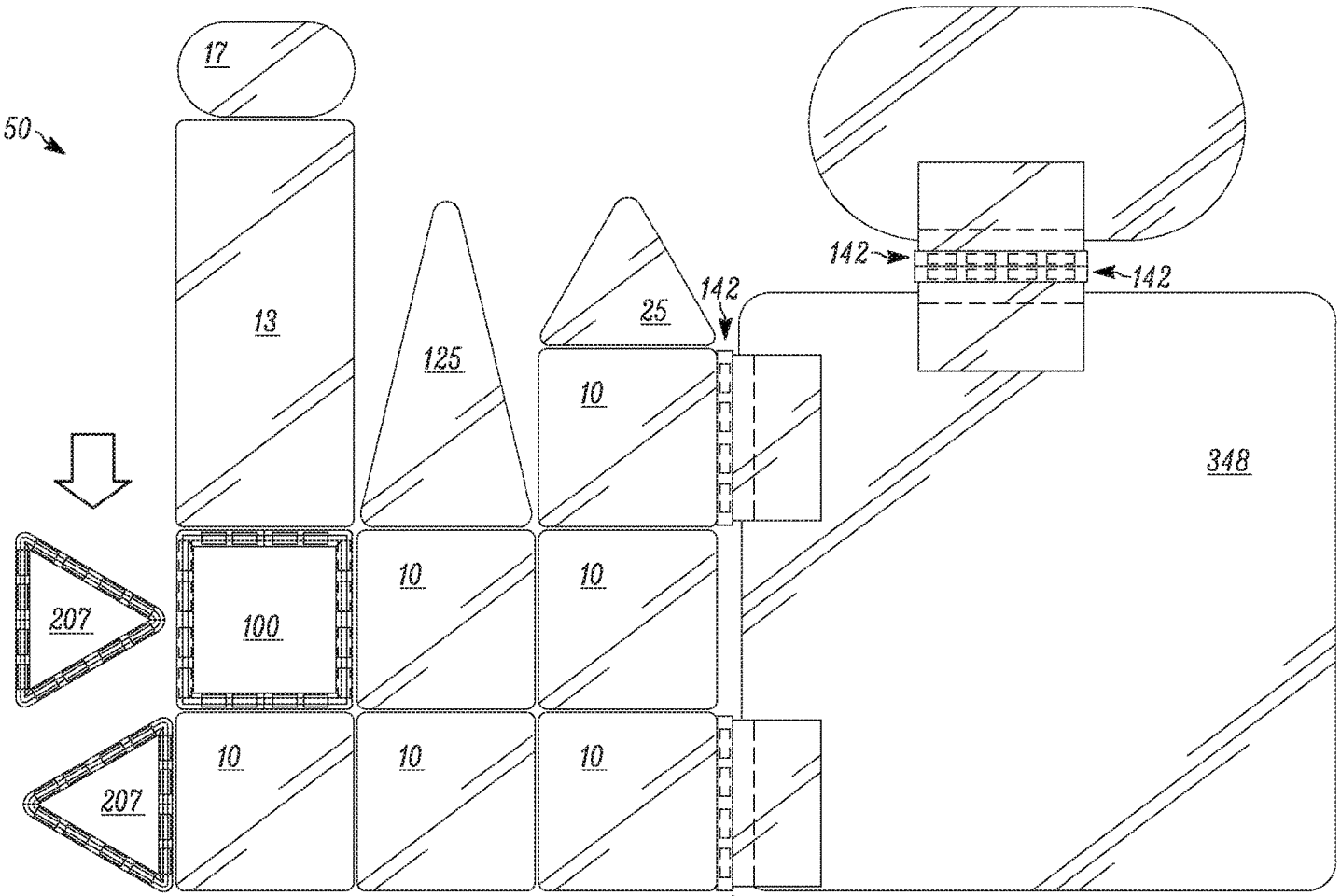
FIG. 31 is a front view illustrating connected magnetic building tiles, mechanical connectors, and cardboard cutouts.
Figure 32:
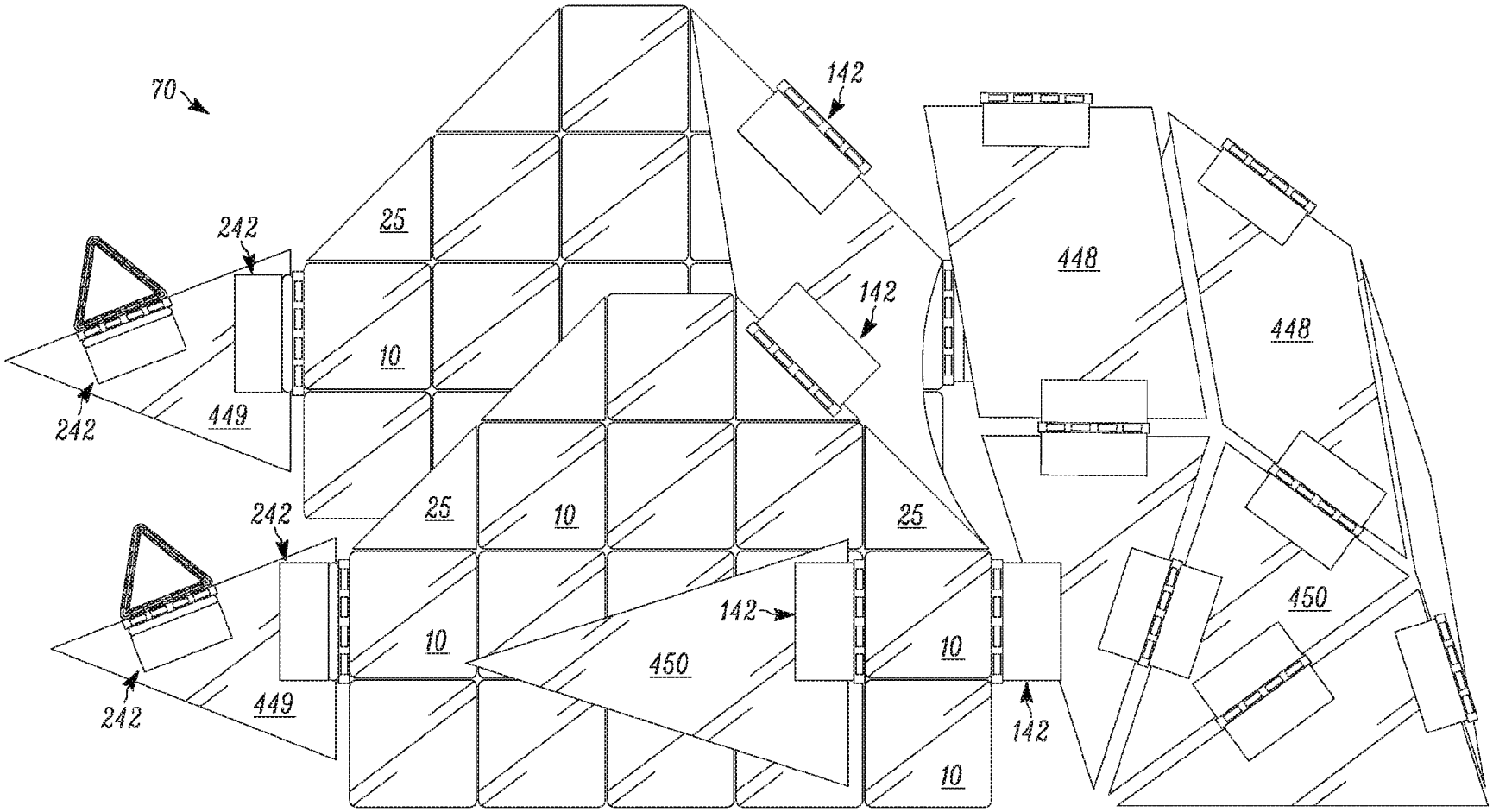
FIG. 32 is a top perspective view illustrating connected magnetic building tiles, mechanical connectors, and cardboard cutouts.
Figure 33:
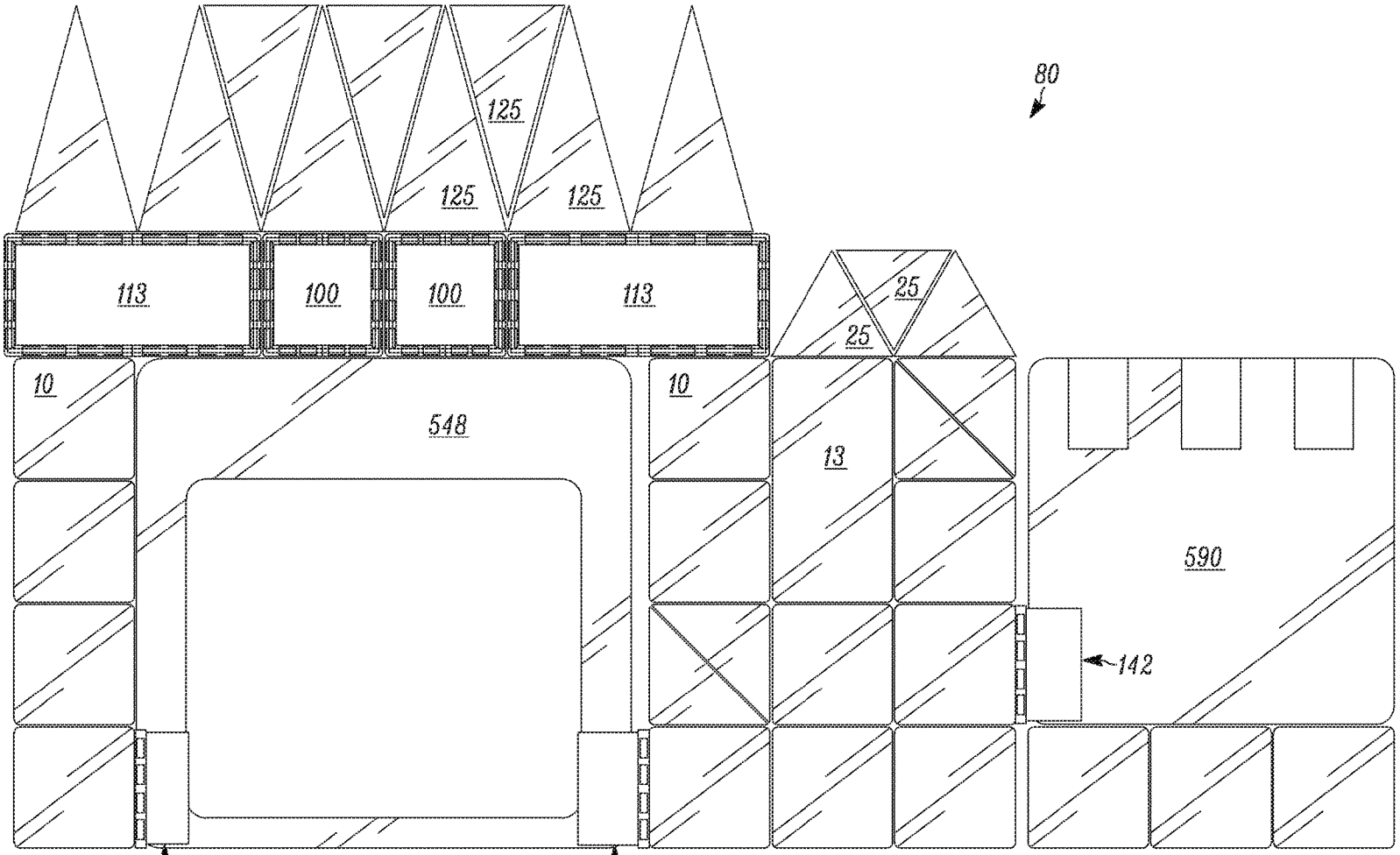
FIG. 33 is a front view illustrating connected magnetic building tiles, mechanical connectors, and cardboard cutouts.

FIG. 1 illustrates a single building tile 10 that is magnetically connectable to other building tiles. For example, a side edge 11 of the building tile 10 may be magnetically connected to a side edge 11 of an adjacent building tile 10 (see, e.g., FIGS. 31 and 36), or to the front of an adjacent building tile 10 (see, e.g., FIG. 37), such that the building tiles 10 require a predetermined force to separate the magnetically connected building tiles 10. FIGS. 31-33 illustrate a set or a portion of a set 50, 70, 80 of building tiles 10 and other tile configurations and building elements described below. The sets or kits 50, 70, 80 described herein are illustrative and a variety of magnetic tiles, frames, panels (including three-dimensional panels), magnetic connectors, mechanical connectors, clips, and plastic and/or cardboard pieces, cutouts, or boxes may be employed therewith.

As shown, a tile frame 12 and a tile panel 18 are configured to mate together to form the building tile 10. By one approach, the tile frame 12 has a first frame portion 14 that releasably connects with a second frame portion 16. Each of the frame portions 14, 16 may have magnets 20 disposed therein. See, e.g., FIGS. 2-4. In other configurations, the tile frame 12 may be comprised of more than two portions or may be a single unitary configuration. Examples of one-piece frames with a single element or unitary configuration are illustrated, e.g., in FIGS. 50-52, 58, 60, 93, 99, and 102, discussed further below.

Figure 4:
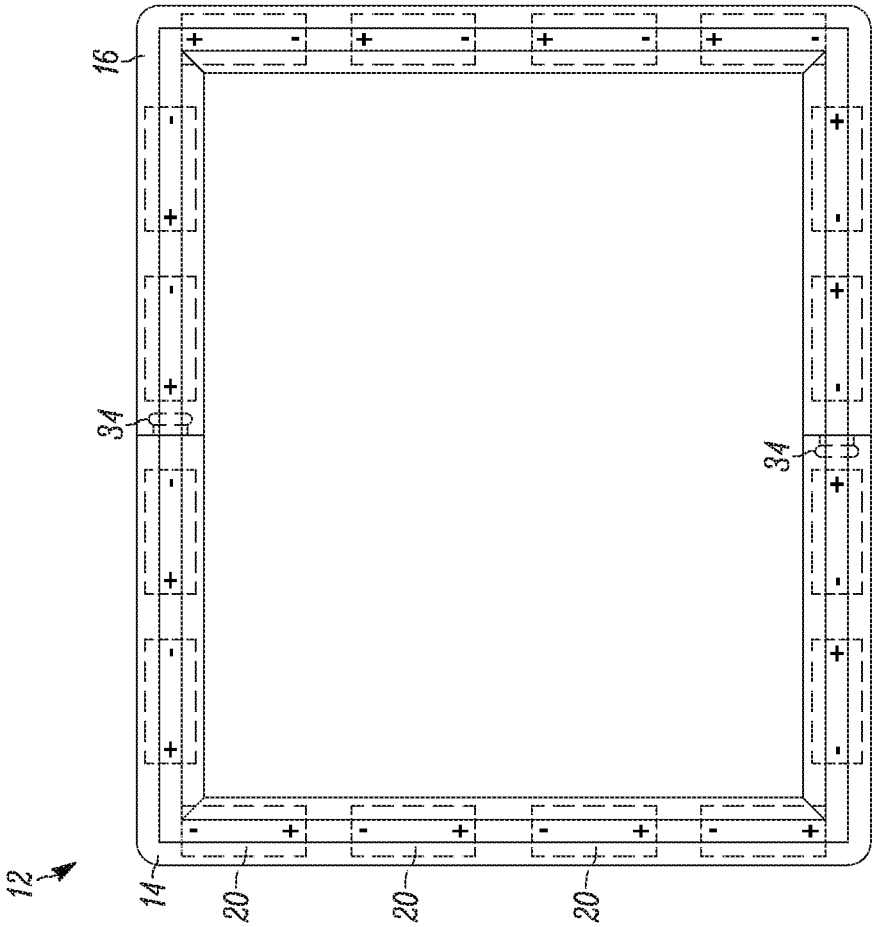
FIG. 4 is a front view of a closed frame of the magnetic building tile of FIG. 1.

FIG. 4 illustrates one exemplary arrangement of the magnetic poles of the magnets 20. A variety of magnets including a variety of types, shapes, and sizes may be employed in the frame 12. In one configuration, the tile frame includes a plurality of square or rectangular shaped magnets, though other shapes also may be included. The frame magnets or magnetic elements also may be configured to move, adjust, rotate, or spin within the panel frame such that their poles can adjust relative to the magnetic poles of nearby or adjacent magnetic elements. More particularly, the magnets may have a cylindrical, spherical, or similar shape such that the magnets may rotate, spin, or otherwise adjust their polarity in relation to the nearby magnets to facilitate their attachment to one another. In another configuration, the magnets may not include discrete magnets, but may include another magnetic material, such as magnetic paint.

Further, the frame 12 may include only a few magnets or, alternatively, may include many magnets, and this may depend, in part, on the type, shape, strength, and size of the magnets used. By one approach, each side of the magnetic building tile 10 with a similar length includes the same number of magnets 20. Thus, the magnets are generally evenly distributed through the length of the frame. In other configurations, the magnets may be more heavily concentrated near certain portions of the building tile, such as near the corners.

As noted above, a variety of magnets 20 may be incorporated into the frames described herein. In one illustrative configuration, the attractive force or separation force between two magnets 20 is about 0.25 to about 50 pounds per magnet if they are placed in contact with each other. In another illustrative embodiment, the magnets may require a separation force of between about 0.5 to about 10 pounds per magnet. In another illustrative embodiment, the magnets may require a separation force of between about 0.5 to about 5 pounds per magnet. In yet another configuration, the separation force between magnets will be about 1 to about 3 pounds per magnet. These illustrative magnetic forces are measured with the magnets contacting each other prior to the magnets being disposed within the walls of the frame.

In one configuration, the magnets 20 are injection molded into the plastic frame 12 or the plastic frame 12 is injection molded around the magnets 20 such that the magnets are secured within the structure of the frame 12. Other alternative arrangements are possible. For example, the magnets 20 may be glued, snap fit or friction fit into the frame, to note but a few additional options. Further, even if the user or consumer receives a one-piece frame with a single unitary configuration with the magnets 20 therein (such as, for example, the frames illustrated in FIGS. 50, 58, and 60), the frame itself may have been manufactured in a plurality of steps or components and assembled into the single element to which the panels may be attached.

Once the panels are assembled or attached to the frame, the building tiles may have a height and width of between about 2 to about 50 centimeters (about 0.79 to about 19.7-inches), though other dimensions are possible. In one illustrative embodiment, the building tiles may have a height of between about 7 to about 40 centimeters (about 2.75 to about 15.75-inches) and width of between about 7 to about 40 centimeters (about 2.75 to about 15.75-inches). Further, an assembled building tile may have a thickness of between about 0.25 to about 2.0 centimeters (about 0.098 to about 0.79-inches). In one illustrative embodiment, an assembled building tile has a thickness of about 0.5 to about 1 centimeter (about 0.2 to about 0.39-inches), though other thickness may be employed.

As mentioned above, the frame 12 may have a first and second frame portion 14, 16 that are connectable to one another around at least portions of the panel 18 such that the frame 12 is securely mated to the tile panel 18, as shown in FIG. 1. To secure the first and second frame portions 14, 16 together, the frame 12 may include a frame connection mechanism 22 that permits a user to releasably connect the frame portions 14, 16 together. By one approach, the first and second frame portions 14, 16 are snap fit together. For example, the frame connection mechanism 22 may include a cantilever beam snap fit, a cylindrical snap fit, or a spherical snap fit. In one configuration, the snap fit connection is magnetic, such that the first and second frame portions 14, 16 have a magnetic snap fit. Such a releasable connection permits the frame 12 to be releasably connected to the tile panel 18, which is then removable and interchangeable. When a user wants to remove the panel 18 from the building tile 10, the user pulls the portions of the frame 14, 16 away from one another such that the two portions disengage with one another. In this manner, the tile panel 18 may then be removed from the tile frame 12.

Figure 2:
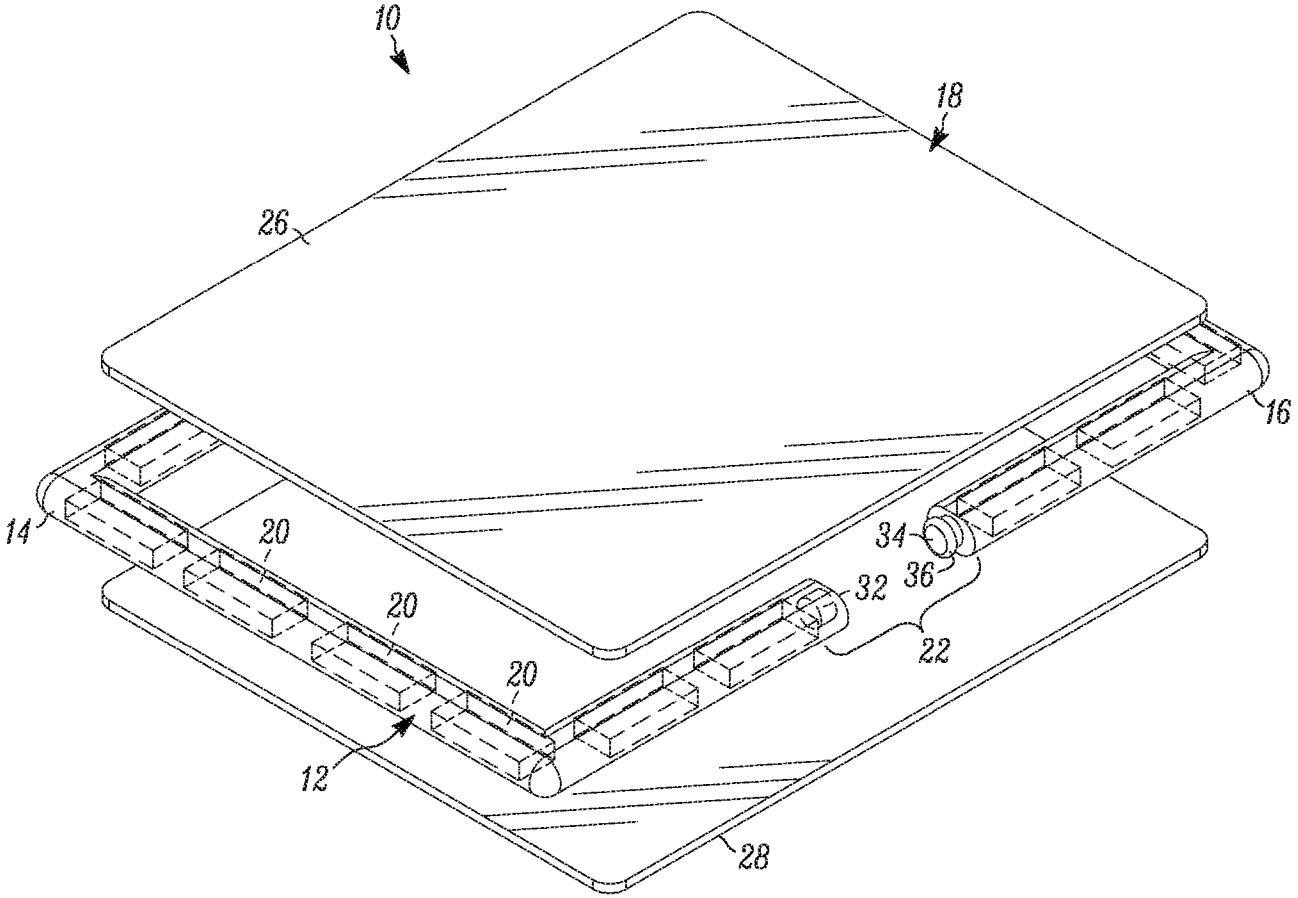
FIG. 2 is an exploded view of the magnetic building tile of FIG. 1.
Figure 3:
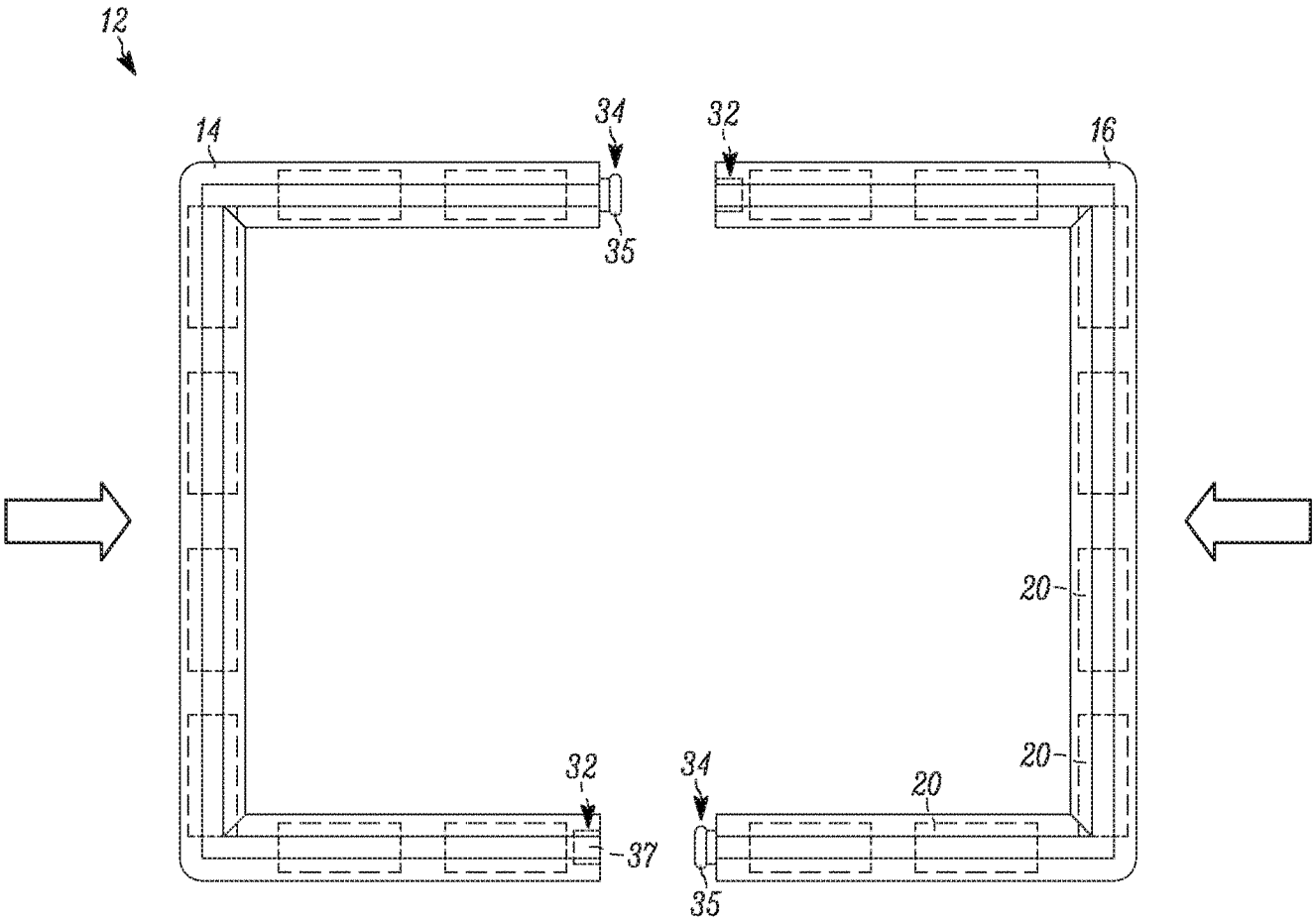
FIG. 3 is a front view of an open frame of the magnetic building tile of FIG. 1.
Figure 5:
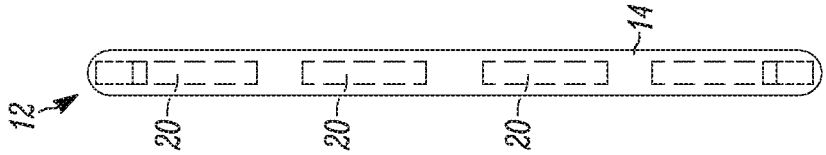
FIG. 5 is a side view of a closed frame of the magnetic building tile of FIG. 1.

As shown in FIGS. 2 and 3, the connection mechanism 22 may include a first joint portion 32 and a second joint portion 34 that mate together. The first and second portions 32, 34 are disposed at ends of the first and second frame portions 14, 16 where the frame portions 14, 16 meet together when disposed around portions of the tile panel 18. The connection mechanism 22 of FIG. 2 is a mechanical joint between the first and second frame portions 14, 16. The flexible locking feature of the connection mechanism 22 includes a catch 35 of the second portion 34 and a recess 37 that mates with the second portion 34. FIG. 3 illustrates how the first and second frame portions 14, 16 may be pushed together to secure the frame portions together via the connection mechanism 22. FIG. 4 illustrates how the connected frame 12 will appear, without the tile panel 18. To separate the first and second frame portions 14, 16, the user will pull the frame portions apart in a direction opposite to that illustrated in FIG. 3.

Figure 7:
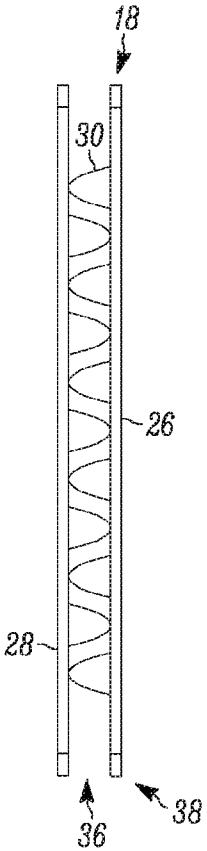
FIGS. 6-7 are front and side views of a panel in accordance with one embodiment.
Figure 6:
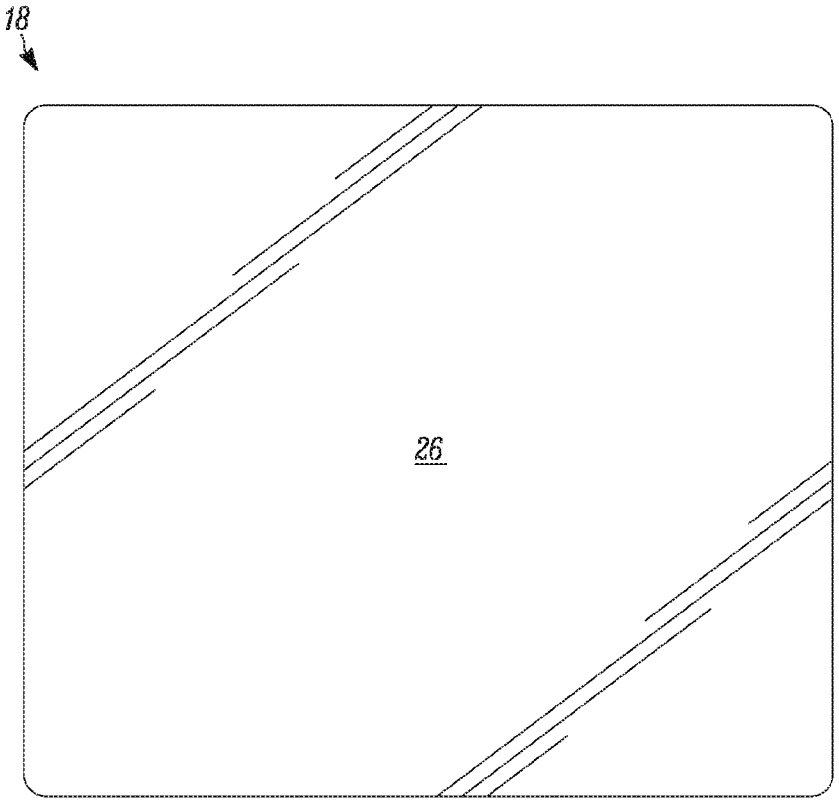

The tile panel 18, shown in FIGS. 6 and 7, has a first and a second tile wall 26, 28. In between the two panel walls 26, 28, the tile panel 18 has a core or connecting member 30 (see, e.g., FIG. 7) that may take a variety of configurations.

In one approach, the connecting member 30 is a wavy sheet of material, similar to the material found inside of corrugated cardboard or paperboard. In other configurations, the connecting member may be foam or a block of material attached to both panel walls 26, 28. In yet other configurations, the connecting member 30 may be another structure capable of keeping the first and second tile walls 26, 28 secured relative to one another. In other configurations, as discussed below, the tile panel may not include a connecting member, but instead the panel walls may be merely opposing sides of the same member or single sheet. The panels described herein may be comprised of a number of materials, such as, for example, cardboard, paperboard, composite materials, plastics, and metals, among others.

Figure 9:
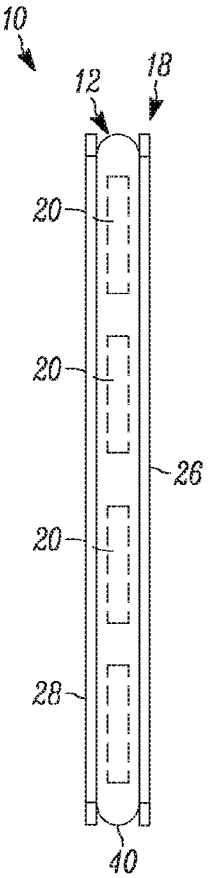
FIG. 9 is a side view of the frame and panel of FIG. 8.
Figure 8:
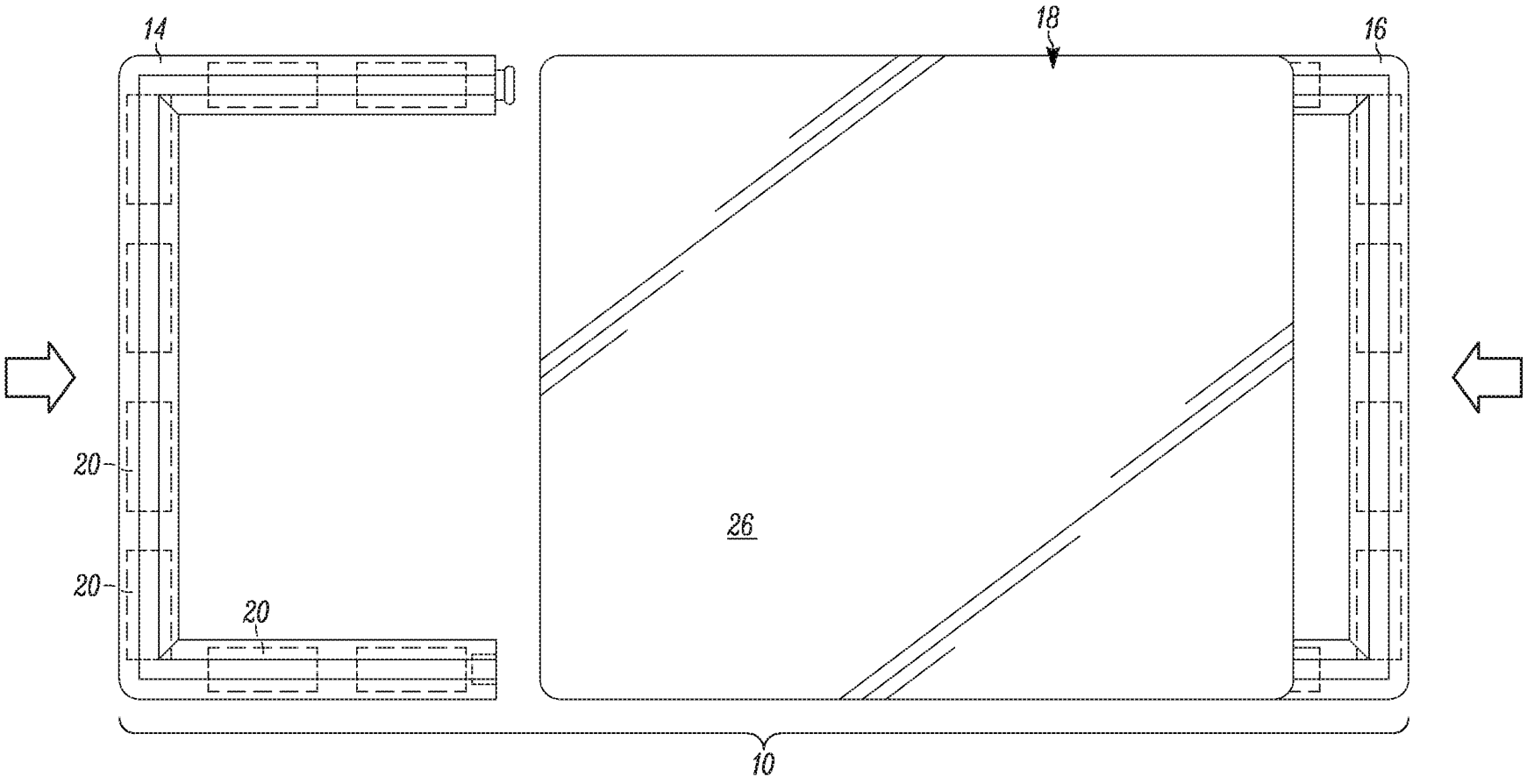
FIG. 8 is a front view of a frame being connected around the panel of FIGS. 6 and 7.

FIG. 7 also illustrates a panel channel 36 formed adjacent a panel edge 38 of the tile panel 18. In one illustrative embodiment, the panel channel 36 extends around the entire edge of the tile panel 18. The tile frame 12 may extend within the channel 36, and the first and second frame portions 14, 16 may snap together within the panel channel 36 to form the building tile 10. In one configuration, the panel channel 36 is deep enough such that a frame edge 40 is disposed near the panel edge 38. In this manner the magnets 20 are disposed relatively near the side edge 11 of the building tiles 10 to permit adjacent building tiles 10 to magnetically connect with one another. Further, having the frame edge 40 disposed near the panel edge 38 allows a user to manually grasp the frame 12 to pull apart the frame portions 14, 16 and push the frame portions 14, 16 together (see, e.g., FIG. 8). FIG. 9 illustrates a side view of the building tile 10 with the tile frame 12 mated together with the tile panel 18.

In other configurations, the tile panel may not include a channel 36. For panels that do not include a panel channel, the frame will not be secured therein and the frame and panel will be associated to one another in another fashion, such as by having the frame secured around an edge or another portion of the panel or having an attachment element such as a set of fasteners or extension pegs that secure the panel to the frame. In yet another approach, the tile panel and the frame may be attached via a snap-fit and/or friction-fit connection.

Figure 37:
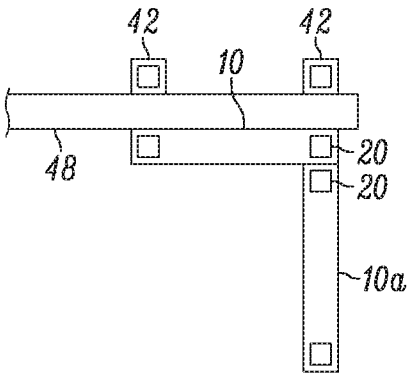
FIG. 37 is a cross section of an alternative connection between the two magnetic building tiles in FIG. 36.
Figure 36:
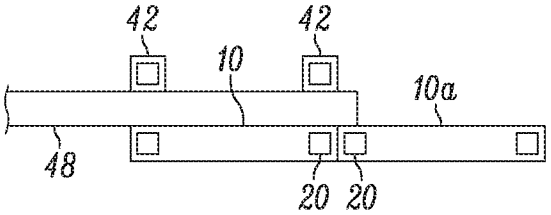
FIG. 36 is a cross section of a portion of FIG. 20 illustrating the connection between two magnetic building tiles.
Figure 38:
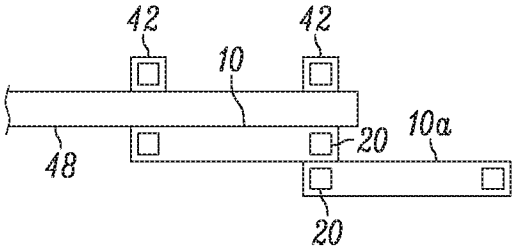
FIG. 38 is a cross section of an alternative connection between the two magnetic building tiles in FIG. 36

When magnetically connecting the tiles together, adjacent tiles may connect in an edge-to-edge connection (FIG. 36), an edge-to-face connection (FIG. 37), or a face-to-face connection (FIG. 38). In each of these connection configurations, the portions of the building tiles that connect to one another are proximate to the frame, which has the magnets disposed therein. As shown in FIG. 36 (which illustrates a cross section of a portion of FIG. 20), two tiles that connect edge-to-edge generally have an edge abutting the other tile. Though the tiles 10 and 10*a* are illustrated as disposed 180° from one another, other configurations and angles are anticipated. By one approach, the edges of the tiles are rounded. In the edge-to-face configuration, shown in FIG. 37, one tile may be disposed at any angle from the other tile (tiles 10 and 10*a* are illustrated at a 90° configuration for merely illustrative purposes) and the edge of one tile 10*a* is disposed adjacent the face of another tile 10 at or near the location of the magnets. As suggested above, if an edge-to-face connection is desired with a non-perpendicular configuration, a user may orient the tiles in such a configuration. In another configuration, shown in FIG. 38, a face-to-face connection is arranged by disposing the faces of two tiles, at or near the location of the magnets, adjacent to one another. Any of these connections may be employed when configuring the tiles into structures, and the preferred connection may depend on the desired structure.

Figure 11A:
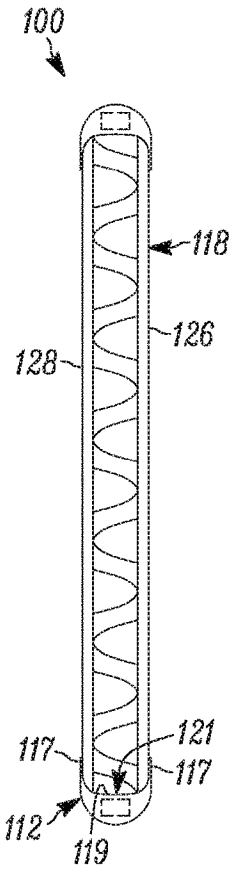
FIG. 11A is a cross sectional view of the tile of FIG. 10 with a frame.
Figure 10:
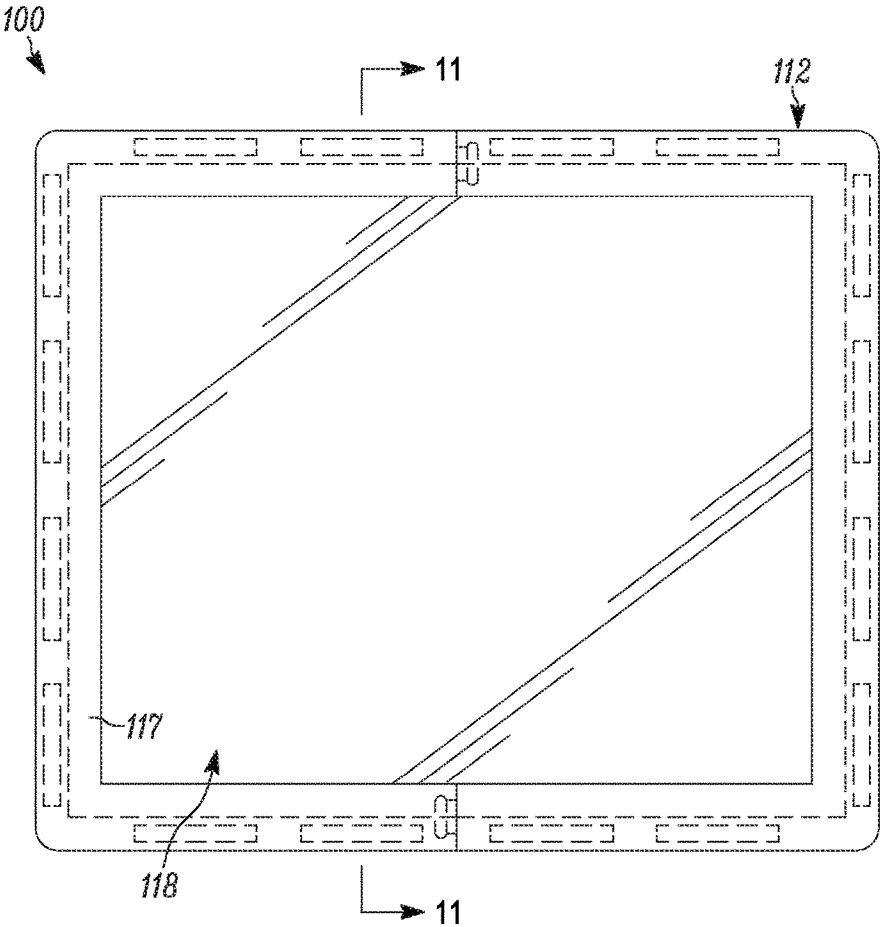
FIG. 10 is a front view of a tile in accordance with another embodiment.
Figure 11C:
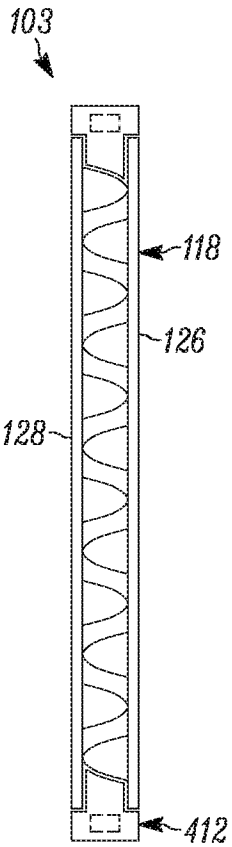
FIGS. 11B-C are cross sectional views of tiles in accordance with additional embodiments.
Figure 11B:
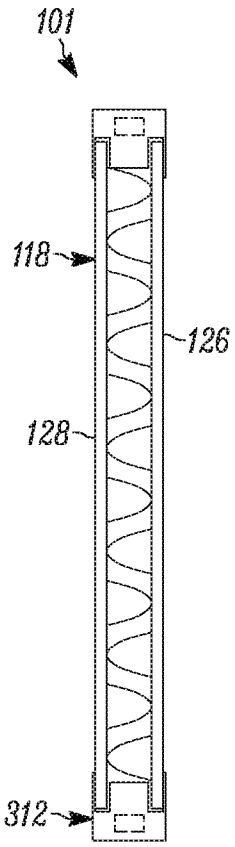

FIGS. 10 and 11A illustrate an alternative building tile 100. The building tile 100 is similar to the building tile 10 discussed above, except the tile frame 112 is generally disposed around and outside the edge of the tile panel 118, as opposed to within a channel 36 of the tile panel 18. FIG. 11B illustrates a building tile 101 that incorporates both a frame disposed around the edge of the panel and within the channel, and FIG. 11C illustrates a frame disposed within the channel and along the edge of the panel. As shown in FIGS. 11A-C, the tile panel 118 does not necessarily have the same channel as described above with respect to panel 18. In yet another embodiment, shown in FIG. 43, a single type of frame 712 may cooperate with a number of different panels 718*a*, 718*b*, 718*c*. Further, for some panels, such as panel 718*c*, the frame 712 and panel 718 can be engaged in more than one engaged configuration.

FIG. 10 illustrates a panel 118 having a panel perimeter or edge 119 disposed within the frame 112. In one embodiment, the frame 112 includes a pair of arms 117 that each extend on either side of the panel 118, as shown in the illustrative embodiment of FIG. 11A. Further, the tile frame 112 has a channel 121 into which an edge of the tile panel 118 is secured. In this configuration, the tile frame 112 is disposed around the edge of the tile panel 118 and the frame 112 generally does not extend in between the two panel walls 126, 128.

Another embodiment, shown in FIG. 11B, includes a building tile 101 having a tile frame 312 that is disposed around the edges of the panel 118 and is partially disposed in between the two panel walls 126, 128. Such a configuration may be desirable to ensure a very secure fit between the tile panel 118 and the tile frame 312.

Figure 41:
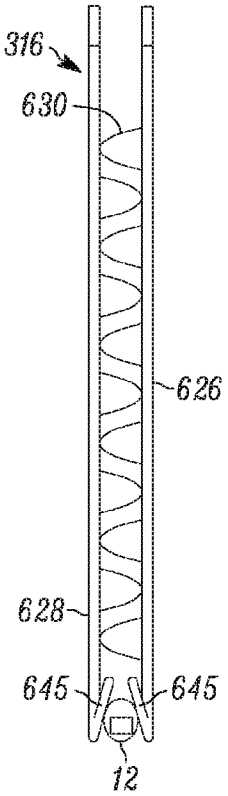
FIG. 41 is a cross-sectional view of the panel of FIG. 40 with another frame engaged therewith.
Figure 40:
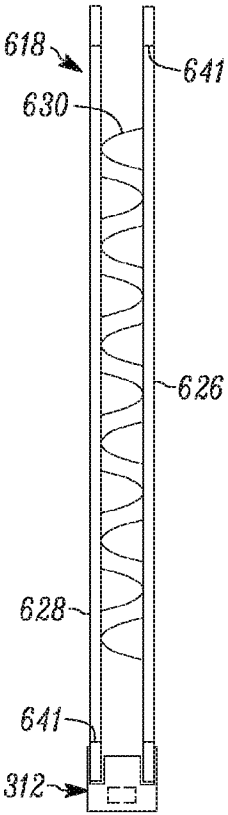
FIG. 40 is a cross-sectional view of the panel of FIG. 39 with a frame engaged therewith.
Figure 39:
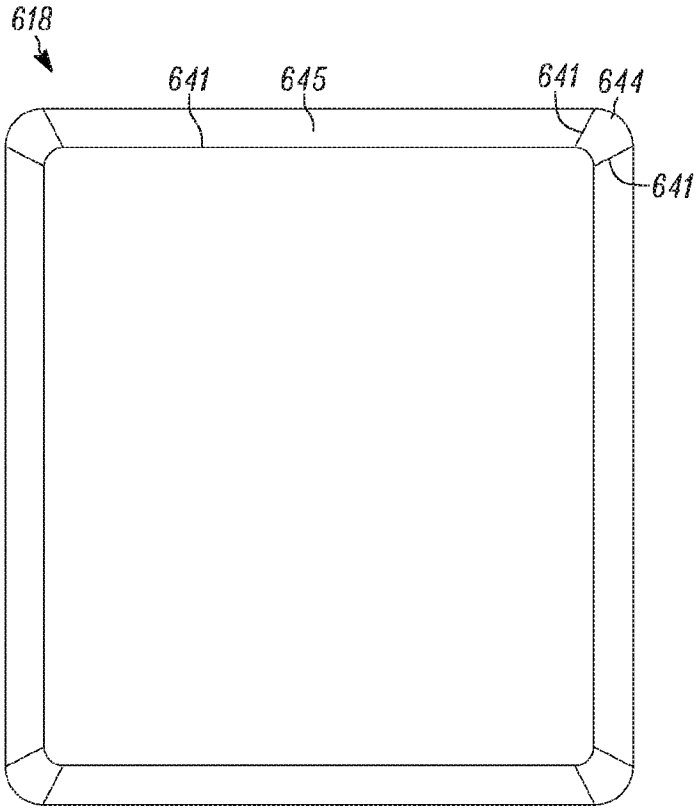
FIG. 39 is a front view of an alternative panel.

In yet another configuration, the building tile 103 has a tile frame 412 that extends in between the walls 126, 128 of the panel 118 and along the edge of the panel, but not along the outside surfaces of the walls 126, 128. The embodiment illustrated in FIG. 11C is similar to the embodiment of FIG. 1, though in FIG. 11C the frame 412 extends outwardly from the perimeter of the panel 118 and covers the end surfaces of the side walls 126, 128 such that the magnets are disposed outwardly of the panel perimeter as well. As discussed above, the panels may have a channel into which the frame extends (see, e.g., FIGS. 7-9) and/or the frame may have a channel into which a panel can extend (see, e.g., FIGS. 10-11C), among others. Though the panel 118 may be engaged by three different frames 112, 312, 412, it may be desirable to have a panel that also can be engaged by the frame 12 illustrated in FIG. 3. FIGS. 39-41 illustrate a convertible tile panel 618 that is adjustable for use with many of the tile frame configurations described herein.

Figure 42:
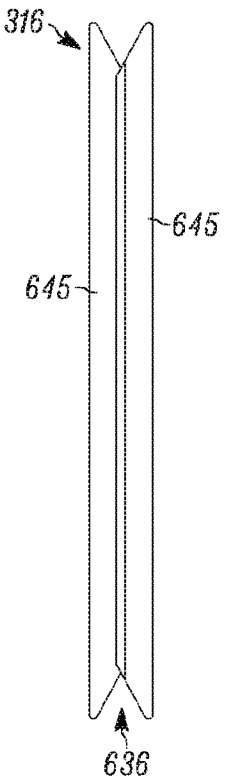
FIG. 42 is a side view of the panel of FIG. 39 without a tile frame.

In one approach, the convertible tile panel 618 has two panel walls 626, 628 with a connecting member 630 therebetween and a crease, score, or line of weakness 641 on the walls 626, 628 disposed proximate the edge of the walls. This line of weakness 641 permits the panel 618 to be folded or bent into another configuration. For example, a margin 645 of the panel 618, which is disposed outside of the line of weakness 641, can be manipulated or folded in between the two panel walls 626, 628 as shown in FIG. 42. To assist with the manipulation of the tile panel 618, in one exemplary embodiment, the tile panel 618 may include corner portions 644 that can be removed from the remainder of the panel 618 to facilitate configuration of the remainder of the panel 618 into the folded configuration. Further, it is possible that the margins 645 also may be removed from the panel 618 prior to use with any of the frames described herein.

FIG. 40 illustrates an unfolded convertible panel 618 having one end of the panel 618 engaged with a tile frame 312. In this configuration, the tile panel 618 remains unfolded. Alternatively, a portion of the tile panel 618 beyond the line of weakness 641 may be folded over, as shown in FIGS. 41 and 42. In this manner, the tile panel 618 can receive a tile frame 12 in the channel 636 formed in between the two portions or margins 645 that are folded in between the panel walls 626, 628. It is also anticipated that the margin 645 might be entirely removed from the panel 618, depending on the design of the frame that is to be disposed within the channel 636.

Figure 43:
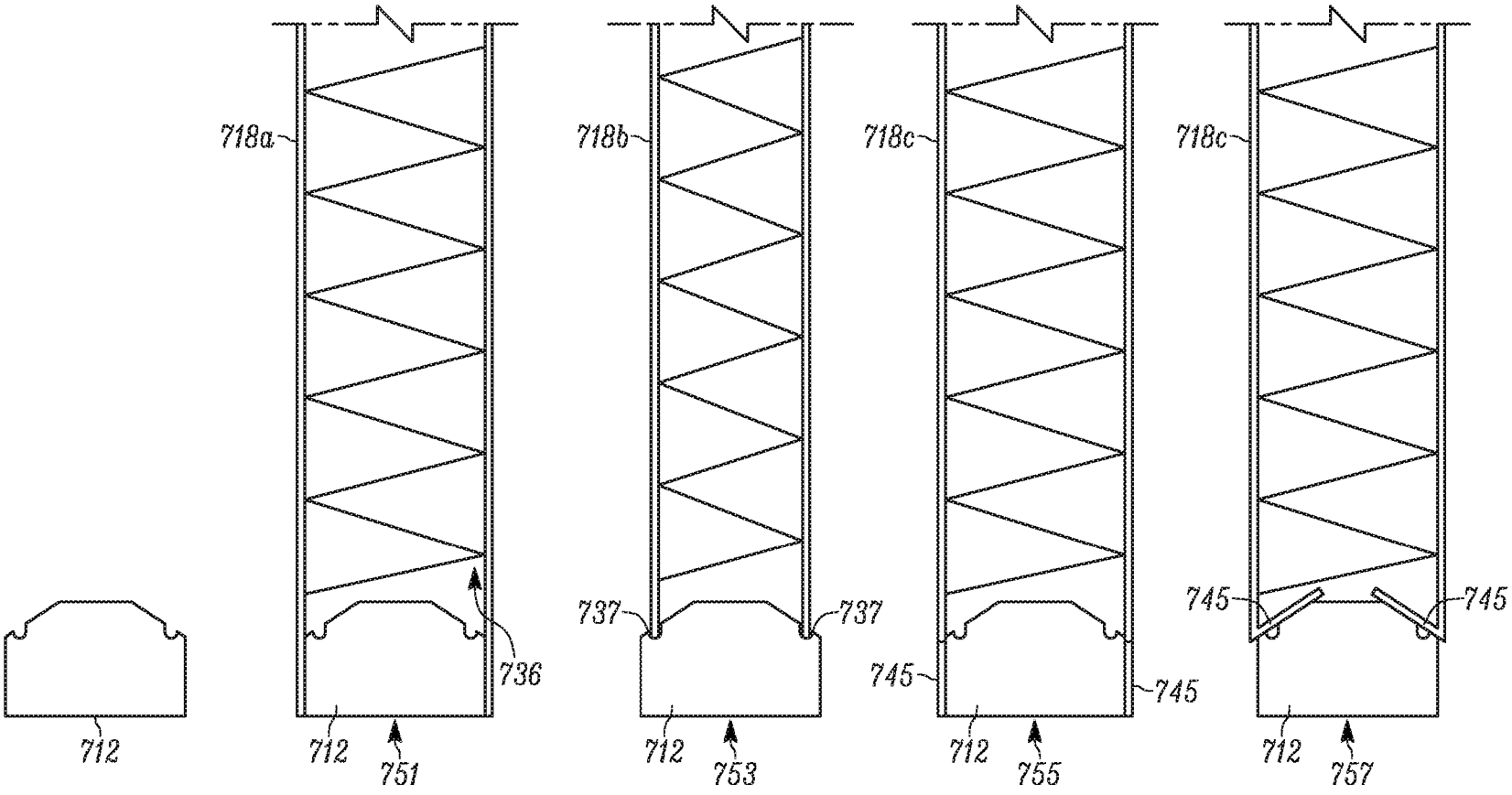
FIG. 43 is a schematic cross-sectional view of a frame engaging different panels.

In one exemplary embodiment, illustrated in FIG. 43, a tile frame 712 may be engaged with a number of different panels. The building tile configuration of 751 (which is similar to the building tile 10 shown in FIG. 1) includes frame 712 that is disposed in a channel 736 of panel 718*a*. The building tile configuration of 753 has panel 718*b* engaging channels 737 disposed in frame 712. As illustrated in FIG. 43, the panels 718*a*, 718*b*, though similar, have different widths. The building tile configurations 755 and 757 include a convertible panel 718*c*, similar to panel 618 discussed above, and illustrate how the frame 712 and the panel 718*c* can be used in two different arrangements. The building tile configuration 755 has the frame 712 disposed within the margins 745 of the convertible panel 718*c*, whereas in building tile configuration 757, the panel margins 745 are folded inward and the frame 712 engages the margins 745 disposed in the channel 736

FIGS. 1-11 depict building tiles 10, 100 with a generally square configuration when viewed from the front. As shown in FIG. 31, additional configurations are possible, such as, a rectangular-shaped building tile 13, triangular-shaped building tiles 25, 125, and an oval-shaped building tile 17, among others. Indeed, the shapes illustrated are merely exemplary and many other shapes and configurations are possible within the scope of these teachings. A variety of shapes can be employed with building tiles, e.g., building tiles 10, having a channel in the tile panel or with building tiles, e.g., building tiles 100, having a channel in the tile frame. In yet another configuration, the building tiles may not include a channel on the frame or panel such that the frame and panel are associated with one another in another fashion, such as by fasteners, a snap-fit connection, and/or a friction-fit connection. Further, the variety of shapes (rectangular, triangular, oval, circular, etc.) and configurations (channels on the tile panel, channels on the tile frame, or no channel) may be used together to form a myriad of building structures.

Figure 12:
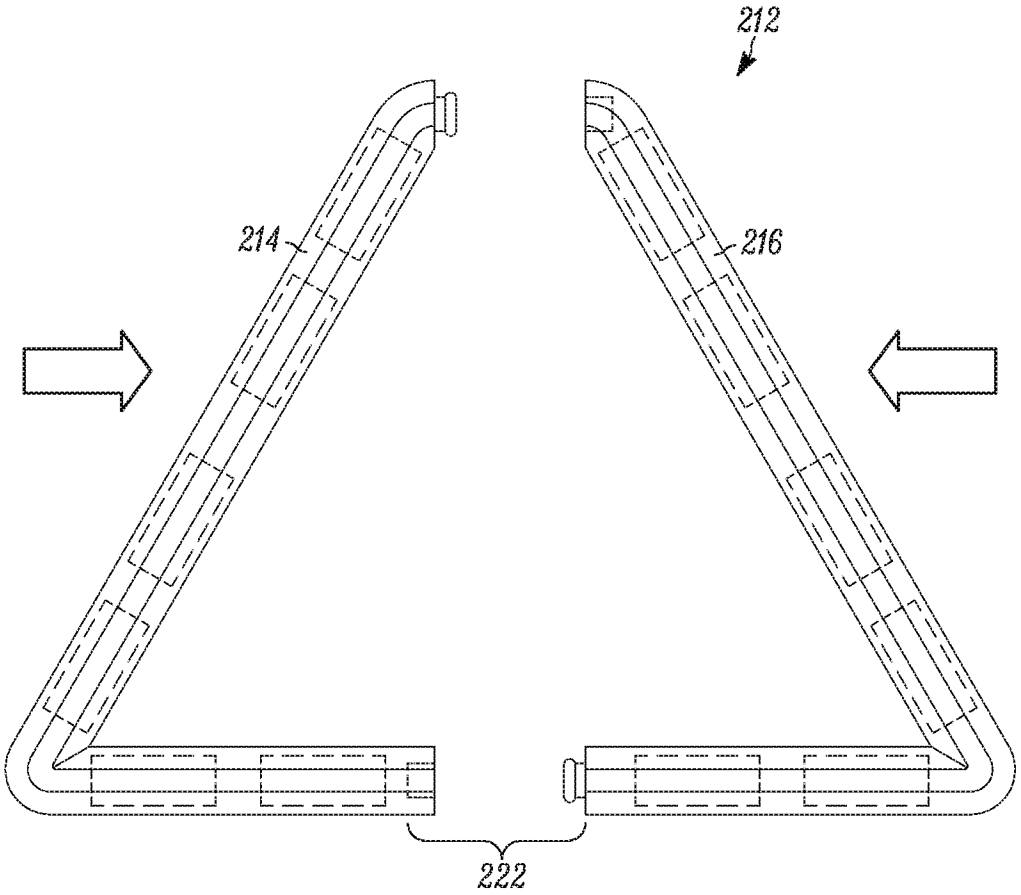
FIGS. 12-13 illustrate a frame in accordance with another embodiment.
Figure 13:
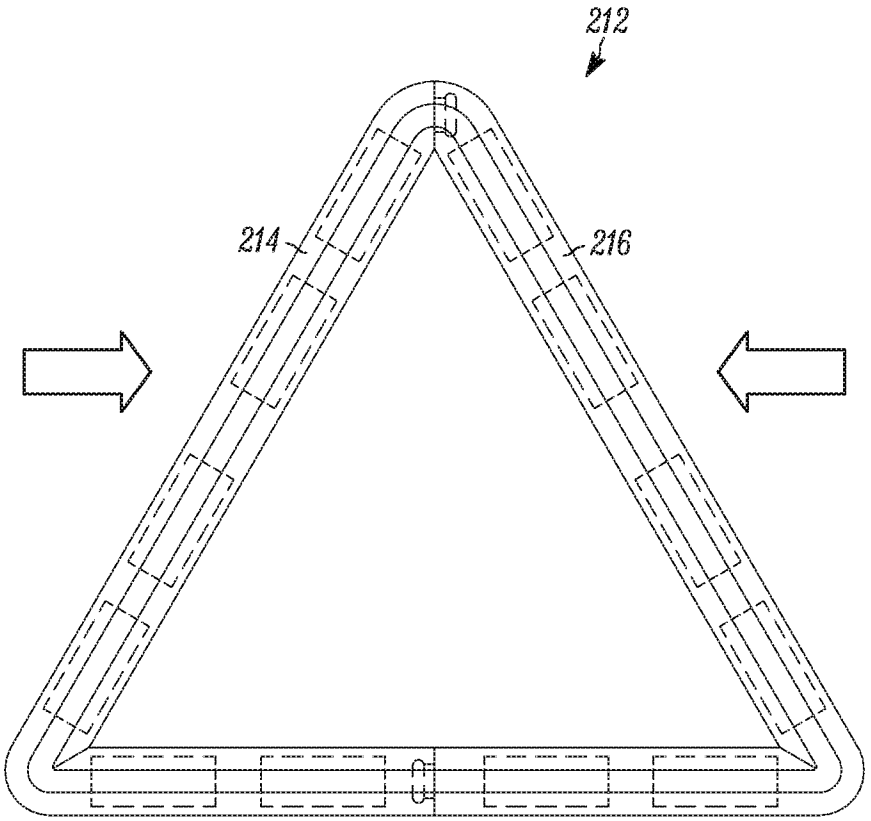
Figure 15:
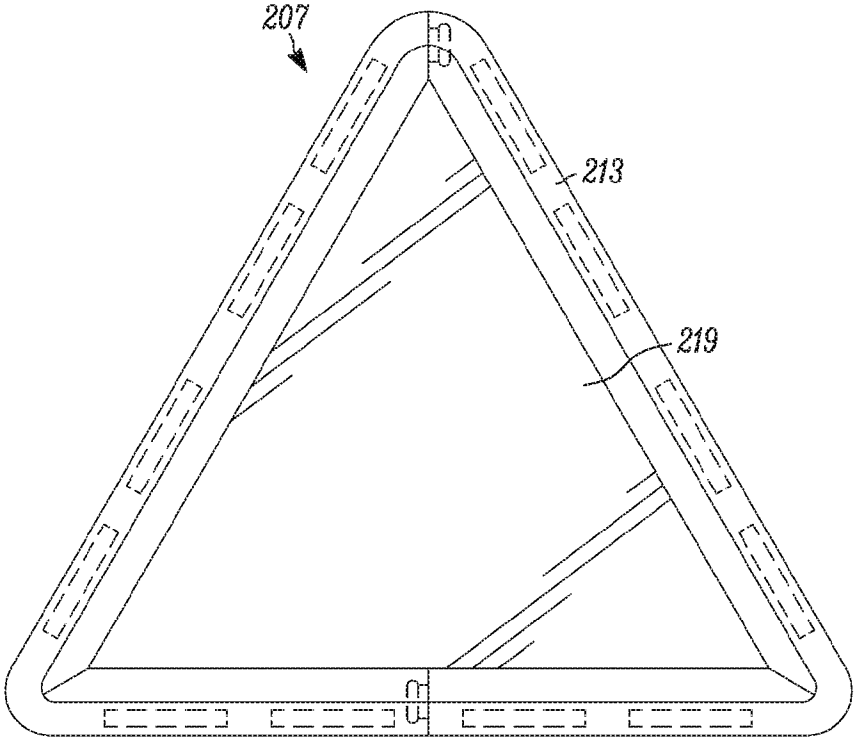
FIG. 15 is a front view of another magnetic building tile with a panel that exposes the frame from the front view.
Figure 14:
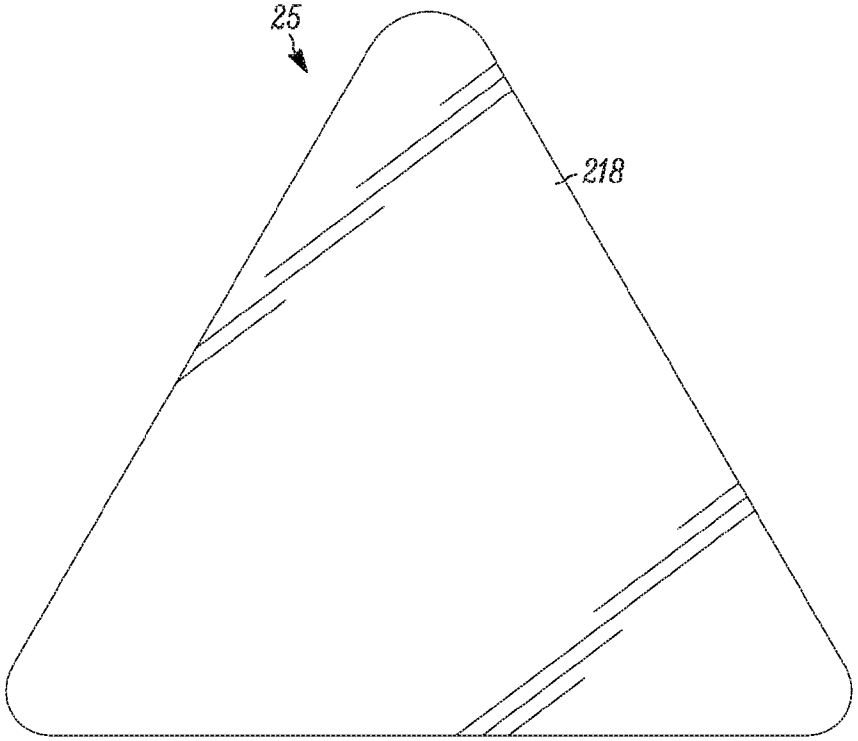
FIG. 14 is a front view of the magnetic building tile of FIGS. 12-13 with a panel that covers the frame from the front view.

FIGS. 12 and 13 illustrate one exemplary embodiment of a triangular frame element 212 with a first frame portion 214 and a second frame portion 216 that may connect via connection mechanism 222 that is similar to those discussed above. FIGS. 14 and 15 illustrate two formed building tiles 25, 207. Triangular building tile 25 has a panel 218 with a channel into which the tile frame extends. Triangular building panel 207 has a triangular tile frame 213 that has a channel into which the panel 219 extends.

Figure 44:
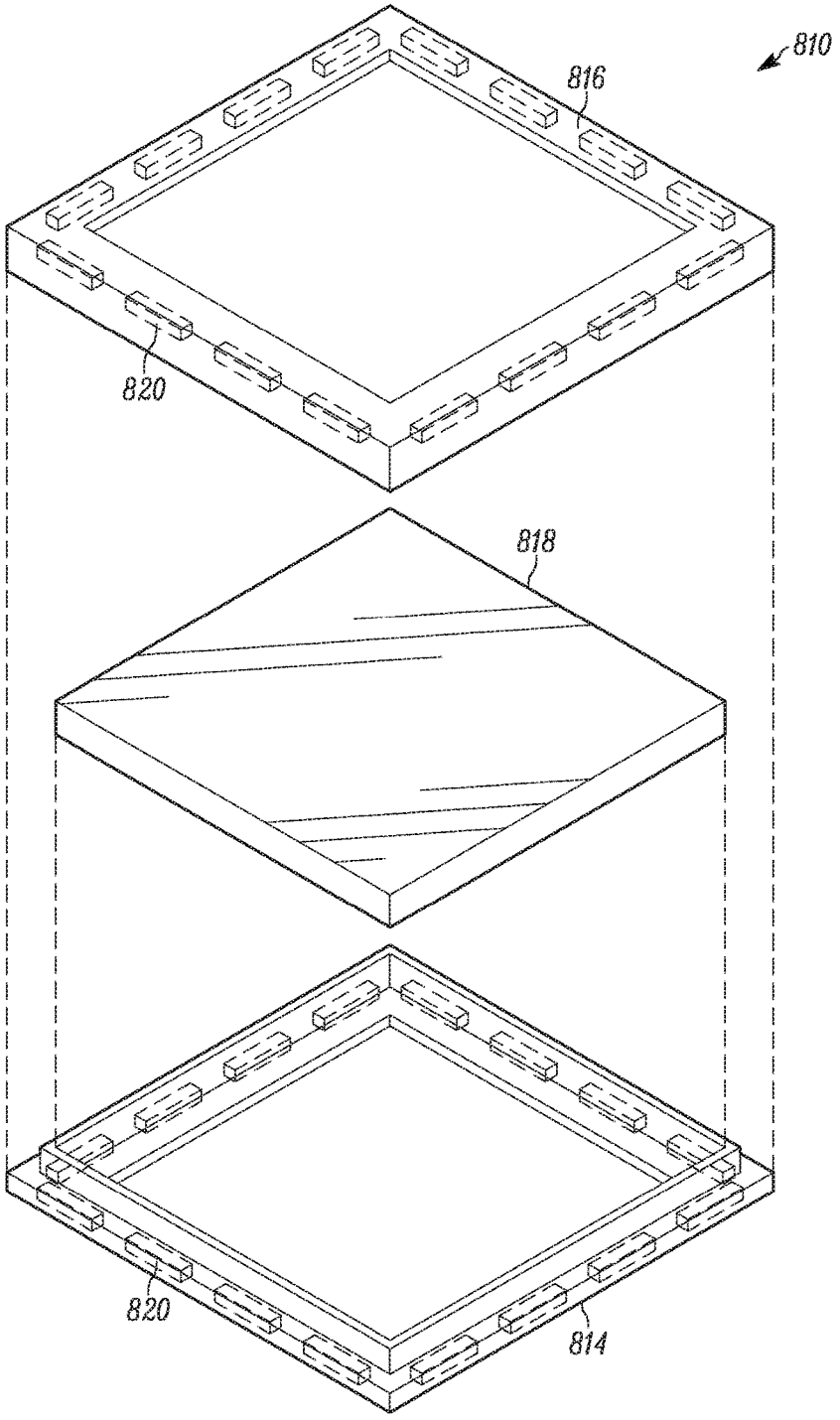
FIG. 44 is an exploded view of an additional embodiment.
Figure 45:
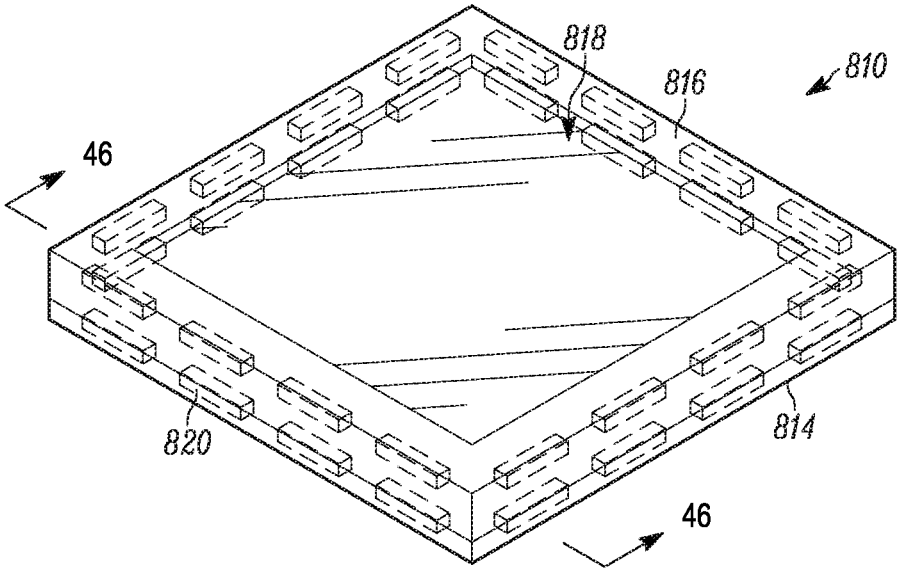
FIG. 45 is a perspective view of the magnetic building tile of FIG. 44.
Figure 46:
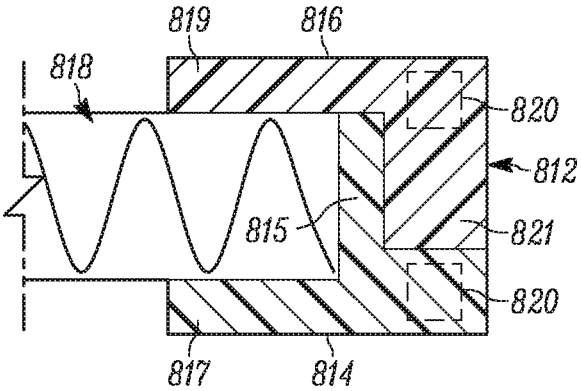
FIG. 46 is a partial schematic cross-sectional view of the magnetic building tile of FIG. 44.

FIGS. 44-46 illustrate an alternative building tile 810. The building tile 810 includes a tile frame 812 and a tile panel 818 that are configured to mate together. The frame 812 may have a first frame portion 814 and a second frame portion 816 that are connectable to one another around at least portions of the panel 818 such that the frame 812 is securely mated to the tile panel 818, as shown in FIGS. 45 and 46. In one configuration, the tile frame 812 is disposed around the edge of the tile panel 818. More specifically, the first frame portion 814 may be snap-fit together with the second frame portion 816 around the edge of the tile panel 818. FIG. 46 illustrates the first frame portion 814 having a flange 817 disposed near an edge of the tile panel 818 along a face of the tile panel 818 and the second frame portion 816 having a flange 819 disposed near an edge of the tile panel 818 along an opposing face of the tile panel 818. In this manner the tile panel 818 is tightly and securely captured between the two frame portions 814, 816. In one embodiment, an edge portion of the tile panel may be pinched or compressed between the frame portions such that the edge portion has a slightly reduced thickness where it is gripped by the frame portions. To secure the two frame portions 814, 816 relative to one another, the first and second frame portions 814, 816 have respective first and second walls 815, 821 that tightly snap-fit together. In other embodiments, the two frame portions 814, 186 may be secured together by other fastening elements. Further, the wall 815 may help retain the tile panel 812 securely between the first and second frame portions 814, 816, as shown in FIG. 46.

Similar to previous embodiments, the building tile 810 may include a magnet, or a plurality of magnets 820, in the tile frame 812. The magnets 820 may be disposed in both the first and second frame portions 814, 816 and the magnets also may be limited to one or the other of the first and second frame portions 814, 816.

Figure 47:
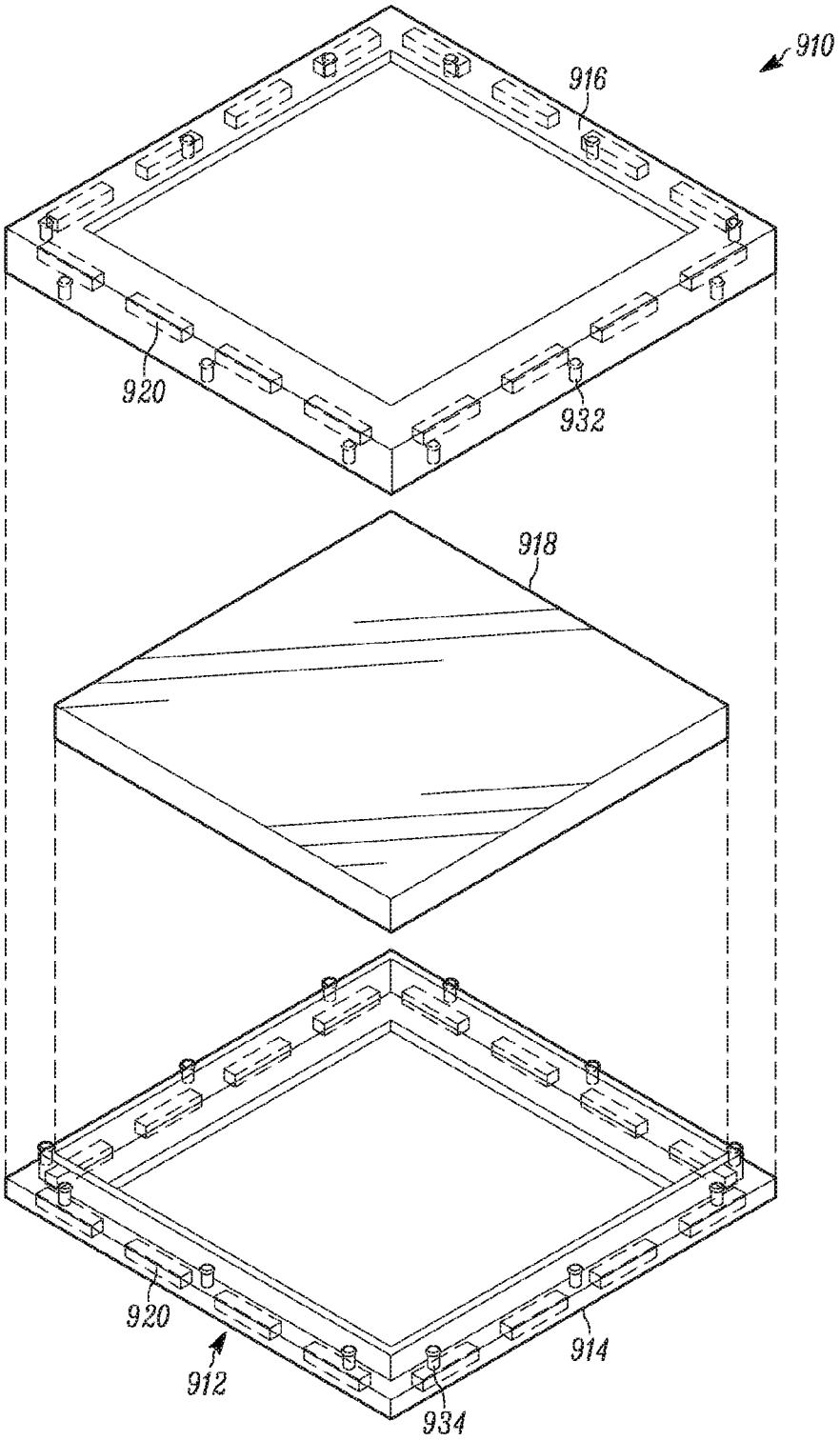
FIG. 47 is an exploded view of an additional embodiment.
Figure 48:
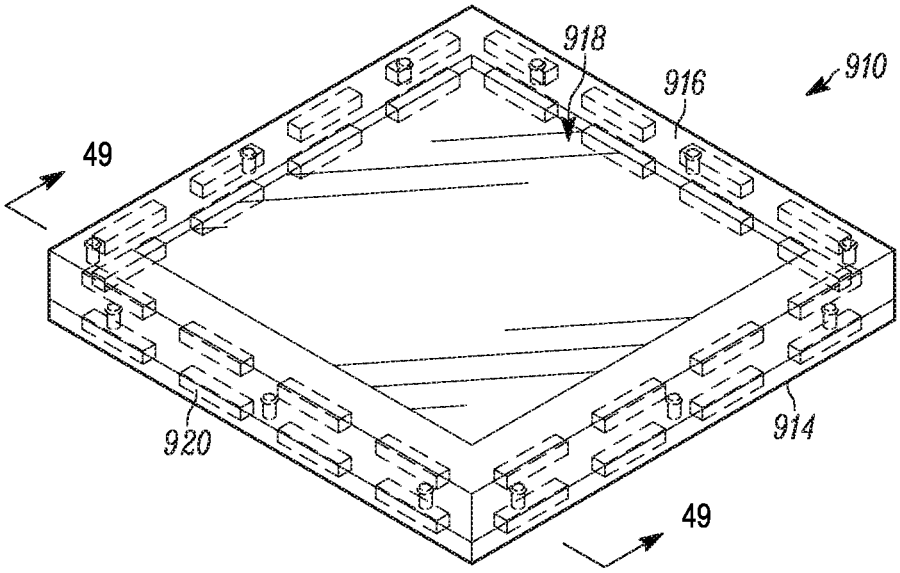
FIG. 48 is a perspective view of the magnetic building tile of FIG. 47.
Figure 49:
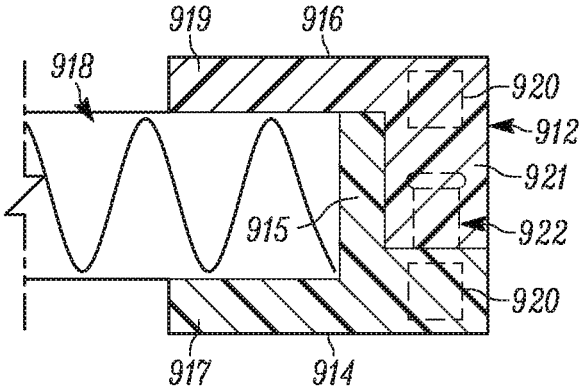
FIG. 49 is a partial schematic view of the magnetic building tile of FIG. 47.

FIGS. 47-49 illustrate an alternative building tile 910. The building tile 910 includes a tile frame 912 and a tile panel 918 that are configured to mate together. The frame 912 may have a first frame portion 914 and a second frame portion 916 that are connectable to one another around at least portions of the panel 918 such that the frame 912 is securely mated to the tile panel 918, as shown in FIGS. 48 and 49. In one configuration, the tile frame 912 is disposed around the edge of the tile panel 918. More specifically, the first frame portion 914 may be snap-fit together with the second frame portion 916 around the edge of the tile panel 918. FIG. 49 illustrates the first frame portion 914 having a flange 917 disposed near an edge of the tile panel 918 along a face of the tile panel 918 and the second frame portion 916 having a flange 919 disposed near an edge of the tile panel 918 along an opposing face of the tile panel 918. One of the first and second panels 914, 916 also may have a wall, such as a wall 915 or 921 to help retain the panel 918. In this manner, the tile panel 918 is securely captured between the two frame portions 914, 916.

To secure the two frame portions 914, 916 relative to one another, the first and second frame portions 914, 916 may have respective first and second walls 915, 921 that tightly snap-fit together. In addition to the first and second walls 915, 921, or instead of the walls, the first and second frame portions 914, 916 may include a connection mechanism 922 having a first joint portion 932 and a second joint portion 934 (FIG. 47) that mate together. The first joint portion 932 may include a recess, and the second joint portion 934 may include a protrusion, extension, or catch. The first and second joint portions 932, 934 are disposed along the faces of the first and second frame portions 914, 916 that are coextensive with or abut one another when the tile frame 912 and tile panel 914 are securely mated together. Though FIG. 47 illustrates a segment or side of the tile panel 912 having three connection mechanisms 922 disposed thereon, a greater or lesser number may be employed.

Similar to previous embodiments, the building tile 910 may include a magnet, or a plurality of magnets 920, in the tile frame 912. The magnets 920 may be disposed in both the first and second frame portions 914, 916 and the magnets also may be limited to one or the other of the first and second frame portions 914, 916.

Figure 55:
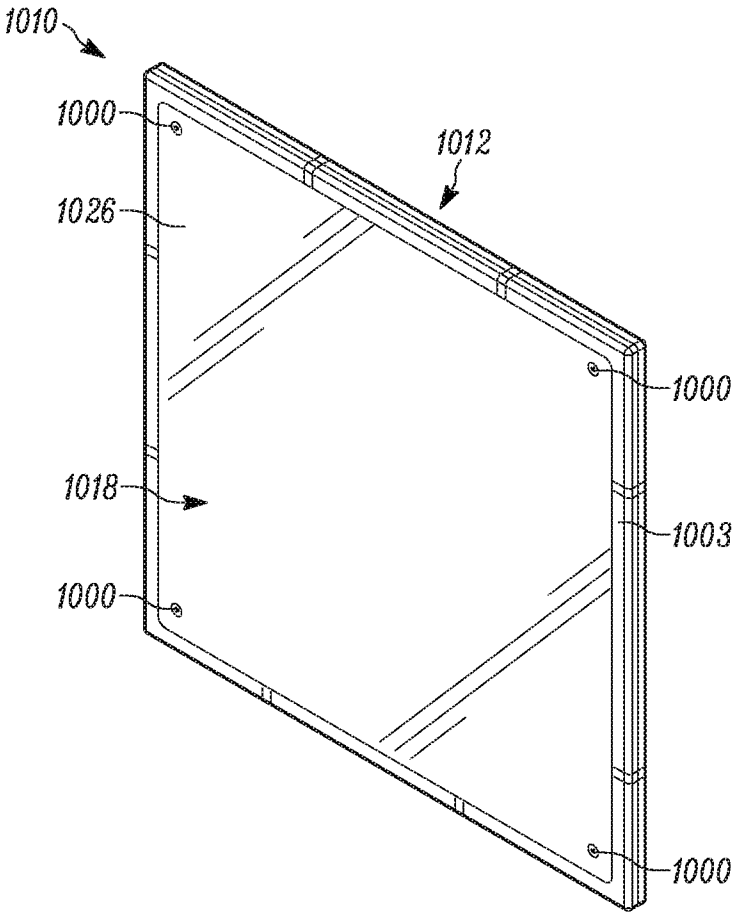
FIG. 55 is a perspective view of another magnetic building tile.
Figure 59:
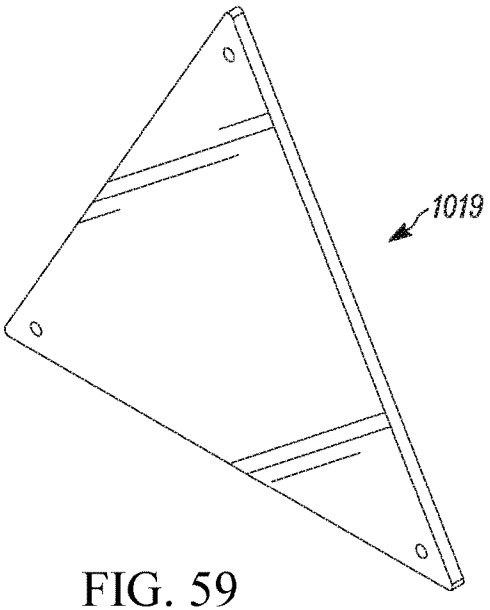
FIG. 59 is a perspective view of an additional panel embodiment.

FIG. 55 illustrates another exemplary magnetic building tile. The building tile 1010 has a magnetic tile frame 1012 that mates with a tile panel 1018. The magnetic tile frame 1012 is connected to the tile panel 1018 by a connection mechanism, such as a peg, protrusion, extension, catch, friction fit or snap-fit element 1000 (see, e.g., FIG. 50). The peg 1000 disposed on the tile frame 1012 mates with corresponding holes or openings 1001 in the tile panel 1018. The peg 1000 and the openings 1001 are friction or snap-fit together to ensure that the two elements are securely connected to one another when assembled as a building tile 1010.

Figure 92:
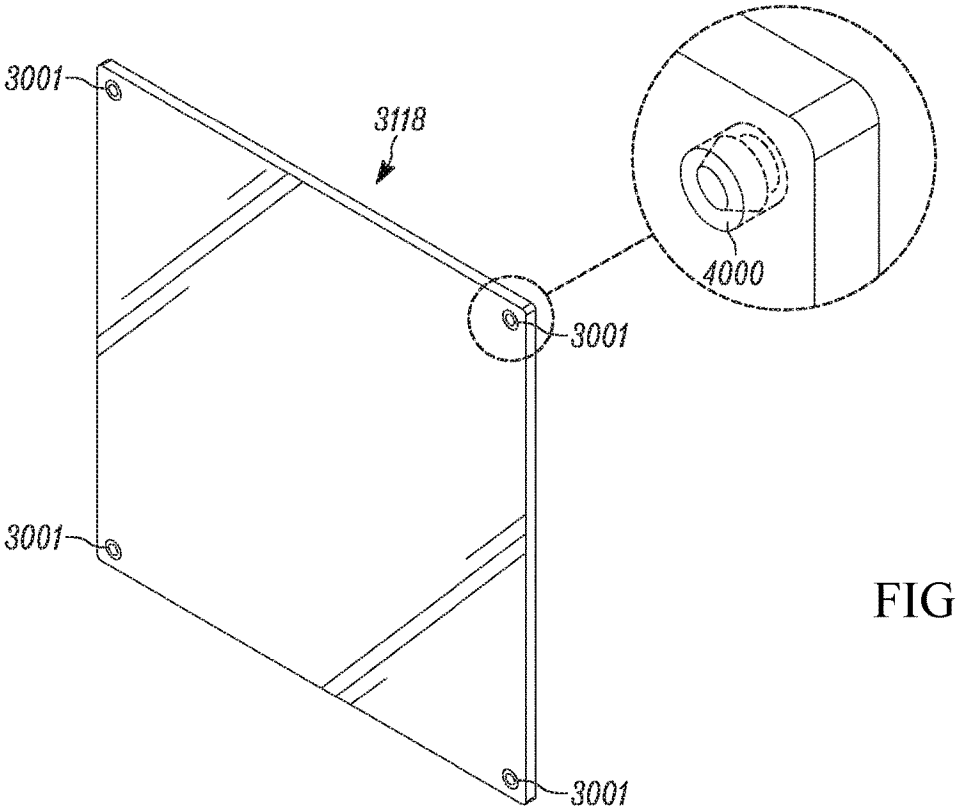
FIG. 92 is a perspective view of another panel.

As noted, a number of connection mechanisms between the frame 1012 and the panel 1018 may be employed. In addition, to improve the connection between the tile frame 1012 and the tile panel 1018 additional elements may be incorporated therein. For example, the panel 3018, shown in FIG. 92, may include a fitting within or around the openings 3001 to improve or strengthen the interference or friction fit between the two elements. The fitting 4000 may be an inset fitting, retainer, grommet, eyelet, or lining of the opening 3001. By one approach, the fitting 4000 is comprised of a material having an increased coefficient of friction as compared to the material comprising the remainder of the panel 3118. By another approach, the fitting 4000 may help retain the shape or configuration of the opening 3001 to permit the panel 3118 to be detached and reattached to frames many times. In yet another approach, the fitting 3001 may be external to the panel.

Similar to the frame previously discussed, the frame 1012 has magnets 1020 disposed therein such that the frame can be magnetically attracted and attached to another magnetic frame, tile, or connector. Like the frames previously discussed, a plurality of interchangeable panels can be releasably and stably supported therewith to form a building tile. One of the panels can be easily inserted into and removed from the frame to create tiles of different appearances by changing panels.

The frame 1012 also may be a single or one-piece construction to which the user may simply secure a removable tile panel. In this manner, the removable panel 1018 can be releasably and stably supported in the frame 1012 to form a building tile 1010 without disassembling the frame 1012. More particularly, each of the panels 1018 can be placed in a position of stable equilibrium within the frame 1012 or removed therefrom simply by manually applying pressure to the panels 1018 and frame 1012 without disassembling or permanently deforming any part of either the frame or the panel. In addition, this attachment and detachment can be accomplished without the use of tools. Though the user may manipulate a one-piece frame 1012, the frame itself may nonetheless have been manufactured in a plurality of steps or components and assembled into the single element to which the tile panels 1018 are attached.

Though illustrative frame 1012 has a one-piece configuration when in use, the pegs 1000 or similar fasteners also may be incorporated into a frame that has a plurality of releasable and connectable frame elements or portions with a connecting member and/or a channel, such as those described above.

Figure 50:
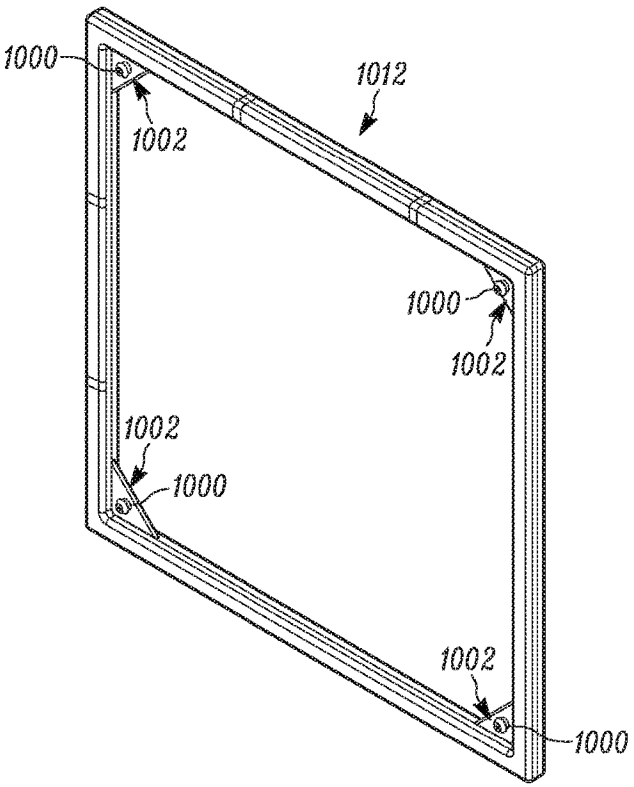
FIG. 50 is a perspective view of an additional frame embodiment.
Figure 52:
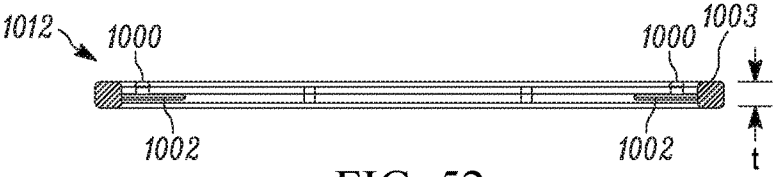
FIG. 52 is a cross sectional view of the frame of FIG. 50 taken along line 52-52.

By one approach, the pegs 1000 are disposed on a brace, strengthening rib, bracket, or support member 1002. In one embodiment, the support members 1002 are disposed near the corners of the frame 1012. One illustrative frame 1012, shown in FIG. 50, has four legs forming four corners, which may be spanned by the support members 1002. As shown in FIG. 50, the support members 1002 are disposed near the corners of the frame 1012. The support member 1002 may have a variety of shapes including the wedge or triangle illustrated in FIG. 51, though in other configurations, the support member 1002 is merely a strip member that spans the distance between two of the legs of the frame. By one approach, the support member 1002 is disposed about halfway through the thickness of the frame 1012. As shown in FIG. 52, the support member 1002 has two sides and a first side from which the peg 1000 extends is disposed approximately in the middle of the thickness of the frame 1012.

As shown, the pegs 1000 extend from a first side of the support member 1002 and may extend such that they are approximately the same height as an edge, surface, or first side 1003 of the frame 1012. In this manner, when the panels 1018 are secured to the frame 1012 the resulting panel wall 1026 is flush with the top of the peg 1000 and a frame surface 1003 of the frame 1012. By one approach, if the frame 1012 is about 0.25-inches (about 6.35 mm) in height, the first side surface of the support member 1002 may be disposed about 0.125-inch (about 3.175 mm) from the outer surface or first side 1003 of the frame 1012.

Unlike some of the panels previously discussed, tile panel 1018 lacks a connecting element and a channel. Instead, the panel 1018 is a single element with opposing sides. Like previous panels described, the panels 1018 may be formed of a variety of materials, such as, for example, cardboard, paperboard, plastic, composites, metal, or wood. In some embodiments, the panels 1018 may have a coating of material that enables the user to easily decorate and redecorate the surface of the panel 1018. As suggested above, the panel 1018 is approximately the same thickness as the peg 1000 such that the peg 1000, a side surface 1026 of the panel 1018, and the first frame surface 1003 of the frame 1012 are flush with one another when the panel 1018 and the frame 1012 are assembled together.

Figure 51:
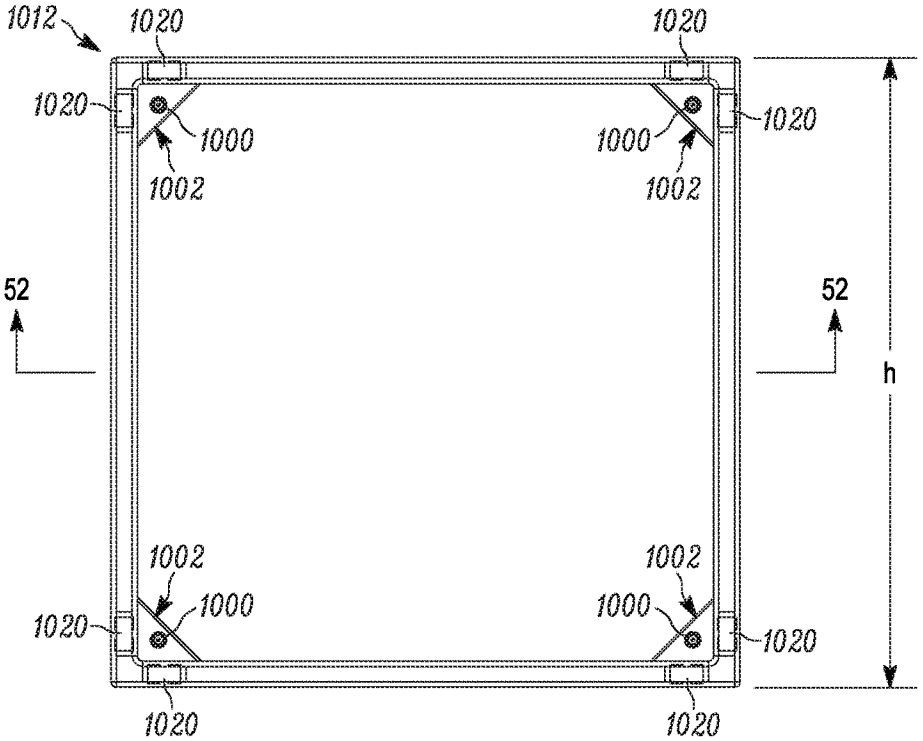
FIG. 51 is a front view of the frame of FIG. 50.

As discussed above, the building tiles, such as tiles 1010 may have a height or a width of between about 2 to about 50 centimeters (about 0.79 to about 19.7-inches) and a thickness of between about 0.25 to about 2.0 centimeters (about 0.098 to about 0.79-inches), among other ranges. In one illustrative embodiment, the square building frame 1012 has a height or width of about 10.16 to about 16.51 centimeters (about 4.0 to about 6.5-inches). In yet another configuration, the height, h, or width is about 10.8 centimeters (about 4.25-inches), as shown in FIG. 51. In this manner, the square building frame is about 4.25-inches by 4.25-inches in dimension. In another illustrative configuration, the height may be about 15.24 cm (about 6.0-inches) such that the frame is about 6-inches by 6-inches. In one configuration, the building frame 1012 may have a thickness, t, of about 0.5 to about 0.8 centimeters (about 0.2 to about 0.3-inch). By another approach, the building frame 1012 may have a thickness, t, of about 0.65 centimeters (about 0.25-inch), as shown in FIG. 52.

Furthermore, each of the legs or lengthwise sections of the building frame 1012 may be about 0.64 centimeters (about 0.25-inch) in width, w, such that the central opening of the building tile 1012 is between about 8.9 cm (3.5-inch) to about 15.2 cm (6.0-inch) if the height is between about 10.2 cm (4.0-inch) to about 16.5 cm (6.5-inch). In one illustrative configuration, the central opening is about 9.5 centimeters (about 3.75-inch). In this manner, the square panel 1018 that mates with the frame 1012 is about 9.5 centimeters by 9.5 centimeters (about 3.75-inch by 3.750 inch). Further, the panel 1018 may have a thickness of about 0.32 centimeters (about 0.125-inch). As the first surface of the support member 1002 is disposed about halfway through the height of the building frame 1012, the panel 1018 is flush or nearly flush with the top edge of the building frame 1012 when the two are mated together.

Figure 54:
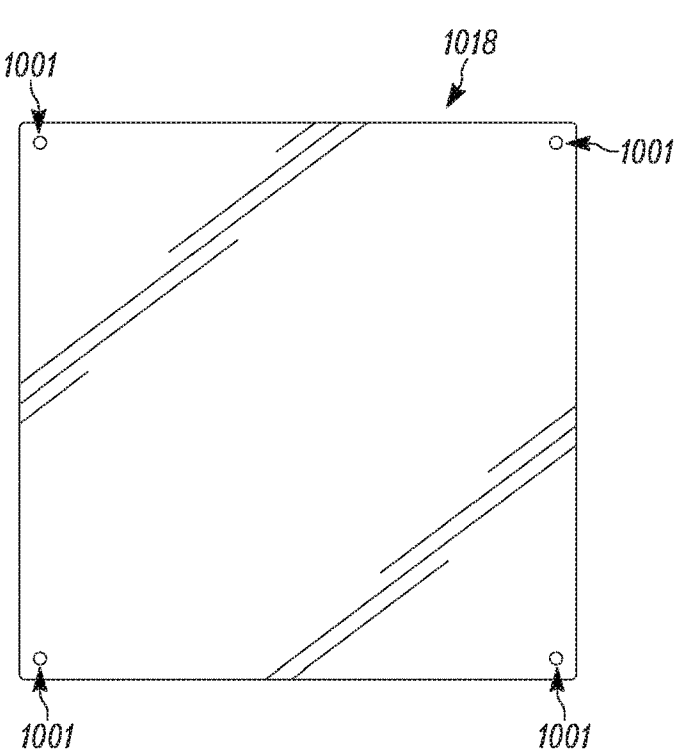
FIG. 54 is a front view of the panel of FIG. 53.
Figure 53:
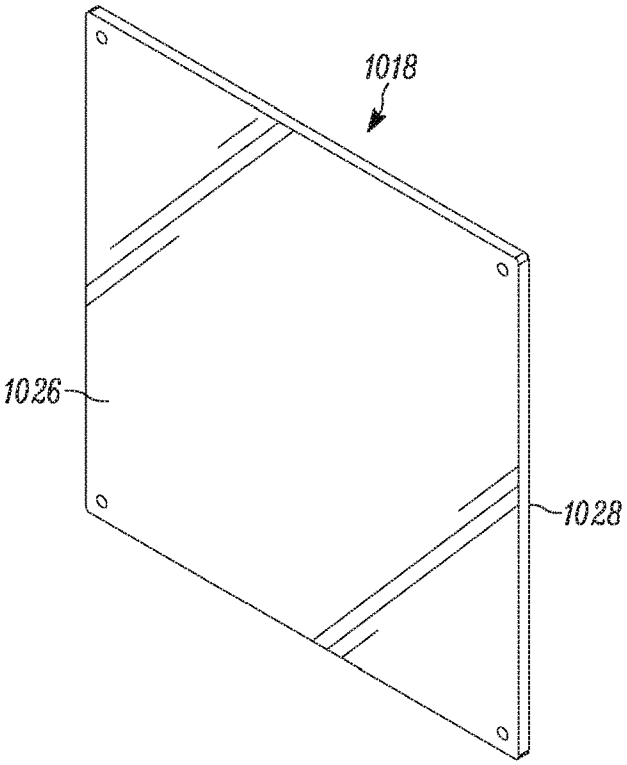
FIG. 53 is a perspective view of an additional panel embodiment.

The square magnetic frames 1012 (shown in FIGS. 50-52) mate with the corresponding square panel 1018 illustrated in FIGS. 53 and 54. The openings 1001 are disposed proximate the corners such that they easily mate with the pegs 1000 when the tile 1012 is assembled, as shown in FIG. 55. The magnetic frames and associated panels also may have a number of different shapes or sides, such as, for example, a pentagonal shape, a hexagonal shape, and a triangular shape, such as an equilateral or an isosceles shape, among others. These alternative shapes may have a range of dimensions similar to those described above. By another approach, the magnetic tiles, frames, and panels may have a circular or oval shape, among others.

Figure 58:
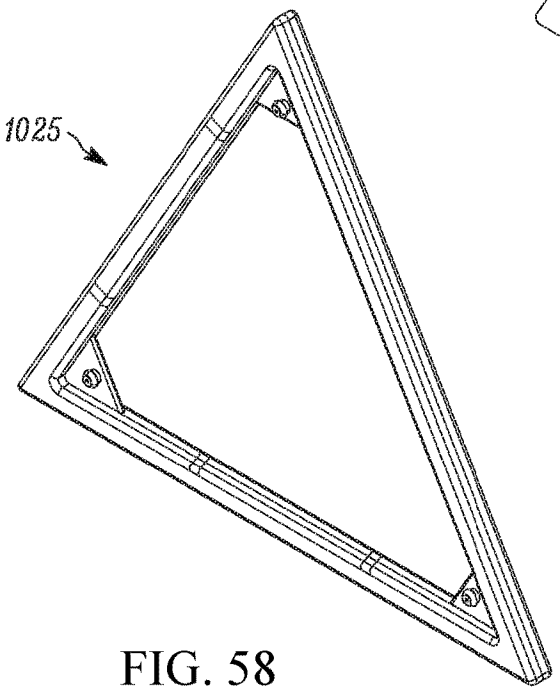
FIG. 58 is a perspective view of an additional frame embodiment.

Further, one illustrative triangular frame 1025, shown in FIG. 58, has an equilateral shape and can be mated with the triangular panel 1019. By one approach, the triangular frame 1025 may have legs with a length of about 15.24 centimeters (about 6.0-inches) and the triangular panel 1019 may have sides with a length of about 12.5 centimeters (about 4.96-inches). Another triangular frame 1007 shown in FIG. 60 has an isosceles shape and can be mated with the triangular panel 1015. By one approach, the triangular frame 1007 has one leg with a length of about 15.16 centimeters (about 5.97-inches) and two other legs with a length of about 30 centimeters (about 11.81-inches). Accordingly, the triangular panel 1015 may have one side with a length of about 13.3 centimeters (about 5.23-inches) and two other sides with a length of about 26.54 centimeters (about 10.45-inches). In yet another approach, the triangular frame 1025 may have legs with a length of about 10.5 centimeters (about 4.25-inches) and the triangular panel 1019 may have sides with a length of about 8.9 centimeters (about 3.51-inches). Another triangular frame 1007 shown in FIG. 60 has an isosceles shape and can be mated with the triangular panel 1015. By one approach, the triangular frame 1007 has one leg with a length of about 10.7 centimeters (about 4.23-inches) and two other legs with a length of about 21.2 centimeters (about 8.36-inches). Accordingly, the triangular panel 1015 may have one side with a length of about 9.4 centimeters (about 3.7-inches) and two other sides with a length of about 18.8 centimeters (about 7.4-inches).

Figure 93:
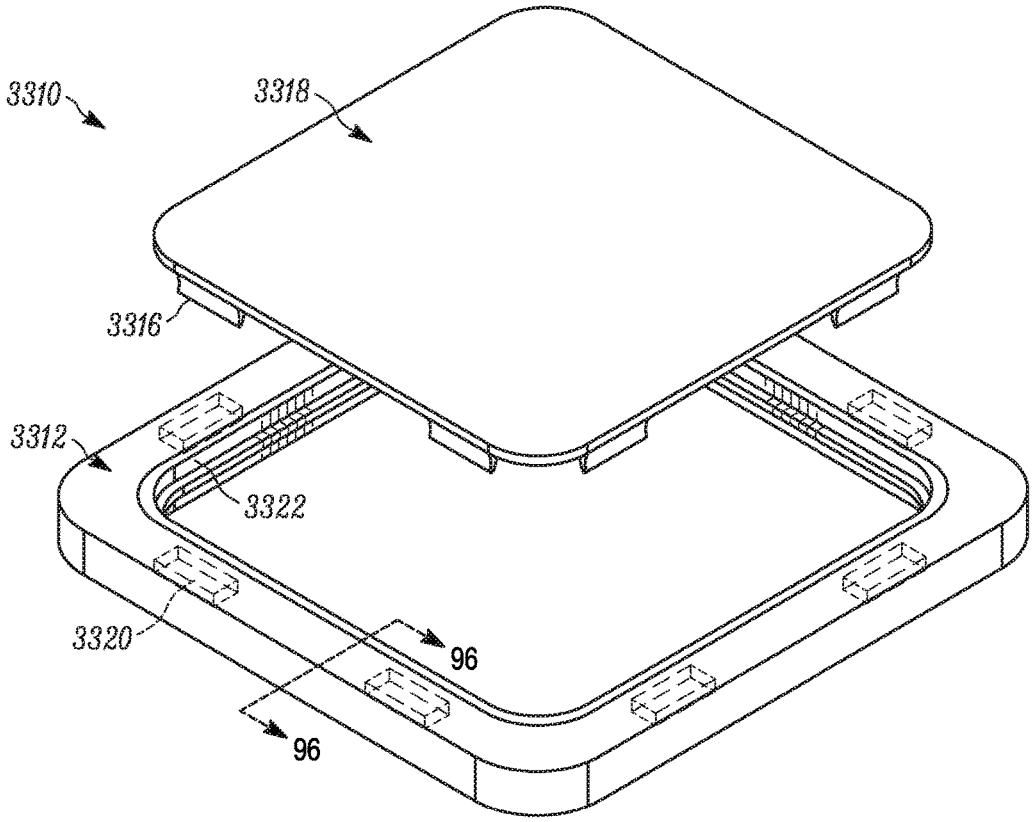
FIG. 93 is an exploded perspective view of another magnetic building tile.
Figure 94:
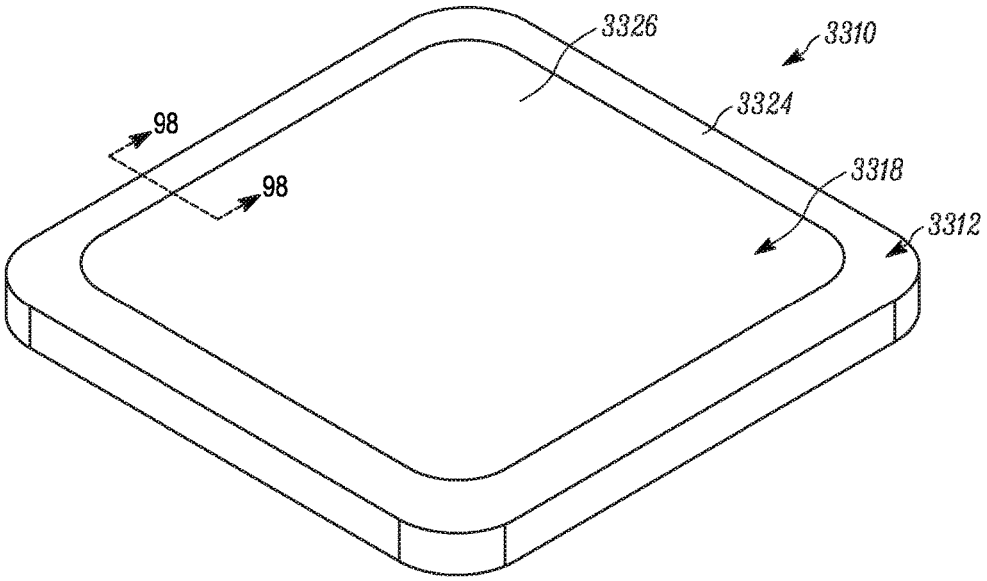
FIGS. 94 and 95 are additional perspective views of the magnetic building tile of FIG. 93.
Figure 95:
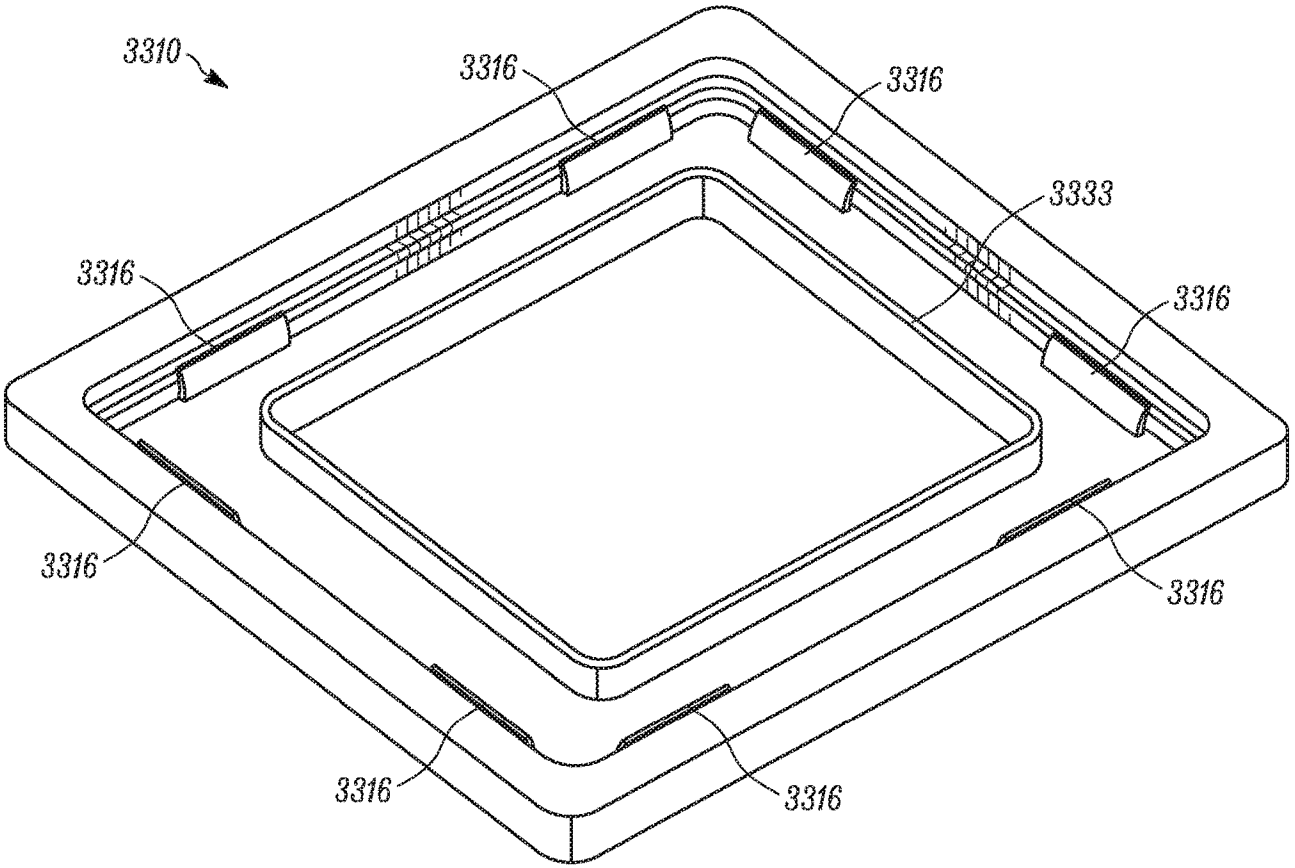

FIGS. 93-95 illustrate another exemplary magnetic building tile 3310 having a panel 3318 and a frame 3312 with a unitary configuration and magnets 3320 disposed therein. FIG. 93 depicts a generally square magnetic building tile 3310 in an exploded perspective view. The tile panel 3318 and frame 3012 may have a friction-fit and/or a snap-fit securement mechanism therebetween. Further, the tile panel 3318 can securely attach to the front or back of the tile frame 3312. To that end, an interior wall 3314 of the frame 3312 is configured to permit flanges, projections, or tabs 3316 of the tile panel 3318 to securely mate thereto from either a front or back side of the frame 3312. In addition to the interior frame wall 3314, the frame 3312 also includes a first or front wall 3324, a second or rear wall 3325, and an outer wall 3323.

As illustrated in FIG. 94, the tile panel 3318 has a panel face 3326 that may be generally flush with an adjacent exterior first wall or surface 3324 of the tile frame 3312 when the frame 3312 and panel 3318 are mated together. To that end, a depth or thickness of the panel body 3332 (FIGS. 97 and 98) from a front panel face 3326 to a rear panel wall 3330 is generally equal to the distance between the exterior first wall 3324 of the frame 3312 and a ridge or shelf 3334 of the interior frame wall 3314 (see, e.g., FIGS. 96 and 97) upon which the panel body 3332 sits when the panel 3318 is secured to the frame 3312. In other embodiments, the tile panels associated with the frames discussed herein may have a thickness that extends beyond the exterior surface of the frame such that the frame and the panel (or portions of the panel) are no longer flush with one another.

On the rear wall 3330 of the panel 3318, which is oppositely disposed from the panel face 3326, the tile panel 3318 includes at least one flange 3316 that engages with the interior frame wall 3314. The flange 3318 and its engagement with the interior frame wall 3314 help connect the panel 3318 and frame 3312 together. Further, the panel 3318 is maintained within the frame in a stable equilibrium until a user has disengaged the flanges 3316 from the interior frame wall 3314. The panel 3318 may be disengaged from the frame 3312 by applying manual pressure or another such force to the rear wall 3330 of the tile panel 3318. FIG. 95 shows one example panel with eight flanges 3316 that engage the interior frame wall 3314, arranged such that two flanges 3316 are disposed on each side or leg of the panel 3318. The rear side of the tile panel 3318 also may include a reinforcing flange 3333 strengthening the tile panel 3318.

Figure 96:
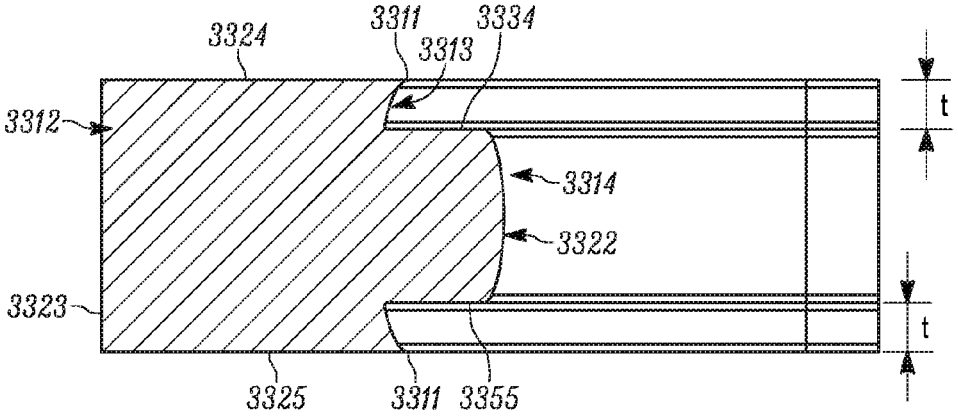
FIG. 96 is a cross section of a portion of the magnetic frame of FIG. 93, taken along line 96-96 in FIG. 93.

FIG. 96, which is a cross section of a portion of FIG. 93, illustrates the interior frame wall 3314 of the tile frame 3312, which facilitates the secure connection between the frame 3312 and the panel 3318. The interior wall 3314 may include a projection or protuberance 3322 that may form a stabilizing ridge or shelf 3334. As shown in FIG. 94, the panel face 3326 may be flush with the exterior wall of the frame 3324. The distance between the exterior wall 3324 and the shelf 3334 facing the exterior wall 3324, t, shown in FIG. 96 is generally equal to the thickness, t, of the panel 3318 from the panel face 3326 and the rear panel wall 3330, shown in FIG. 97.

The panel 3318 may be connected to the frame 3312 such that the panel face 3326 is flush with the front or back of the frame 3312. To that end, the protuberance 3322 is centrally disposed along the interior frame wall 3314 and forms two shelves 3334, 3335 disposed a distance, t, from the first and second walls 3324, 3325, respectively. Further, the first shelf 3344 is disposed the same distance from the first exterior frame wall 3324 as a second shelf 3335 is disposed from the second exterior frame wall 3325.

In addition, the interior frame wall 3314 may include an undercut, groove, or channel 3313 and a slight extension or lip 3311 where the first and second walls 3324, 3325 meet with the exterior walls 3324, 3325. Specifically, the extension 3311 is on the inner wall 3314 of the frame 3312 at its uppermost and lowermost portions where the interior wall 3314 meets the exterior frame walls 3324, 3325. The geometry of the interior frame wall 3314 helps retain the panel 3318 in position within the frame 3312. For example, an edge portion of a panel may be retained in the channel 3313 in between the extension 3311 and the respective shelf 3334, 3335. This securement mechanism may operate in addition to the flanges 3318 that mate with the geometry of the protuberance 3322. In this manner, the building tile 3310 includes both a snap-fit and a friction-fit securement mechanism between the frame 3312 and the panel 3318. Though the panel 3318 may be attached to the frame 3312 with only the snap-fit facilitated by the channel 3313 or the friction-fit facilitated by the flange, the combination of the two securement mechanisms provides a stable connection between the two pieces that is relatively easy and convenient for children to manipulate.

Figure 97:
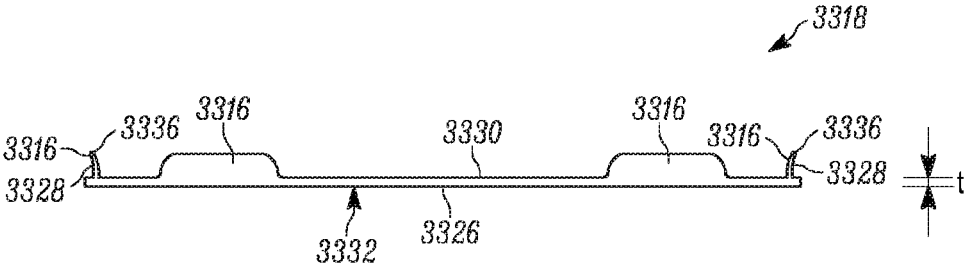
FIG. 97 is a side view of the tile panel of FIG. 93.
Figure 98:
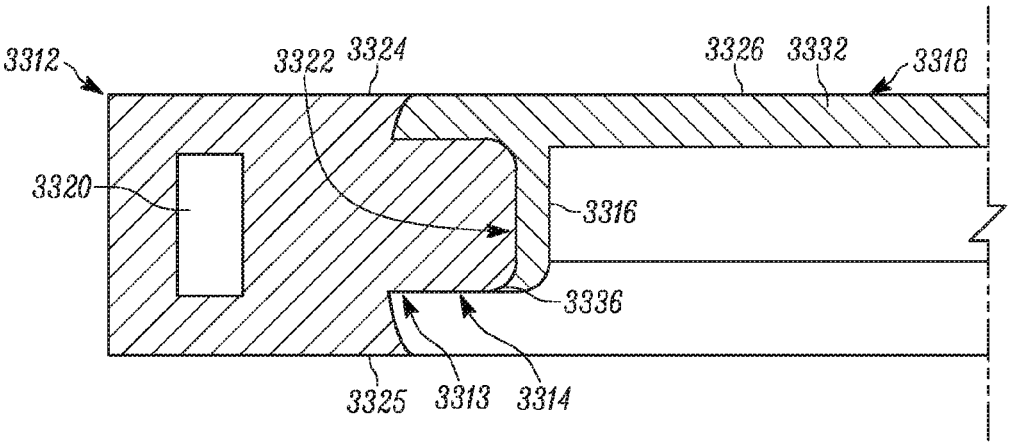
FIG. 98 is a cross section of a portion of the magnetic building tile of FIG. 94, taken along line 98-98 in FIG. 94.

To facilitate the friction-fit between the flange 3316 and the interior wall 3314, the flanges 3316 may have a curved profile facing outward from the center of the panel 3318, as illustrated in FIG. 97. By one approach, the flange 3316 includes a profile that is complementary to or corresponds to the profile of the protuberance on the interior wall 3314. As shown in FIG. 98, the curved flange surface 3328 engages the protuberance 3322 of the interior wall 3314. This curved flange surface 3328 can engage the protuberance 3322 from the front or back of the tile frame 3312. The flanges 3316 push on and engage the protuberance 3322 of the interior wall 3314 thereby securely mating the frame 3312 and the panel 3318. The flange 3316 also may include an end 3336 of the flange 3316 that may engage the curved portion of the protuberance 3322 disposed away from shelf 3334, 3335 upon which the panel 3318 sits or engages. Depending on the geometry of the end 3336 and length of the flange 3316, the end 3336 may provide another snap-fit securement mechanism between the panel 3318 and the frame 3312.

Figure 99A:
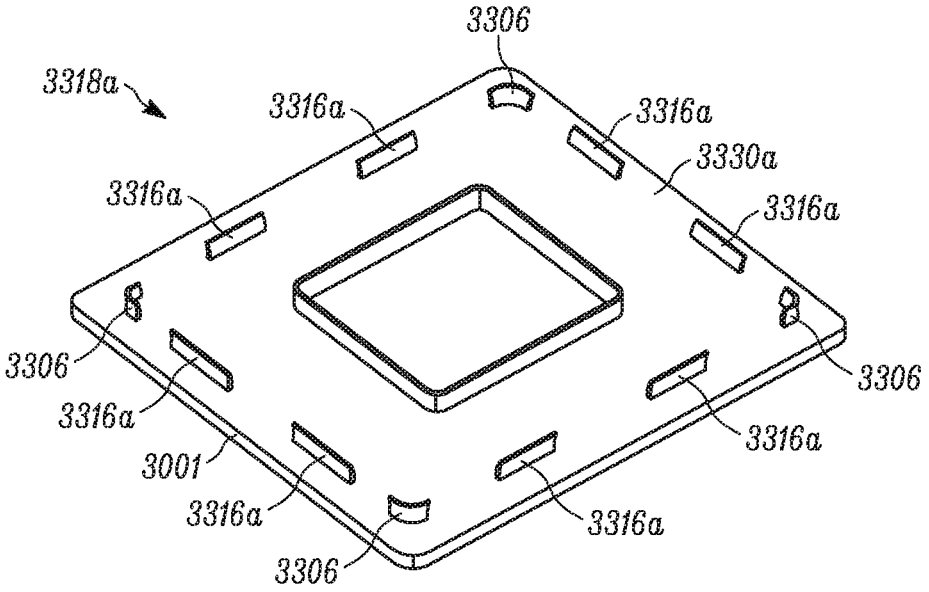
FIG. 99*a*-99*c* are rear perspective views of illustrative panels.
Figure 99B:
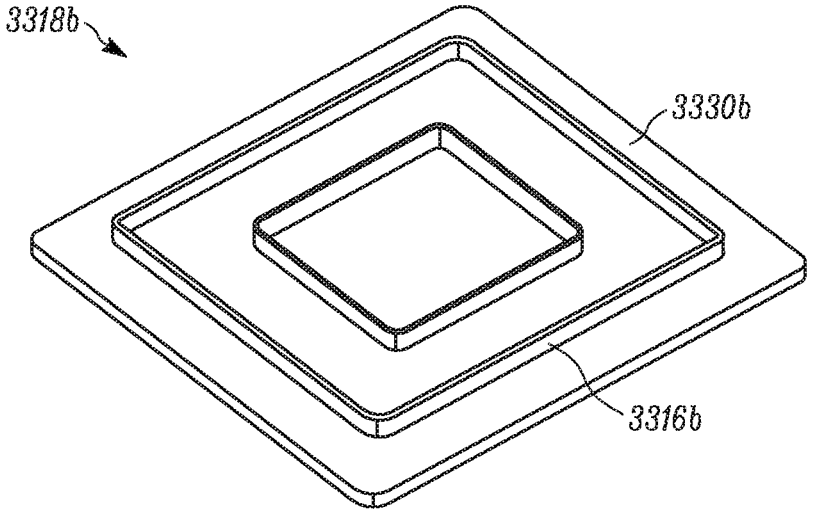
Figure 99C:
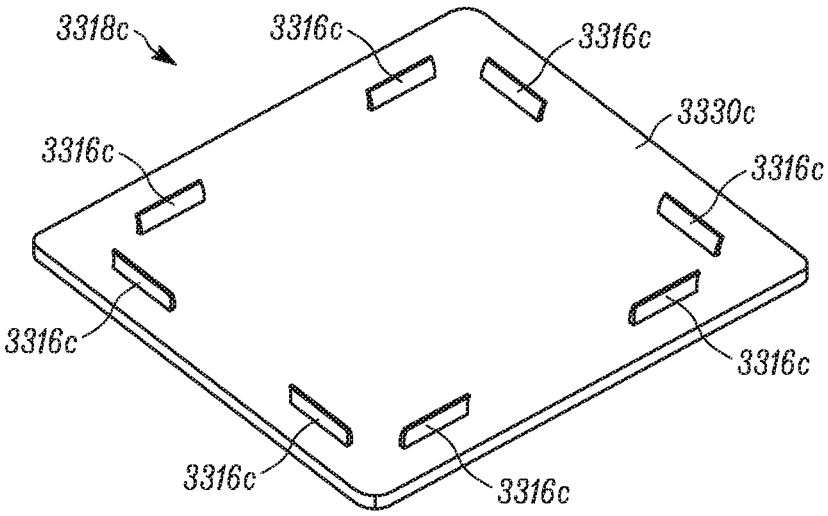

FIGS. 99*a*, 99*b*, and 99*c* illustrate three potential rear wall configurations. By one approach, the tile panel 3318*a* includes a rear wall 3330*a* with a plurality of discrete flanges 3316*a*. As shown, the rear wall 3330*a* may include two discrete flanges 3316*a* along each side 3001. With this configuration, a square- or rectangular-shaped panel will have eight discrete flanges on the rear wall. Further, the rear wall of the panel 3318*a* further includes reinforcing curves or corner portions 3306 in between the discrete flanges 3316*a* adjacent the panel corner. These may be used to strengthen or reinforce the structure on the rear wall 3330*a* of the panel. In this manner, the reinforcing corner portions 3306 may help prevent damage to the surrounding flanges 3316*a*. The reinforcing corner portions 3306 illustrated in FIG. 99*a* are not designed to attach the frames, however, in other configurations, these corner portions 3306 may include structure or geometry facilitating a connection with the frame. In another configuration, shown in FIG. 99*b*, the panel 3318*b* has a rear wall 3330*b* with a single continuous flanges 3316*b* that extends adjacent the entire perimeter of the panel 3318*b*. This flange 3318*b* may engage the interior frame wall 3314 as discussed above. Further, the panel 3318*b* may include a reinforcing flange 3333 to help strengthen the panel 3318*b*. In yet another embodiment, the panel 3318*c* includes only eight discrete flanges 3316*c* without any sort of reinforcing corner portions or reinforcing flange. In other configurations, the tile panel may have only a single, discrete flange disposed along one side of the rear wall. In still other configurations, the tile panel may have three or more flanges disposed along a single side of the rear wall.

Though tile 3310 discussed above includes two connection mechanisms between the frame 3312 and the panel 3318, the snap-fit connection that is formed, in part, by the channel 3313 between the lip 3311 and the corresponding shelf 3334, 3335 also may be used to secure substrates lacking a flange 3316 and its complementary geometry. Accordingly, a plurality of interchangeable substrates are capable of being retained within the frame by having a substrate edge disposed between the shelf of the protuberance 3334, 3335 and the extension lip 3311 adjacent thereto. Further, the frame 3312 may receive panels of different material, such as, for example, paperboard or cardboard, and that lack any sort of flange or projection.

Figure 100:
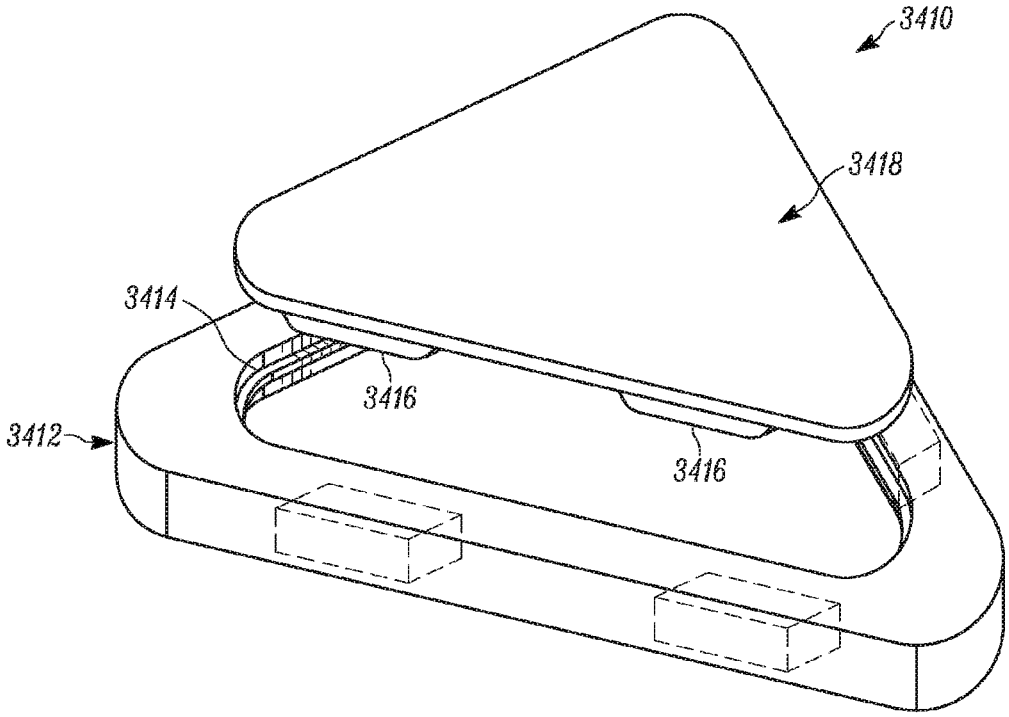
FIG. 100 is an exploded perspective view of another magnetic building tile.
Figure 101:
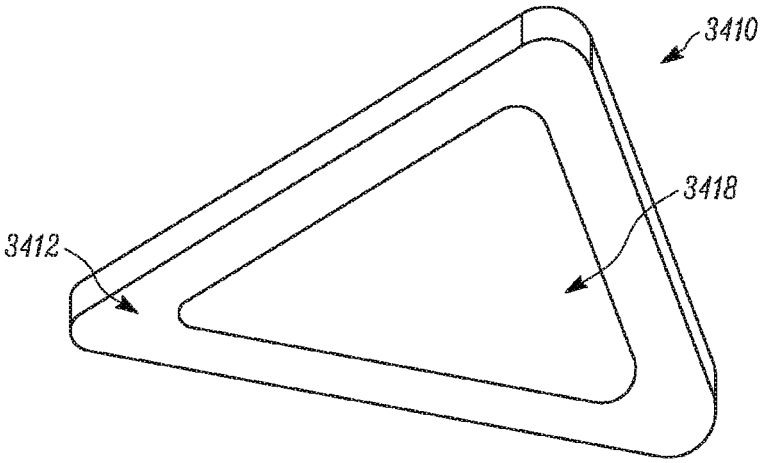
FIGS. 101 and 102 are additional perspective views of the magnetic building tile of FIG. 100.
Figure 102:
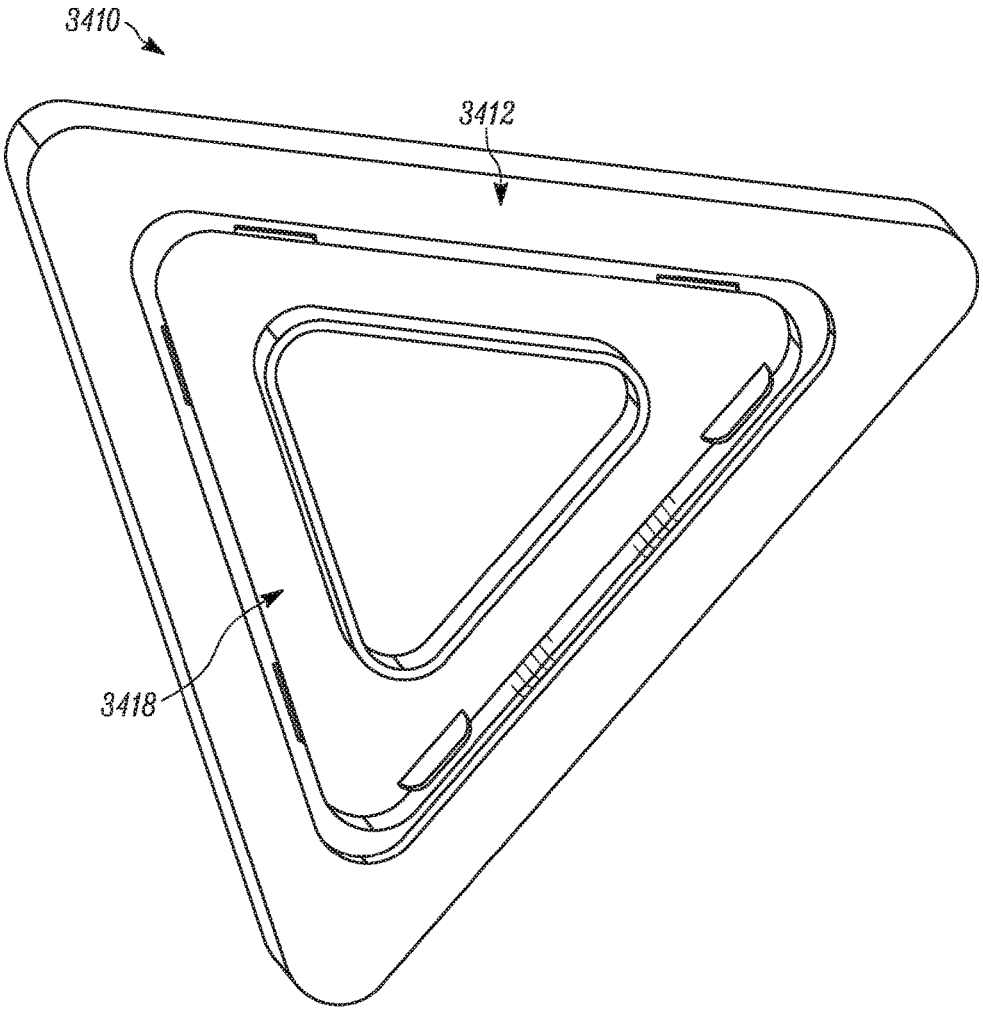

FIGS. 100-102 illustrate an equilateral triangle building tile 3410 with a frame 3412 and panel 3418 that mate together via a flange 3416 and interior wall 3414 similar to that previously described with respect to building frame 3310.

Figure 103:
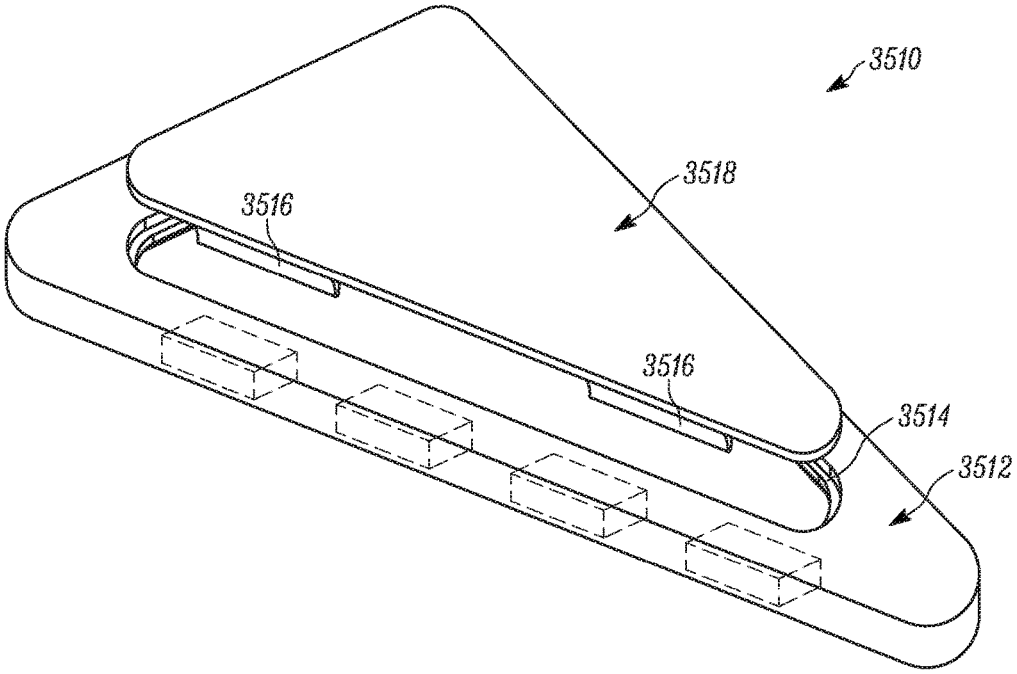
FIG. 103 is an exploded perspective view of another magnetic building tile.
Figure 104:
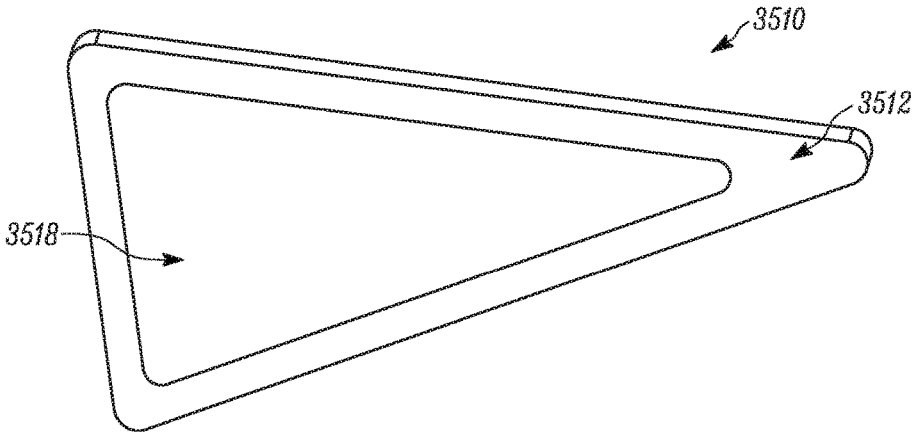
FIGS. 104 and 105 are perspective views of the magnetic building tile of FIG. 103.
Figure 105:
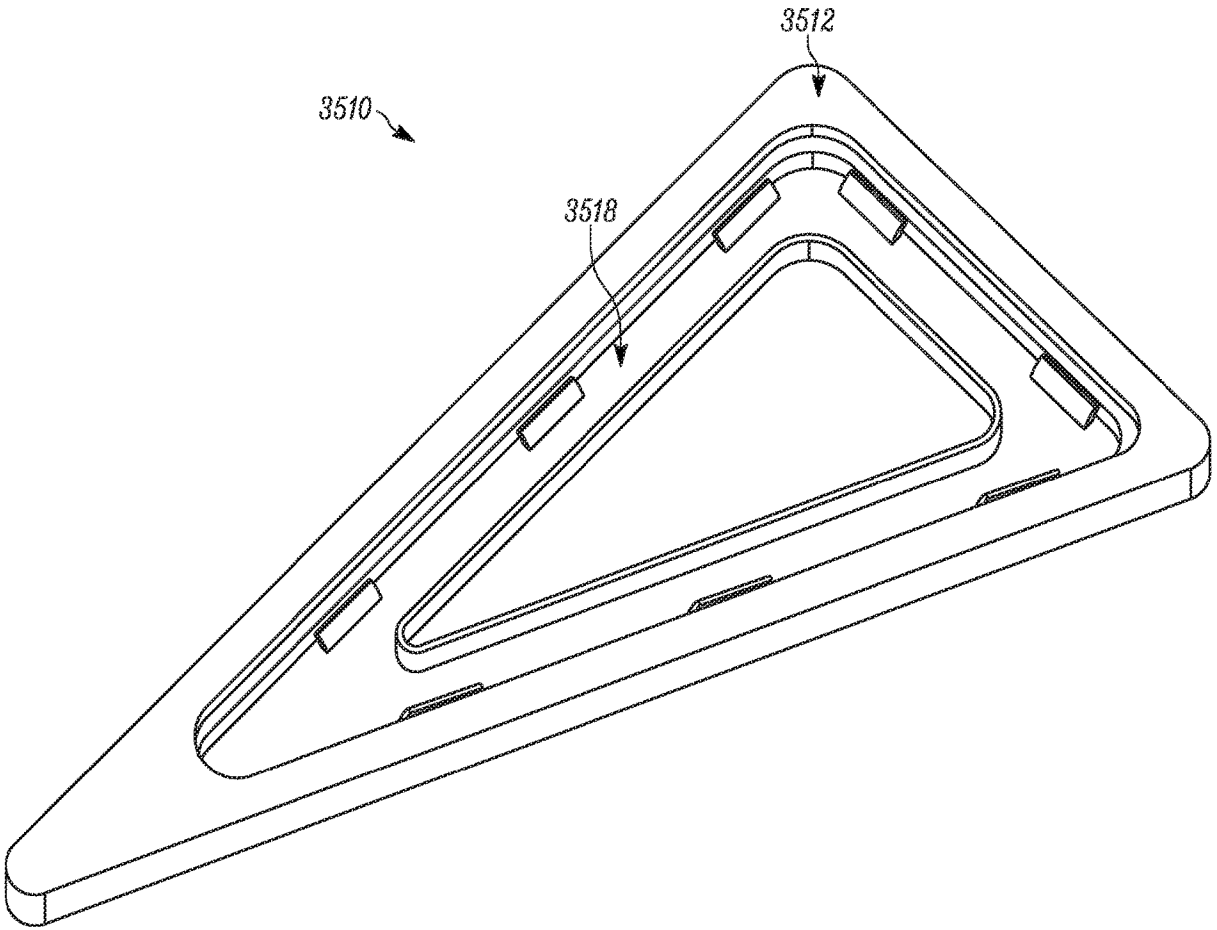

FIGS. 103-105 illustrate an isosceles triangle building tile 3510 with a frame 3512 and panel 3518 that mate together via a flange 3516 and interior wall 3514 similar to that previously described with respect to building frame 3310.

Each of these building tiles 3310, 3410, and 3510 includes a frame that mates with a panel via a snap-fit connection and a friction-fit connection. Further, the frames 3312, 3412, 3512 have a unitary configuration when handled by the user. As described above, even if the frame has a unitary or one-piece configuration when in use, the frame may be manufactured in steps or components.

The frames, as discussed herein, may be formed via a multi-step injection molding process. For example, a first portion of the frame may be formed by a first injection step and the second portion of the frame may be formed by a second injection step. In between the first and second injection steps, the process may include placing magnets into cavities or openings in the first frame portion such that the second injection molding step may mold around the magnets and connectors of first portion. Further, the first step forms an initial piece or mold that has openings into which the magnets may be partially disposed and the second step forms an overmold partially around the initial mold to securely connect or lock the two portions together around the magnets.

Figure 106:
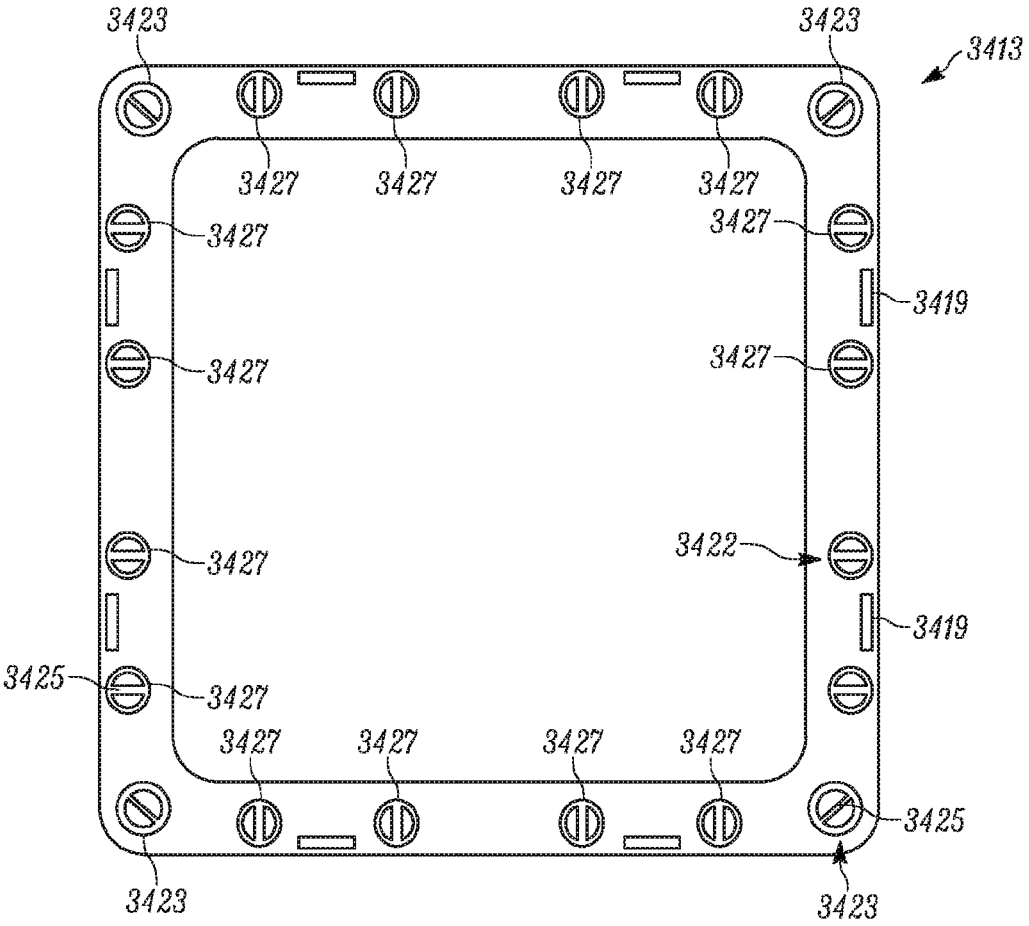
FIG. 106 is a first portion of a frame.
Figure 107:
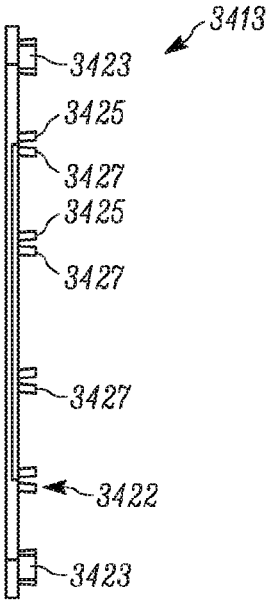
FIG. 107 is a side view of the frame portion of FIG. 106.
Figure 108:
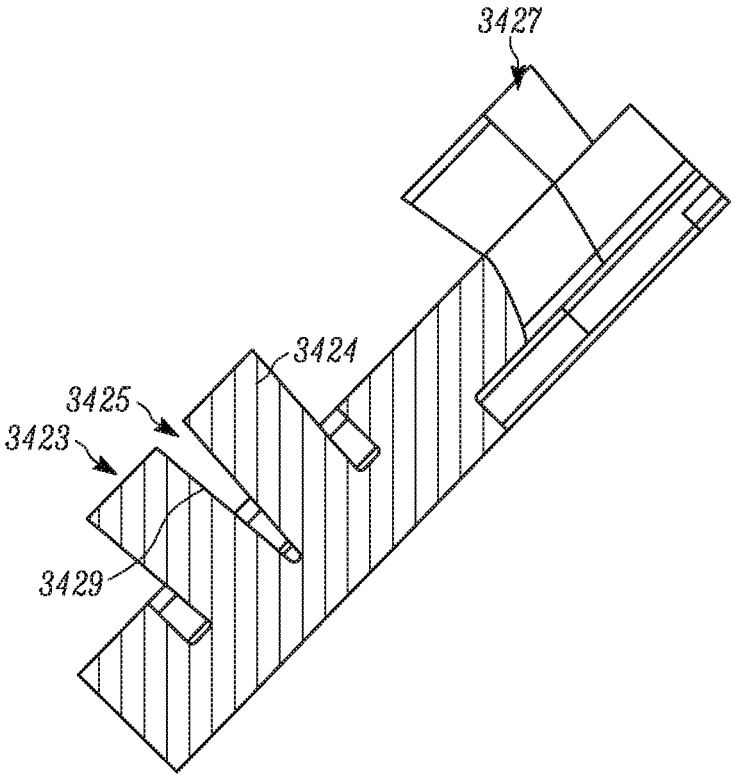
FIG. 108 is a partial cross sectional view of FIG. 106.

Turning now to FIGS. 106 and 107, a first frame portion 3413 of the frame 3312 has been formed with the first injection shot and includes connectors 3422 such as projections 3423 and 3427 described below and openings 3419 into which the magnets can be placed. The connectors 3422 may be flared or expanding projections 3423, 3427 that become gradually wider as they extend from the first frame portion 3413. To provide a secure attachment between the frames portions, the projections 3423, 3427 generally have a flared, cylindrical wall 3424 with a hollow center 3425 and interruptions or openings 3429 in the wall 3424.

Further, the first frame portion 3413 includes two differently sized and oriented projections 3423, 3427. The first projections 3423, which are disposed at the corners of the partial frame 3412, are larger than the second projections 3427, which are disposed along the leg or side of the partial frame 3413. Further, the centerline of the second projections 3427, which extend through the openings in the wall, are disposed orthogonal to the lengthwise direction of the leg on which the projection is disposed. Further, the centerline of the first projection 3423 is disposed offset from the centerline of the second projection 3427. In one configuration, illustrated in FIG. 106, the centerline of the projection 3423 is nearly tangential to the curvature of the corner on which the projection 3423 is disposed.

Once the first step of the injection molding process is complete, the first frame portion 3413 is formed, and then the magnets are put into position in the openings 3419 of the partial frame. At this point, the second injection step of the injection molding process occurs. When the material is injected into the mold, the material, which forms the second part of the frame, flows around the projections 3425, 3427 and into the openings 3425 thereof to form a frame with a unitary configuration. Once removed from the mold, the frame 3312 cannot be manually separated into portions without destroying the integrity of the frame.

Furthermore, the two-step manufacturing design described herein does not require two different injection materials, nor does it require the second injection molding step to be at an increased temperature to melt a portion of the first frame portion. In the present configuration, however, the two-step injection molding process uses, in part, connectors 3422 to form a unitary frame that cannot be separated during normal use.

Figure 56:
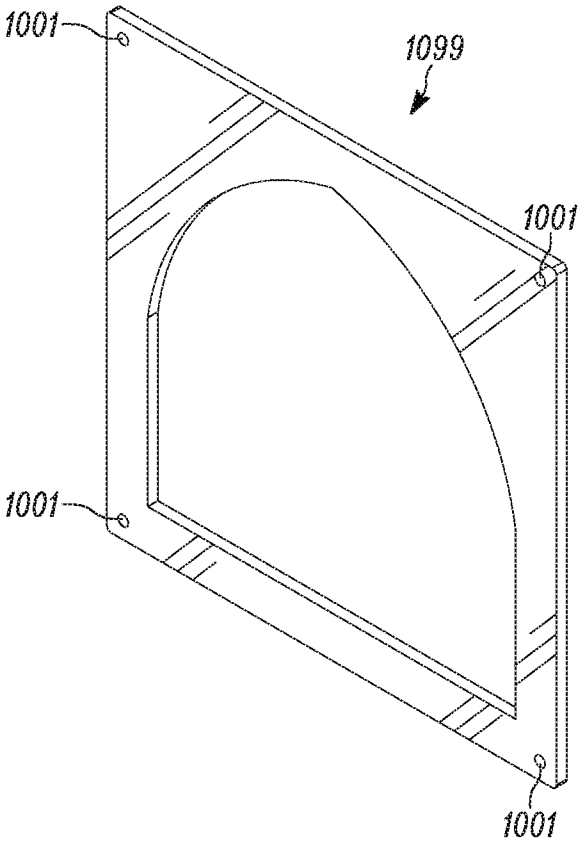
FIG. 56 is a perspective view of an additional panel embodiment.
Figure 57:
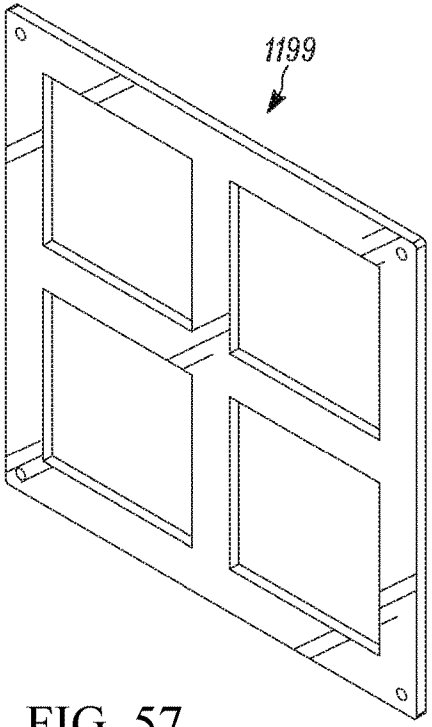
FIG. 57 is a perspective view of an additional panel embodiment.
Figure 61:
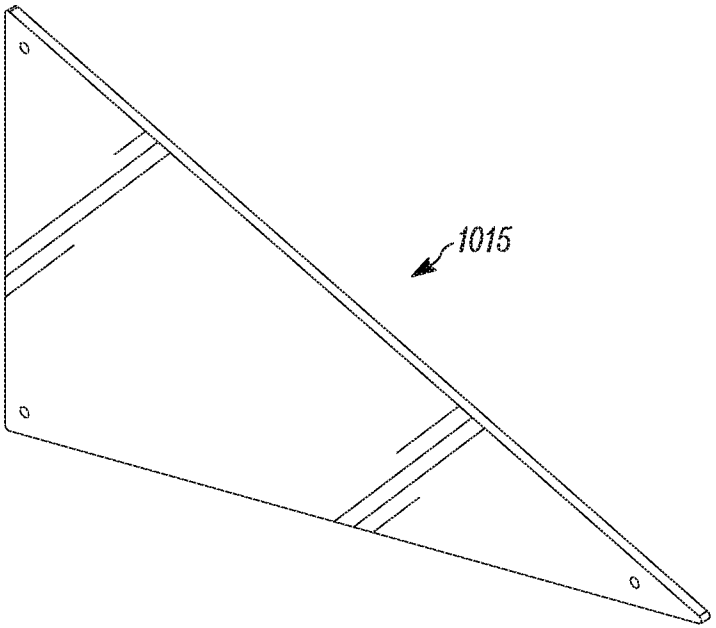
FIG. 61 is a perspective view of an additional panel embodiment.
Figure 60:
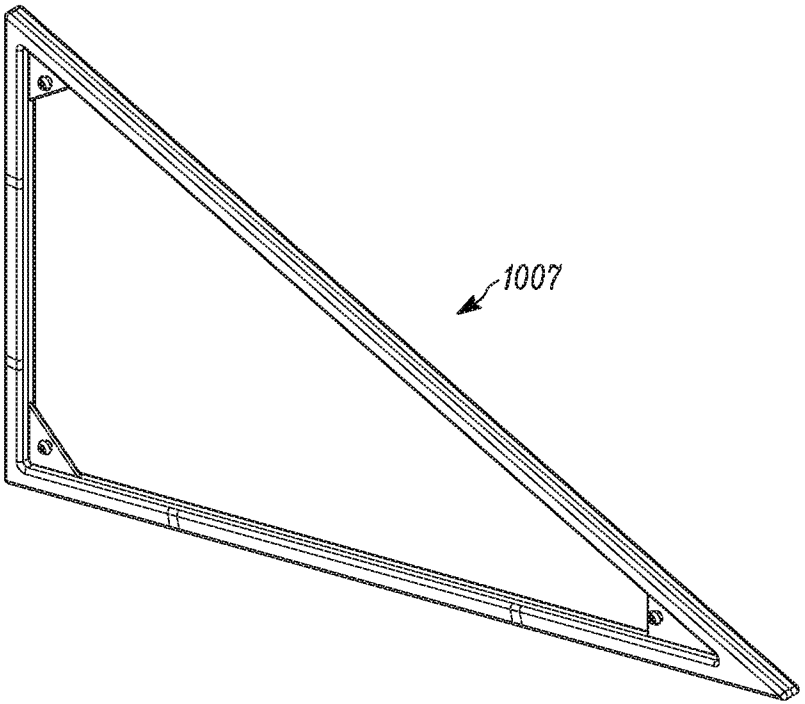
FIG. 60 is a perspective view of an additional frame embodiment.
Figure 62:
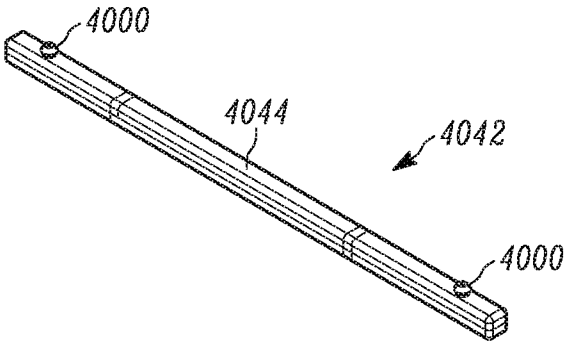
FIG. 62 is a perspective view of an additional mechanical connector.
Figure 65:
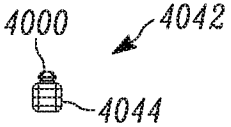
FIG. 65 is an end view of the mechanical connector of FIG. 62.
Figure 64:
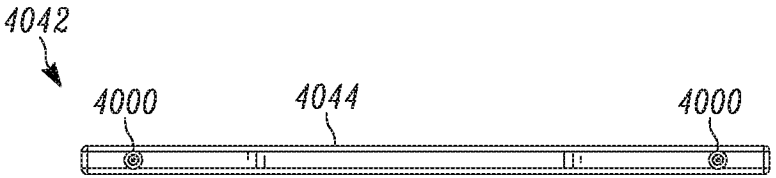
FIG. 64 is a top view of the mechanical connector of FIG. 62.
Figure 63:
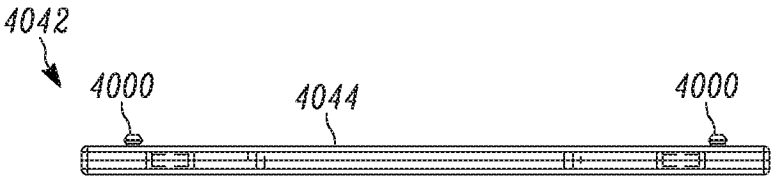
FIG. 63 is a side view of the mechanical connector of FIG. 62.
Figure 67:
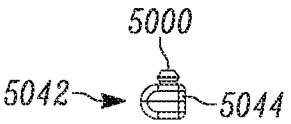
FIG. 67 is an end view of the mechanical connector of FIG. 67.
Figure 66:
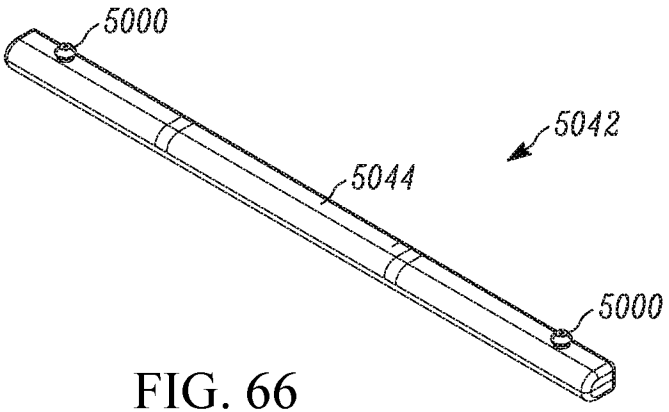
FIG. 66 is a perspective view of an additional mechanical connector.
Figure 116:
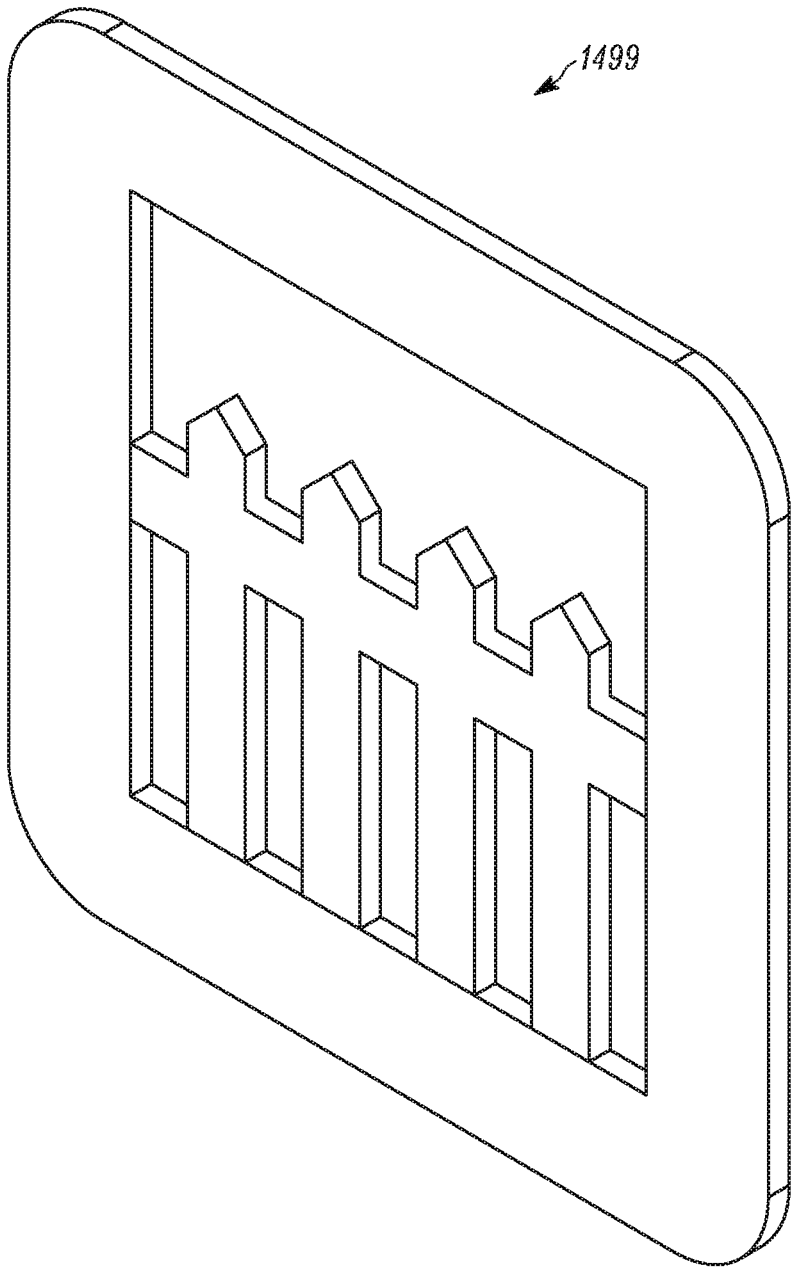
Figure 117:
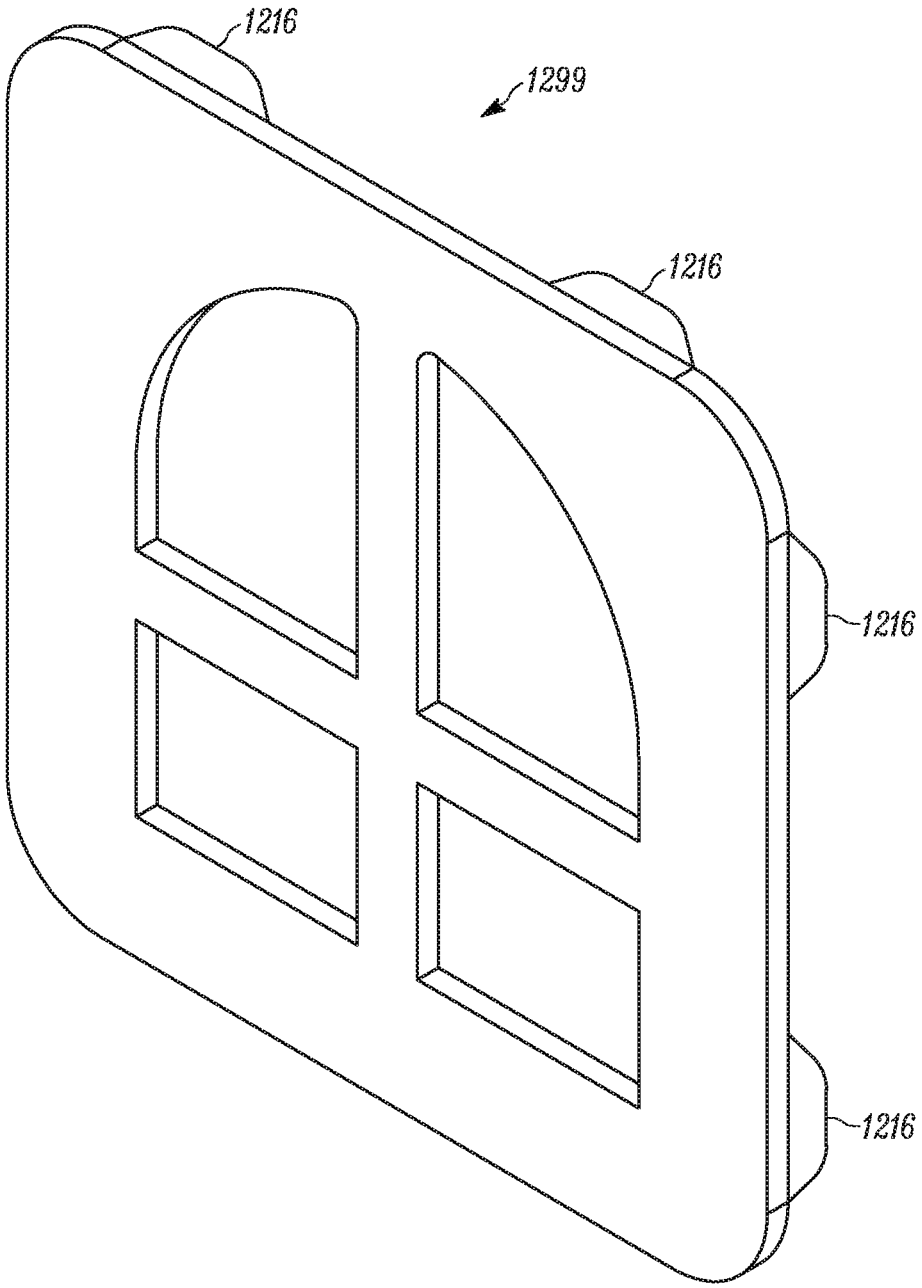

In addition to the panels discussed above, the frames disclosed herein (e.g., frames 10, 110, 1012, 3312) also can be mated with alternative panels, such as window panels illustrated in FIGS. 56, 57, and 116. FIG. 56 illustrates an arched window panel 1099, and FIG. 57 illustrates a window panel with windowpanes. These window panels 1099 and 1199 are similar to the panels 1018 previously discussed, but include a cut out portion that permits the user to see through the panel. Further, the window panels 1099 and 1199 may include plurality of holes or openings 1001 that allow the panels to mate with the pegs 1000 on the frames 1012. While window panels 1099, 1199 include openings that can receive frame projections, such panels also may be employed with alternative frames described herein. For example, FIG. 117 illustrates a panel 1299, which is similar to the window panels previously discussed, and includes projections or tabs 1216 on a rear wall of the panel 1299 to permit the panel to be mounted to the frame 3312.

Figure 115:
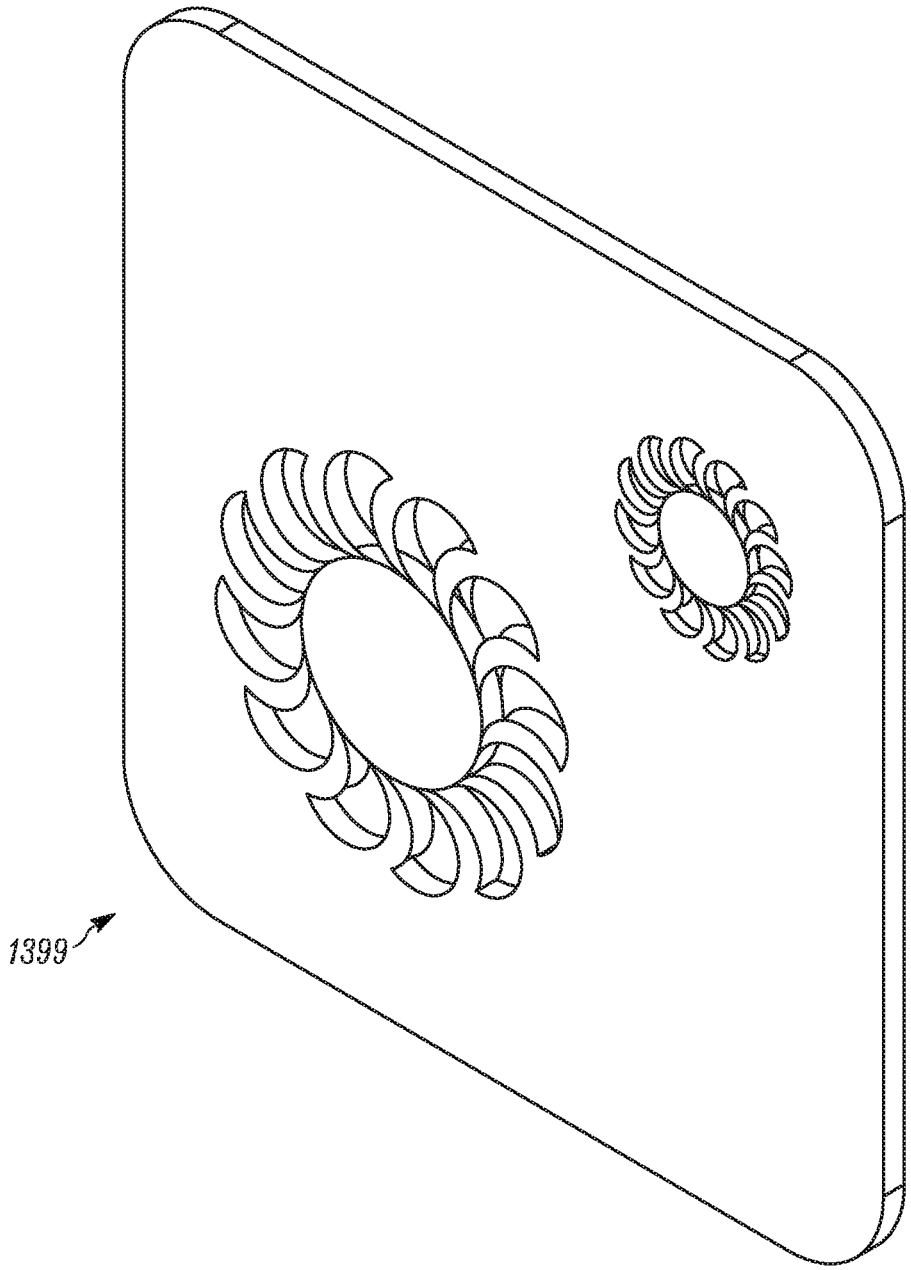
FIGS. 115 to 130 are perspective views of additional panel embodiments.
Figure 118:
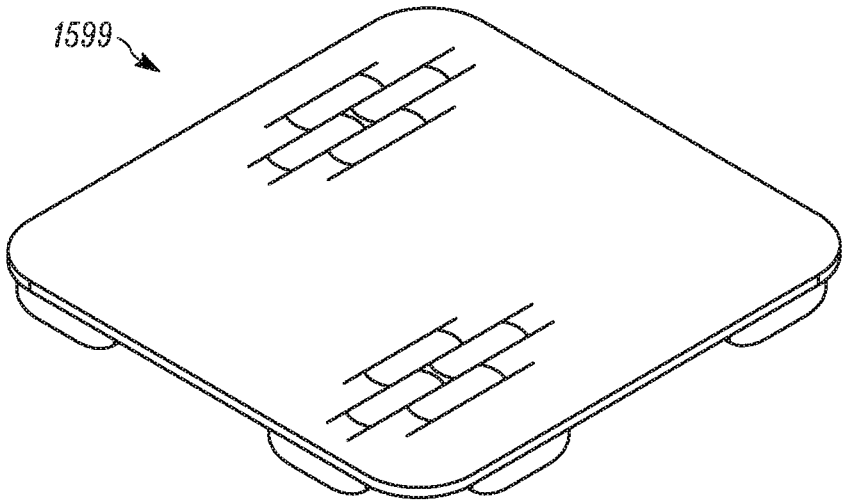
Figure 119:
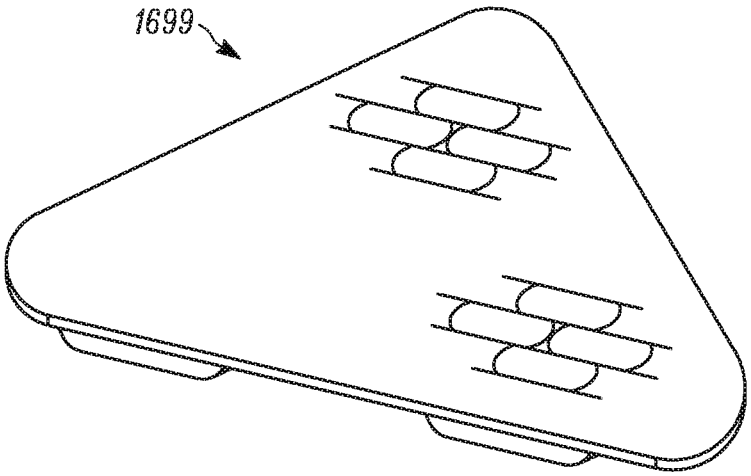
Figure 120:
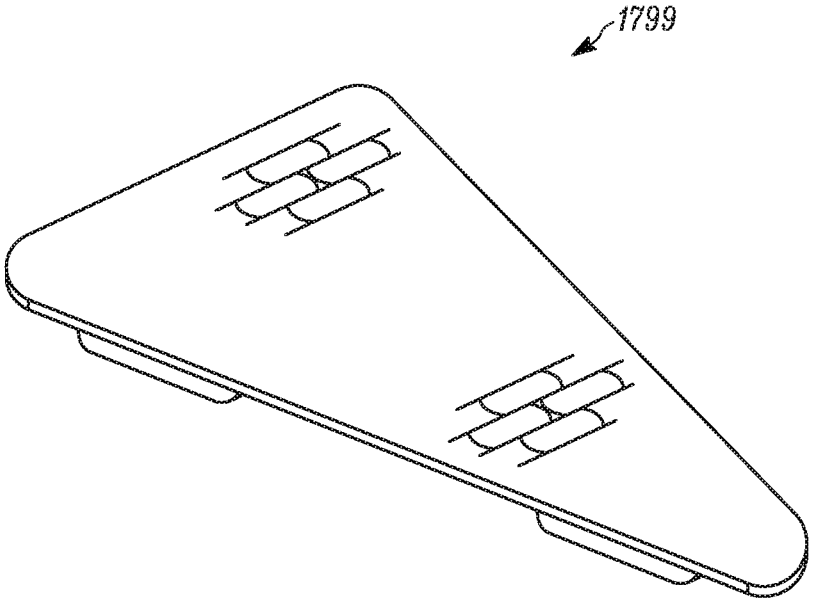

FIGS. 115 and 116 illustrate two additional panel configurations that may be incorporated into the various panel embodiments described herein. For example, the panel 1399 of FIG. 115 includes an opening flower, sun, or starburst shape with two center openings surrounded by smaller openings, and the panel 1499 of FIG. 116 illustrates a picket fence configuration. A user may combine these and other panels with panels having a brick motif, such as panels 1599, 1699, 1799 (FIGS. 118-120) to build a structure, such as, for example, a house. In addition to the window and other decorative panels discussed herein, the user also may incorporate three-dimensional panels as described below. Further, the window panel, other architectural panels, and/or three-dimensional panels may be used with the kits described below to permit a child or other user to build a variety of additional structures.

The building tiles described herein can be manipulated and configured in a number of ways. For example, as discussed above, the edges and faces of the tile adjacent the edges may be magnetically connected together. Further, the building tiles may be connected to other structures, such as a plastic and/or cardboard box or piece. In addition to using the building tiles discussed above, connectors, such as a magnetic connector and/or mechanical connector may be employed to secure the building tiles to other structures or pieces.

Figure 16:
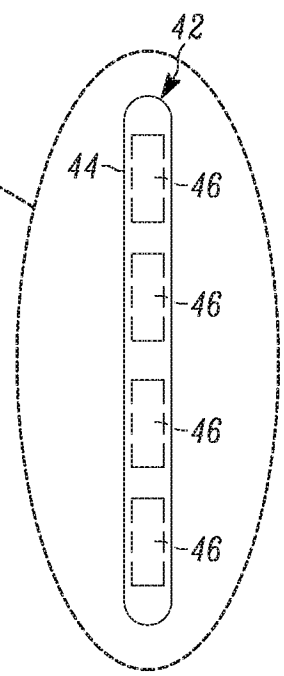
FIG. 16 is a front view of a magnetic connector.
Figure 17:
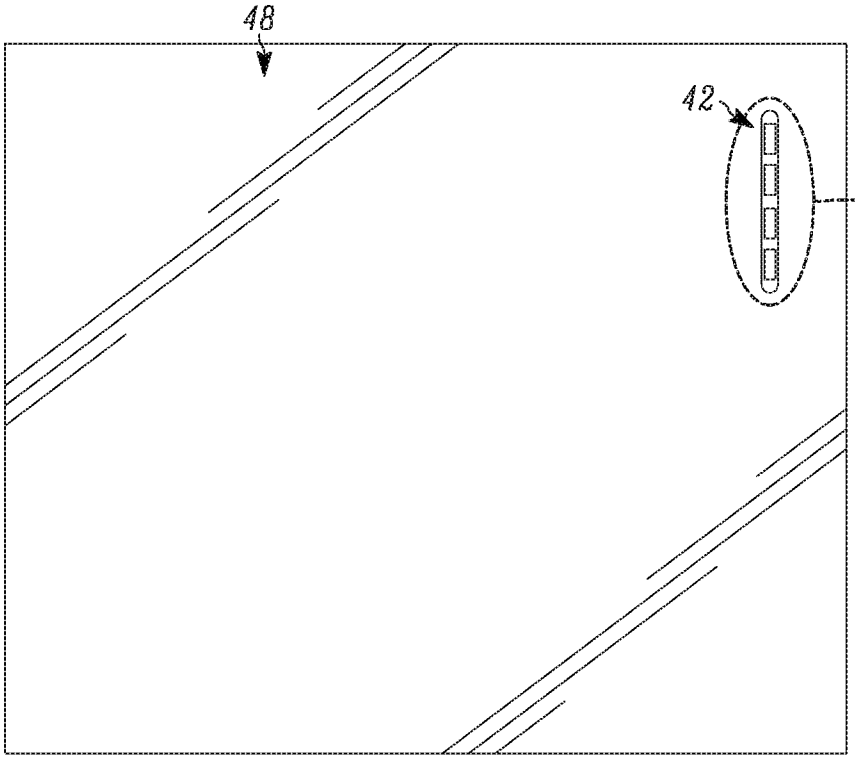
FIGS. 17-19 are front views illustrating the magnetic connector of FIG. 16 being connected with the magnetic building tile of FIG. 1.

As shown in FIGS. 16 and 17, the magnetic connector element 42 (hereinafter referred to as the "magnetic connector") may include a frame element 44 and magnets 46 disposed therein. The magnets 46 may be disposed within the frame 44 in any of the manners discussed above. In one approach, the frame element 44 is a single, linear frame element having at least one surface that is generally flat and that can be disposed flush against a flat surface. As shown in FIG. 17, the magnetic connector 42 may be disposed on the inside surface of a cardboard piece 48. In this manner, magnetic building tiles 10, 100, or any other shape/configuration of magnetic tile or other connectors, including those described below, may be attached to the cardboard piece 48 by placing one or more magnetic connectors 42 on the inside surface and another magnetic element (i.e., building tiles or connectors) adjacent the internal magnetic connector 42, but on the outside surface of the cardboard piece 48.

Figure 18:
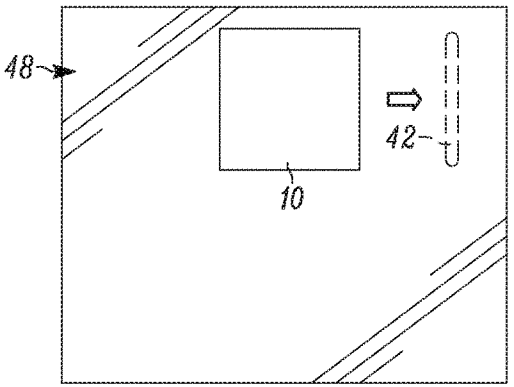
Figure 19:
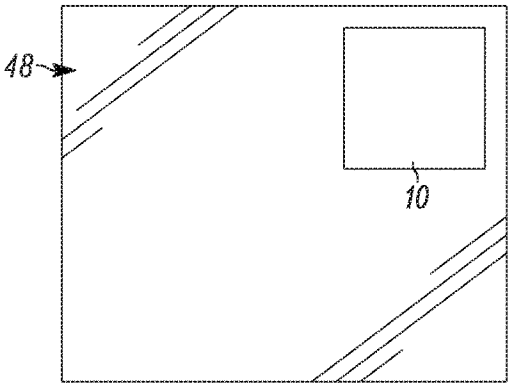
Figure 20:
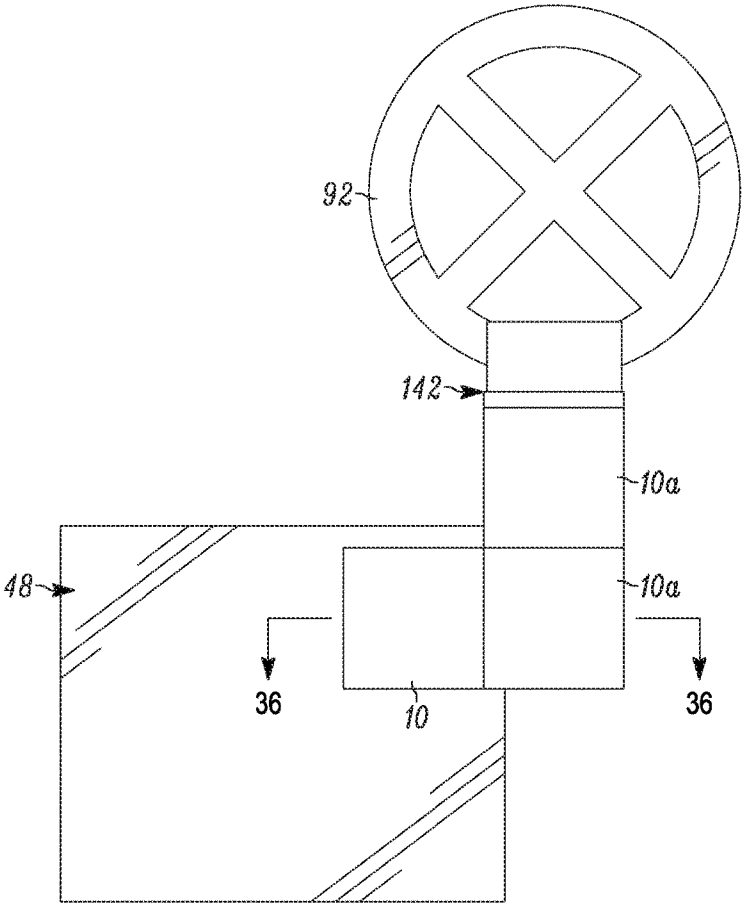
FIG. 20 is a front view illustrating a plurality of magnetic building tiles connected together.
Figure 21:
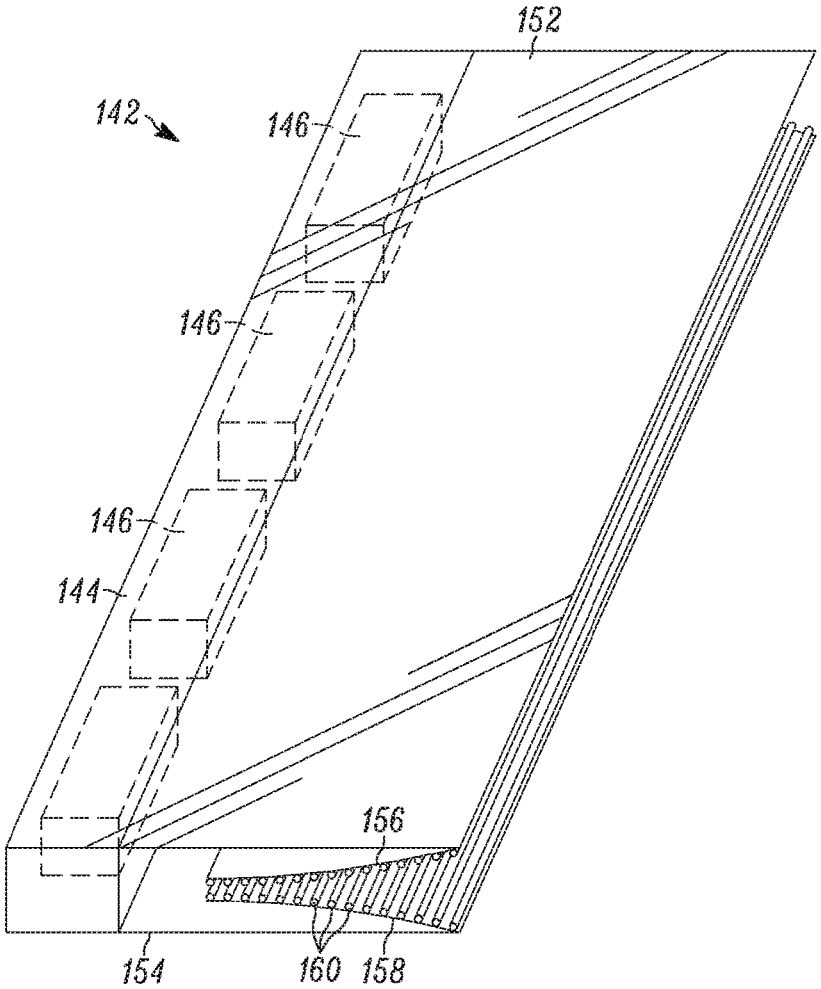
FIG. 21 is a perspective view of a mechanical connector in accordance with another embodiment.
Figure 22:
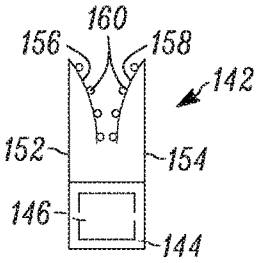
FIGS. 22-25 are top, front and side views of the mechanical connector of FIG. 21.

FIGS. 18-20 depict magnetic building tiles 10, 10*a* being attached to the plastic and/or cardboard piece 48. As shown in FIGS. 16 and 17, the magnetic connector 42 may be disposed on an inside surface of the cardboard piece 48 near an upper corner thereof. A magnetic building tile 10 is then advanced to a position on the outside of the cardboard piece 48 that is adjacent the magnetic connector 42, but on the opposing surface of the wall of the cardboard piece 48. Depending on the materials of the building tiles 10, more than one magnetic connector 42 may be disposed on the inside surface of the cardboard piece 48 to secure the building tile 10 to the outside surface of the box. For example, two, three, or even four magnetic connectors 42 may be disposed on the inside surface of the cardboard piece 48 in an arrangement that corresponds to the first and second frame portions 14, 16 of the building tile 10. See, e.g., FIGS. 36-38 illustrating two magnetic connectors 42 disposed on the inside surface of the cardboard piece 48 to provide additional stability for the building tile 10. Other magnetic elements also may be disposed on the inside surface of the cardboard piece 48, i.e., another magnetic tile or another connector, such as those described below.

Once the magnetic building tile 10 is in position on the outside of the cardboard piece 48, such that it remains attached to the cardboard piece 48 via the magnetic connection, additional magnetic building tiles 10*a* may be attached to the first magnetic building tile 10. In this manner, plastic, paperboard, or cardboard, including a typical cardboard box, may be used with building tiles and connectors described herein. In addition, the building tiles 10, 10*a* and magnetic connectors 42 may be connected to another connector, such as mechanical connector 142 that has a pair of wings, as described below. In the example of FIG. 20, the mechanical connector 142 attaches a cutout 92. Though the cutout 92 is illustrated as a railroad crossing sign, numerous alternative cutouts may engage with mechanical connectors 142.

FIGS. 21-25 illustrate another exemplary magnetic and mechanical connector 142. The mechanical connector 142 has a frame element 144 with magnets 146 disposed therein. The magnets 146 may be disposed within the frame 144 in any of the manners discussed above. The mechanical connector 142 has a pair of extension elements 152, 154 that are attached to and extend from the frame 144 in a substantially parallel arrangement. As shown, each of the extension elements 152, 154 has a connector wing 156, 158 flexibly connected to the extension element 152, 154. In one approach, the end of the connector wing 156, 158 is attached to an end of the extension element 152, 154 disposed a distance from the frame element 144. Further, the flexibly connected wings 156, 158 extend between the parallel extension elements 152,154, and a plurality of friction elements 160 may be disposed on the pair of flexibly connected wings 156, 158 on a surface thereof that faces the other of the connector wings 156, 158.

Figure 30:
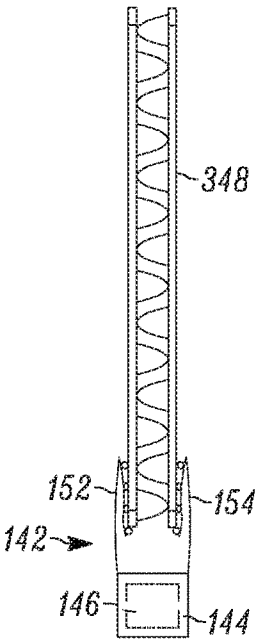
FIGS. 29 and 30 are top views illustrating the mechanical connector of FIG. 21 attaching to a cardboard cutout.

In this manner, a sheet, such as a cardboard panel (or panel made of another material), may extend between the connector wings 156, 158 and engage the friction elements 160 disposed therein (see, e.g., FIG. 30). This permits the mechanical connector 142 to attach magnets, such as magnets 146, to a cardboard (or other) piece or a cardboard box such that the building tiles, or other connectors, can thereafter be attached to such piece or box.

Figure 26:
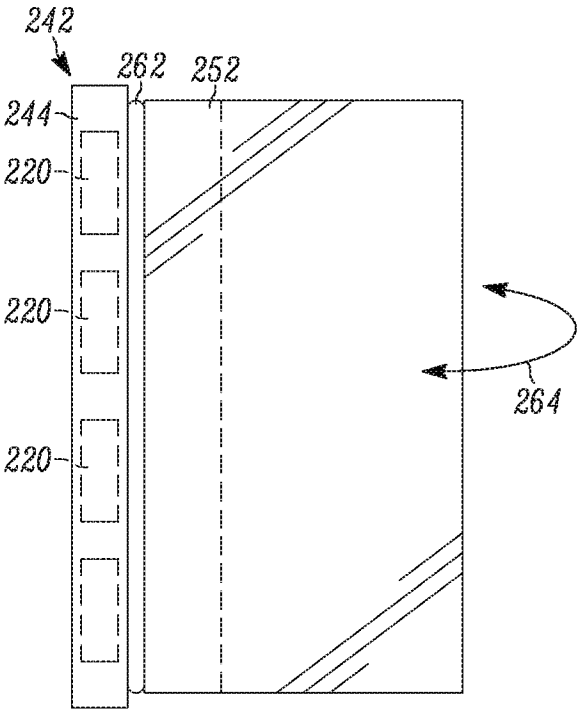

Another exemplary magnetic, mechanical connector 242 is shown in FIG. 26. The mechanical connector 242 includes a frame 244 with parallel extension elements 252 connected thereto. The mechanical connector 242 also includes wings and friction elements similar to those discussed above with respect to mechanical connector 142. Further, the mechanical connector 242 includes a hinge 262 that permits the extension elements 252 to move or rotate relative to the frame element 244 and the magnets 220. Also, when a cardboard piece or box, or other panel type, is disposed within the extension elements 252 of the mechanical connector 242, the cardboard piece or box, or other panel type, may move relative to the frame element 244 and any magnetic building tiles or connectors attached thereto. In short, arrow 264 depicts the movement of the parallel extension elements 252 relative to the frame 244.

Figure 24:
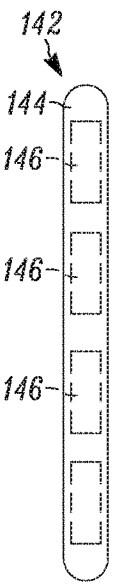
Figure 25:
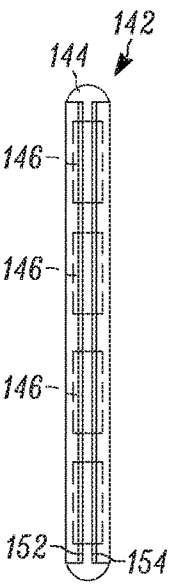
Figure 23:
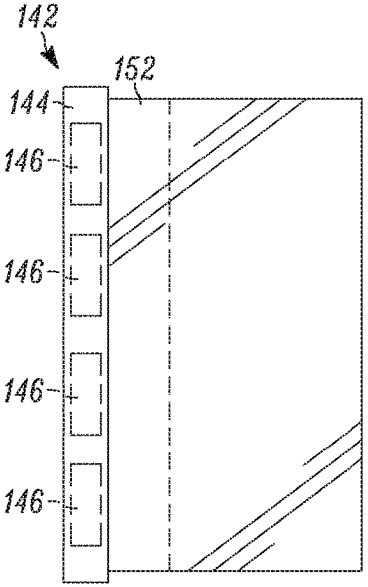
Figure 27:
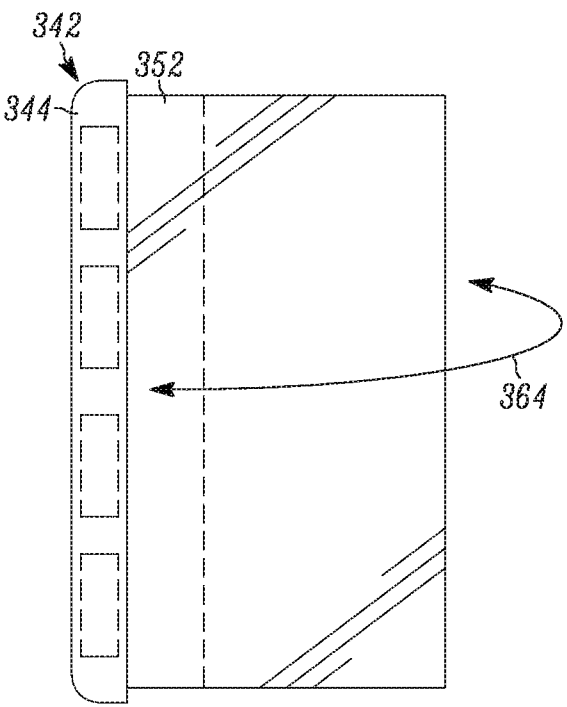
FIGS. 26 and 27 illustrate mechanical connectors in accordance with further embodiments.

FIG. 27 depicts another magnetic, mechanical connector 342, which is similar to mechanical connector 242, but lacks a hinge element. The mechanical connector 342, instead, has a frame 344 with a rounded configuration about its face disposed away from the side of the mechanical connector 342 with the parallel extension elements 352 extending therefrom. Previous connectors had rounded ends as shown in FIGS. 24 and 25 (though squared edges also may be incorporated) and at least a partially flat face, whereas mechanical connector 342 also has a rounded face and also has a cross section of the frame 344 that is similar to a semi-circle. In this manner, the mechanical connector 342 may rotate around the side of the frame 344 or a portion thereof disposed away from the extension elements 352. As shown in FIG. 27 with arrow 364, this provides for a larger range of motion than that resulting from the hinge 262 of the mechanical connector 242 illustrated in FIG. 26. Thus, a building kit or system may include either or both of the mechanical connectors 242, 342 to permit the user to create structures with portions that rotate relative to one another. In addition, it is anticipated that a mechanical connector with both a hinge and a rounded configuration about its face may be employed.

Figure 72:
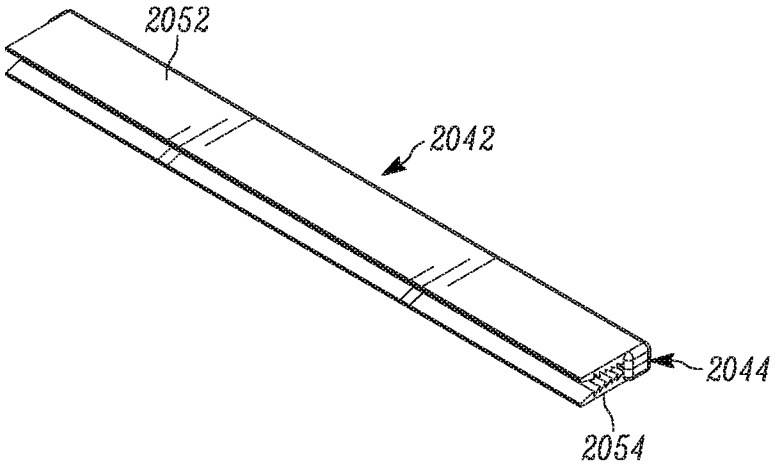
FIG. 72 is perspective view of another mechanical connector.
Figure 73:
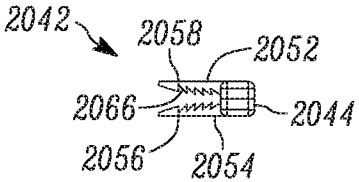
FIG. 73 is an end view of the mechanical connector of FIG. 72.

Another magnetic, mechanical connector 2042 is illustrated in FIG. 72. The mechanical connector 2042 is nearly identical to the mechanical connector 142 described above, expect for the friction elements 2066. The mechanical connector 2042 has a frame 2044 with magnets disposed therein that permit it to be attached to other frame elements described herein. Further, the mechanical connector 2042 includes a pair of extension elements 2052, 2054 that are attached to and extend from the frame 2044. The extension elements 2052, 2054 have flexible connector wings 2056, 2058 attached thereto upon which the friction elements 2066 are disposed. As compared to the previously illustrated rounded friction elements 160, the friction elements 2066 are disposed in a jagged fashion.

Figure 74:
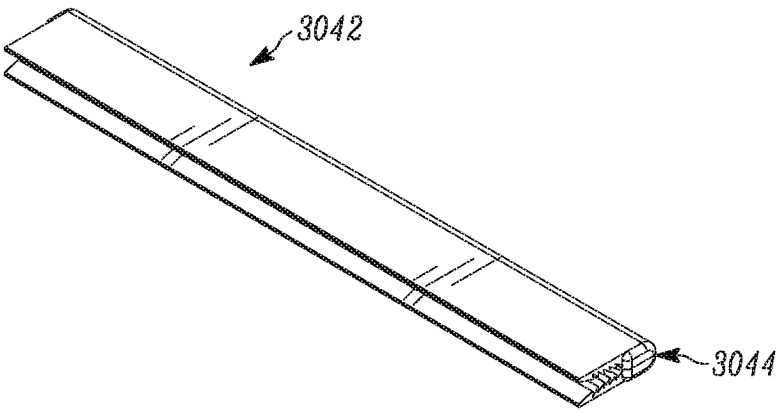
FIG. 74 is a perspective view of another mechanical connector.
Figure 75:
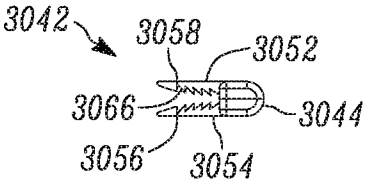
FIG. 75 is an end view of the mechanical connector of FIG. 74.

FIG. 74 illustrates mechanical connector 3042 that is similar to those previously described and includes a magnetic frame 3044, extension elements 3052, 3054 with flexible wings 3056, 3058 having friction elements 3066 formed thereon. The mechanical connector 3042 has a rounded face similar to that in the mechanical connector 3042 shown in FIG. 27. Despite the different shape of the friction elements 2066, 3066, they function similarly to the others described herein.

Figure 156:
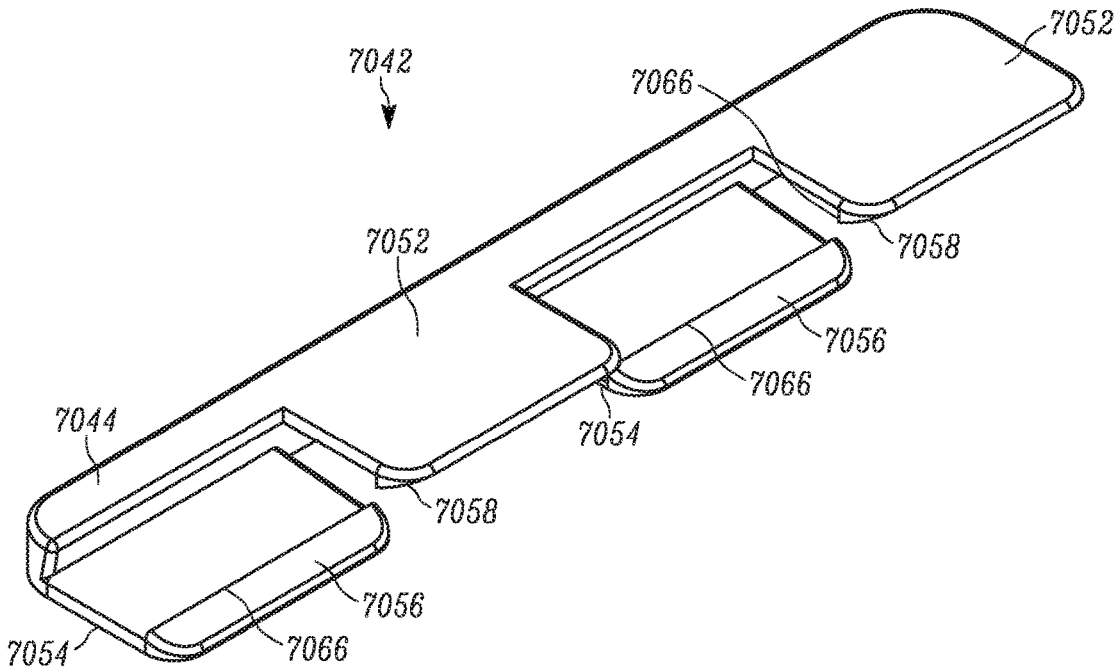
FIG. 156 is a perspective of another mechanical connector.

FIG. 156 illustrates yet another magnetic, mechanical connector 7042 that is similar to the previously described connectors, which may connect to an edge of a substrate or panel. The mechanical connector 7042 includes a frame 7044 with magnets disposed therein and a pair of extension element 7052, 7054 that extend from the frame 7044 in a parallel arrangement. The extension elements 7052, 7054 have flexible connector wings 7056, 7058 attached thereto, respectively, upon which the friction elements 7066 are disposed. Further, the extension elements 7052, 7054 have openings along their length, and in one configuration are primarily or entirely offset from one another. In another configuration, the extension elements 7052, 7054 are only partially offset from one another such that at least a portion of one of the extension elements 7052, 7054 face or oppose one another. The offset configuration of the extension elements 7052, 7054 shown in FIG. 156 may permit a user to more easily engage and disengage a cardboard panel or other substrate from the friction connection between the friction elements 7066 of the flexible connector wings 7056, 7058 and the substrate. Like connectors previously described, the mechanical connector 7042 also may have a hinge or a rounded face incorporated therein.

Figure 28:
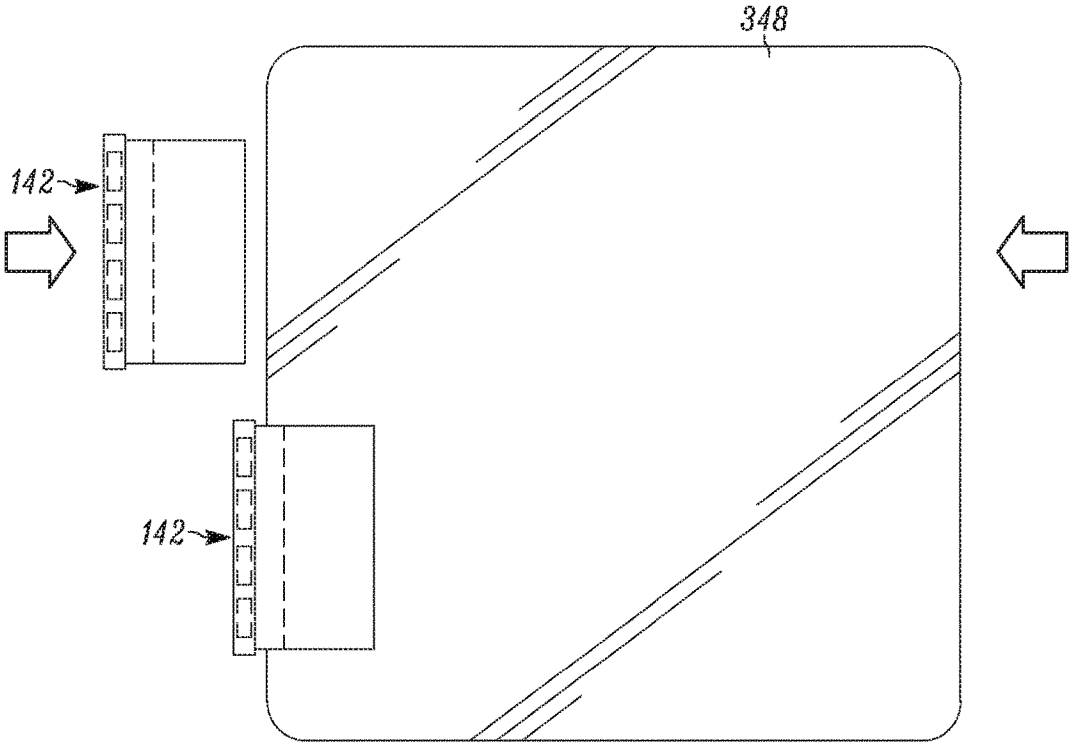
FIG. 28 is a front view illustrating the mechanical connectors of FIG. 21 attached to a cardboard cutout.

FIG. 28 depicts a large plastic and/or cardboard piece 348 with one mechanical connector 142 attached thereto and another mechanical connector 142 being pushed into engagement with the cardboard piece 348. Once the mechanical connectors 142 are attached to the cardboard piece 348, additional building tiles or connectors can be joined thereto. Further, the piece could be any of a variety of shapes, sizes, designs, or materials. If the cardboard piece 348 is to operate as a door, or other rotating element, of a structure, the mechanical connectors 142 may be exchanged for other mechanical connectors such as connectors 242, 342, or 3042.

Figure 29:
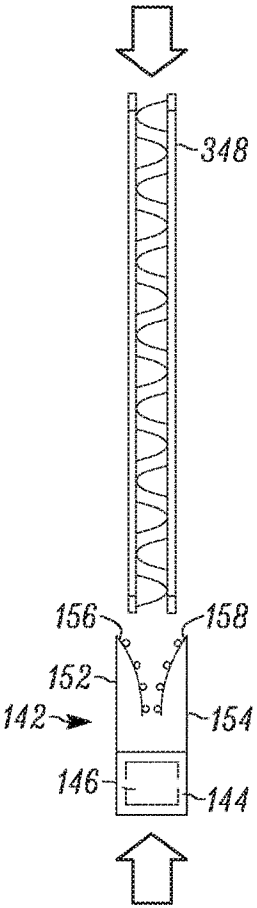

FIG. 29 illustrates the cardboard piece 348 as it is being pushed into contact with the mechanical connector 142. Once the cardboard piece 348 is in position between the extension elements 152, 154 and their respective flexible wings 156, 158, the friction elements 160 disposed on the wings 156, 158 will secure the cardboard piece 348 to the mechanical connector 142 by the friction generated between the wings 156, 158 and the cardboard piece 348. In this manner, the mechanical connector 142 is secured to the cardboard piece 348 by friction, and additional magnetic tiles or connectors can be attached to the mechanical connector 142 via magnetism. The mechanical connector 142 and plastic or cardboard piece may be separated by pulling the cardboard piece out of the connector with sufficient force to overcome the friction.

Two additional mechanical connectors 4042, 5042 are illustrated in FIGS. 62-65 and 66-67, respectively. Like previously described mechanical connectors 142, the mechanical connectors 4042, 5042 include one or a plurality of magnets disposed therein and another mechanical element that permits the mechanical connectors 4042, 5042 to attach to a panel. In the embodiment of FIGS. 62-67, the mechanical connectors 4042, 5042 include a frame element 4044, 5044 and pegs 4000, 5000, respectively, to which panels or other cardboard or plastic pieces with holes or openings therein can attach. Whereas the previously described mechanical connectors could attach or grip a plurality of different cutouts, panels, or sheets of material, the mechanical panel connectors 4042, 5042 are formed to mate with panels having specific openings 1001 therein to accommodate the fasteners or pegs 4000, 5000.

The mechanical connectors 4042, 5052 are similar to one another, except that one side of the mechanical connector 5042 has a rounded face or edge that permits the mechanical connector 5042 to rotate or move around the rounded face of the frame 5044 as previously described. The mechanical connectors 4042, 5042 can attach to the tile panels through the pegs 4000, 5000 and openings 1001 in the panels. Further, the mechanical connectors 4042, 5042 can be combined or magnetically attached to the other mechanical connectors and tiles described herein. To mate with the previously described panels having a length of about 9.5 centimeters (about 3.75-inch) in one configuration, the mechanical connectors 4042, 5042 may have a length of 10.8 centimeters (4.25-inches), a height of 0.635 centimeters (about 0.25-inches), and the pegs 4000, 5000 may be disposed a distance from the ends of the mechanical connectors and in a position corresponding to the openings in the panels. In another configuration, to mate with the previously described panels having a dimension of about 13.97 centimeters (about 5.5-inch), the mechanical connectors 4042, 5042 may have a length of 15.24 centimeters (about 6.0-inches), a height of 0.635 centimeters (about 0.25-inches) and the pegs 4000, 5000 may be disposed a distance from the ends of the mechanical connectors 4042, 5042 and in a position corresponding to the openings in the panels.

Figure 68:
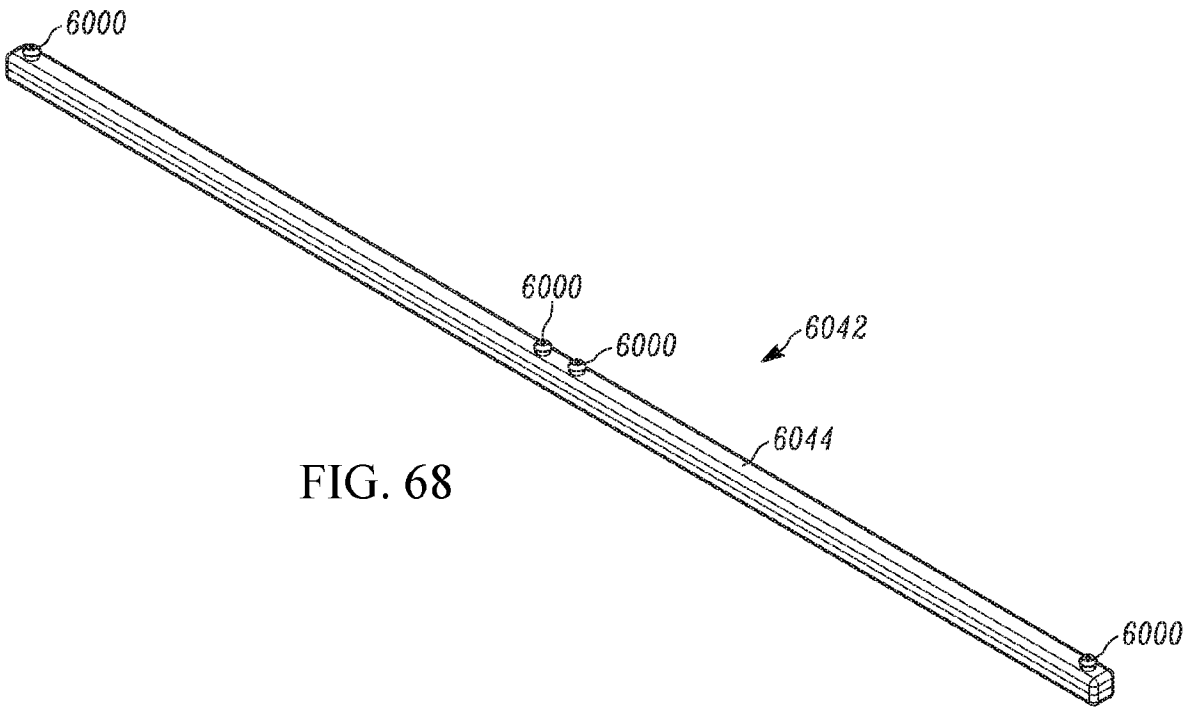
FIG. 68 is a perspective view of another mechanical connector.
Figure 69:
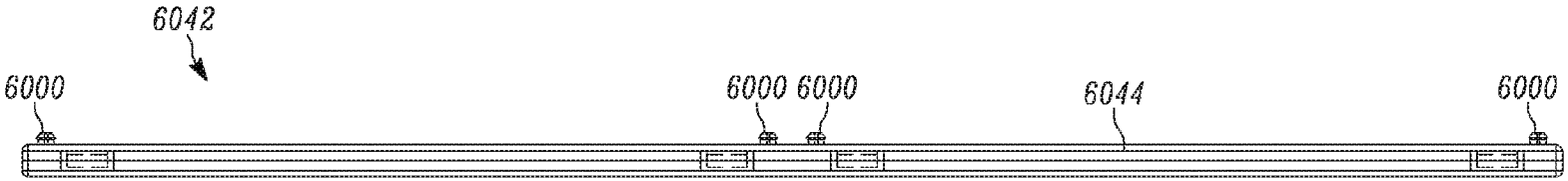
FIG. 69 is a side view of the mechanical connector of FIG. 68.

FIGS. 68 and 69 illustrate another mechanical connector 6042 having a frame 6044 with pegs 6000 disposed thereon. The mechanical connector 6042 operates similarly to the mechanical connectors 4042, 5042 previously discussed. Specifically, the mechanical connector 6042 is configured to have panels attach thereto with the pegs 6000 extending through panel openings. In one illustrative embodiment, the mechanical connector 6042 includes four pegs 6000 disposed along the frame 6044 (as opposed to the previously illustrated two) such that the mechanical connector 6042 can attach two panels 1018. Further, the mechanical connector 6042 also could incorporate a rounded face (not illustrated), if desired.

Figure 70:
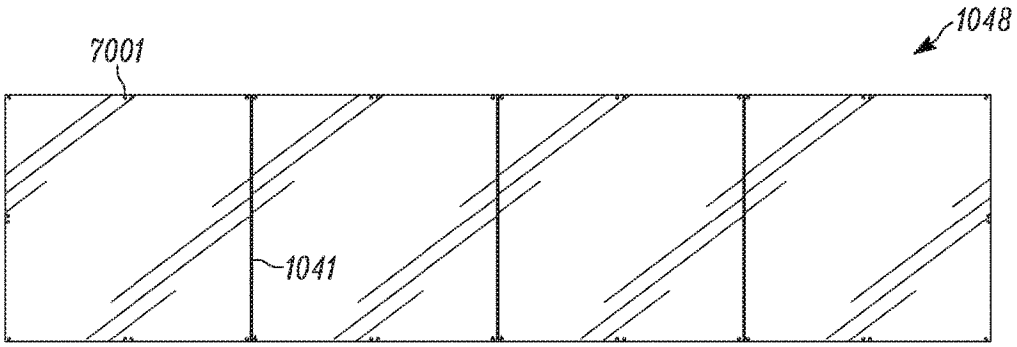
FIG. 70 is a side view of a plurality of connected panels.
Figure 71:
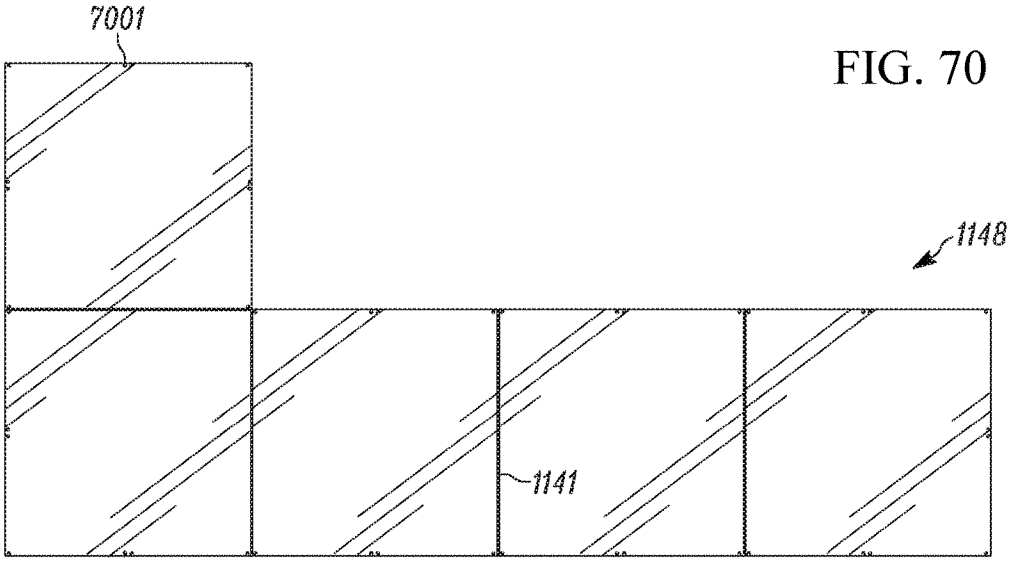
FIG. 71 is a side view of another plurality of connected panels.

By one approach, the mechanical connector 6042 may have a length of about 21.59 centimeters (about 8.5-inches) or about 30.48 centimeters (about 12-inches), possibly depending on the size of the other building tiles and frames. The mechanical connector 6042 also may include four pegs 6000 that are disposed in a configuration that permits the mechanical connector 6042 to attach to two panels, such as, for example panels 1018, 1099, or 1199, among others. In other configurations, a single panel may have openings that correspond to the pegs 6000 disposed along the frame 6044, as illustrated in FIGS. 68 and 69. As illustrated in FIGS. 70 and 71, the panels 1048, 1148, which may be comprised of cardboard or plastic, may have a plurality of openings 7001 that correlate with the location of the pegs 6000 from the mechanical connector 6042. Further, the panels 1048, 1148 may include creases or lines of weakness 1041, 1141 that permit the panels 1048, 1148 to be easily manipulated into a variety of shapes. For example, the panel 1048 can be manipulated into a square shaped box and the panel 1148 can be manipulated into a square box with a lid. Each of the panel sections of the square or box may be approximately 21.59 centimeters (about 8.5-inches) or about 30.48 centimeters (about 12-inches) such that the mechanical connector 6042 may easily mate therewith.

Figure 78:
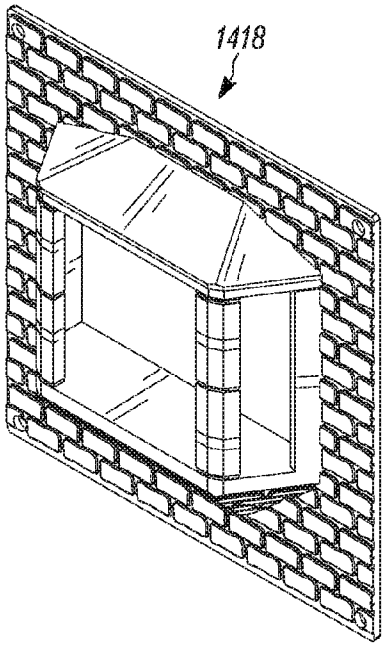
FIG. 78 is a perspective view of another panel.
Figure 77:
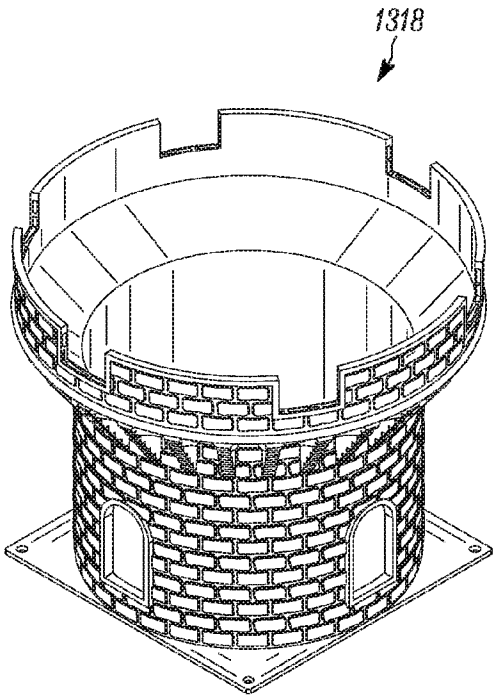
FIG. 77 is a perspective view of another panel.
Figure 76:
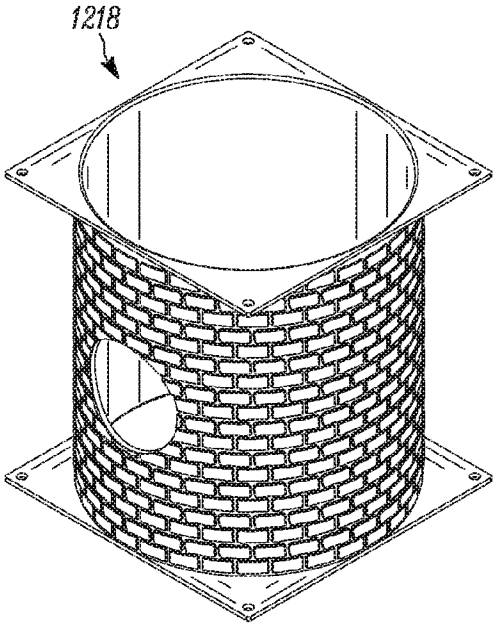
FIG. 76 is a perspective view of another panel.

As mentioned above, the tile frames also may be associated or attached to three-dimensional panels, such as those having a first planar portion and a second portion protruding or otherwise extending from the first planar portion. For example, the panels may incorporate architectural or other design elements that give the panels additional dimension. Such three-dimensional panels may be readily formed into a castle, fort, bridge, and tent, among others. The three-dimensional panels also may be formed to resemble a race track, maze, ball run, or features of animals, vehicles, or superheroes, among many others. FIGS. 76-78 illustrate a few of the myriad of different three-dimensional panels that may be employed with the frames described herein. FIG. 76 illustrates a tunnel panel 1218 with a window opening that may be connected to two frames with one frame at the top of the tunnel panel 1218 and another frame disposed at the bottom of the tunnel panel 1218. The tunnel panel 1218 also may be designed to connect only to a single frame. FIG. 77 illustrates a castle panel 1318 that may be mated to a frame 1012 at its lower end. FIG. 78 illustrates a bay window panel 1418 that may be mated with a frame along its sides, similar to the previously described window panels 1099, 1199, but having additional thickness or dimension. As mentioned above, the tile panels, including the three-dimensional panels, can be made of a variety of materials.

Figure 121:
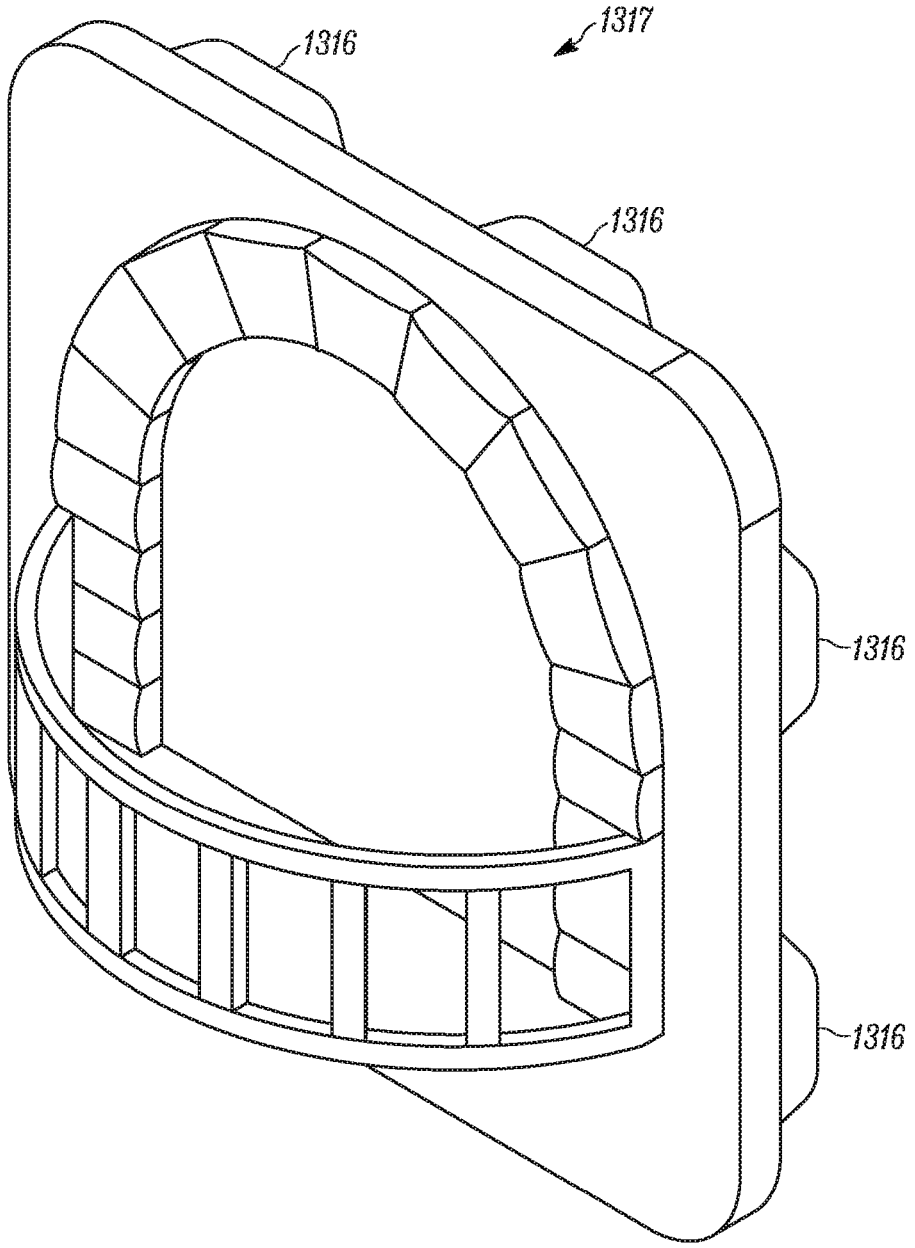
Figure 122:
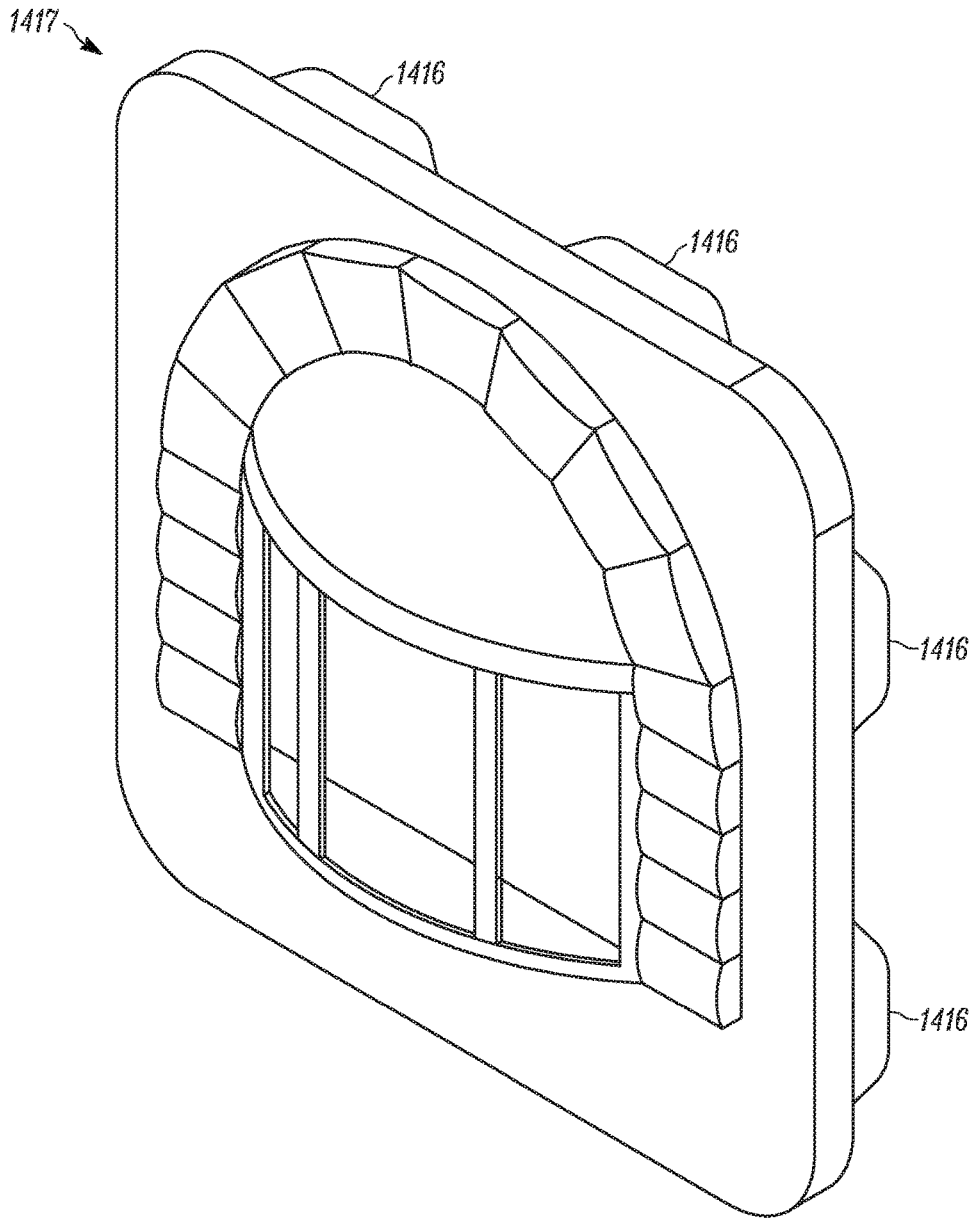
Figure 123:
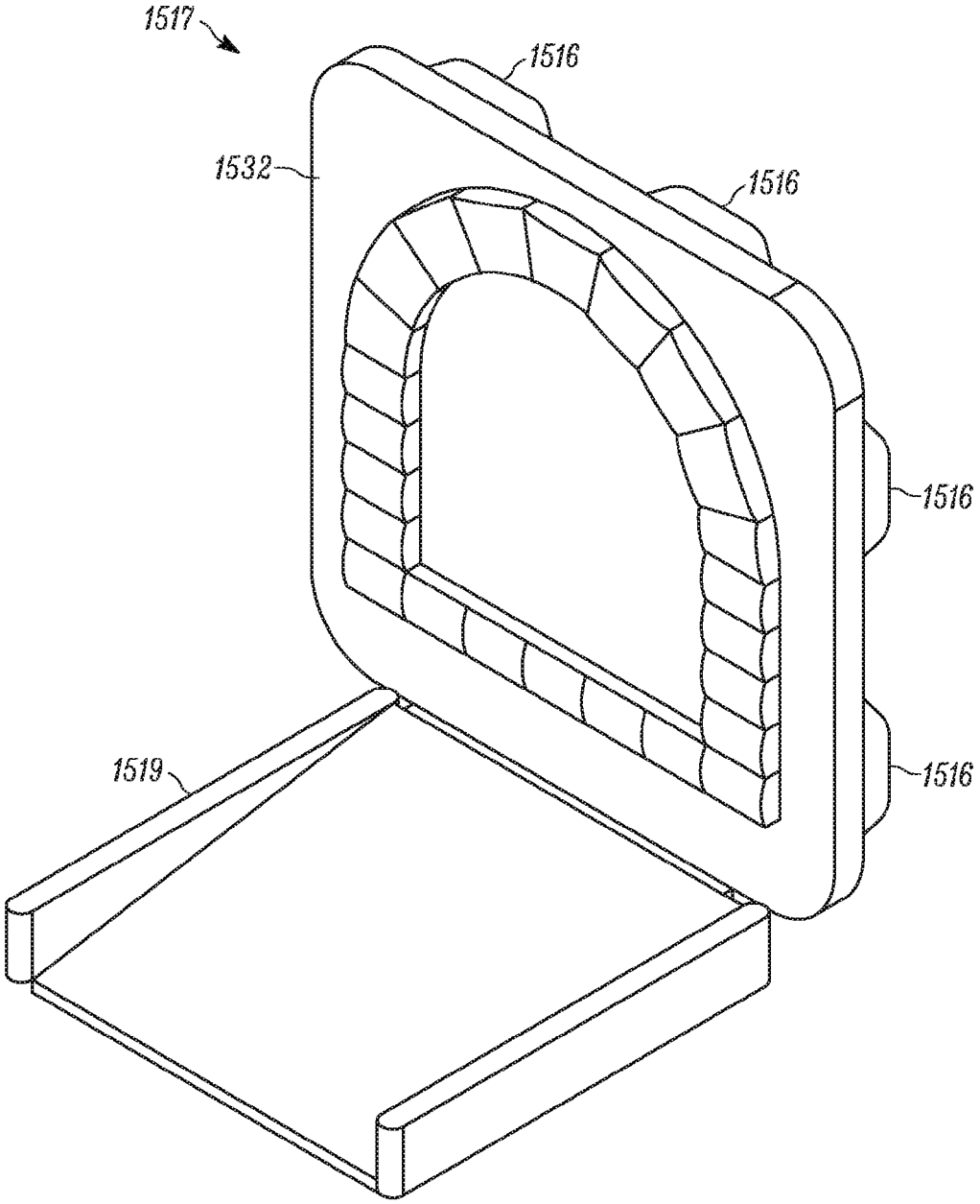
Figure 124:
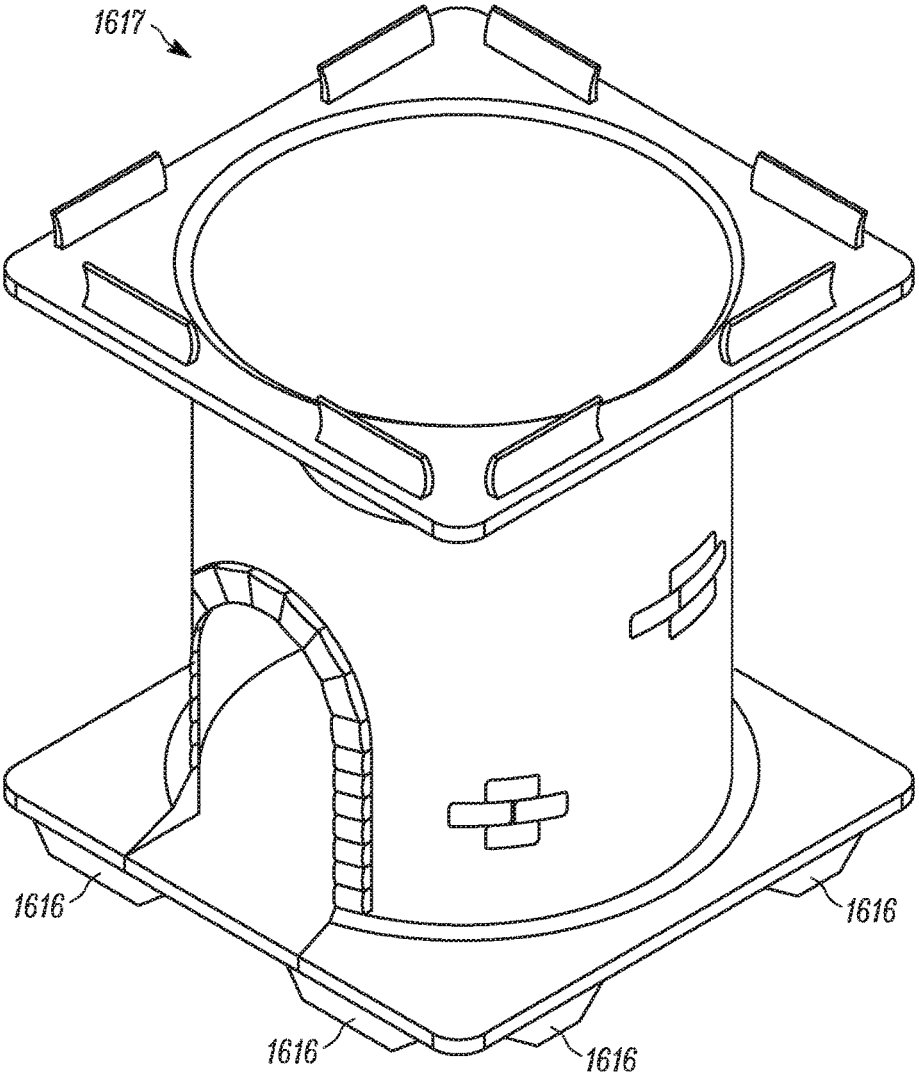
Figure 125:
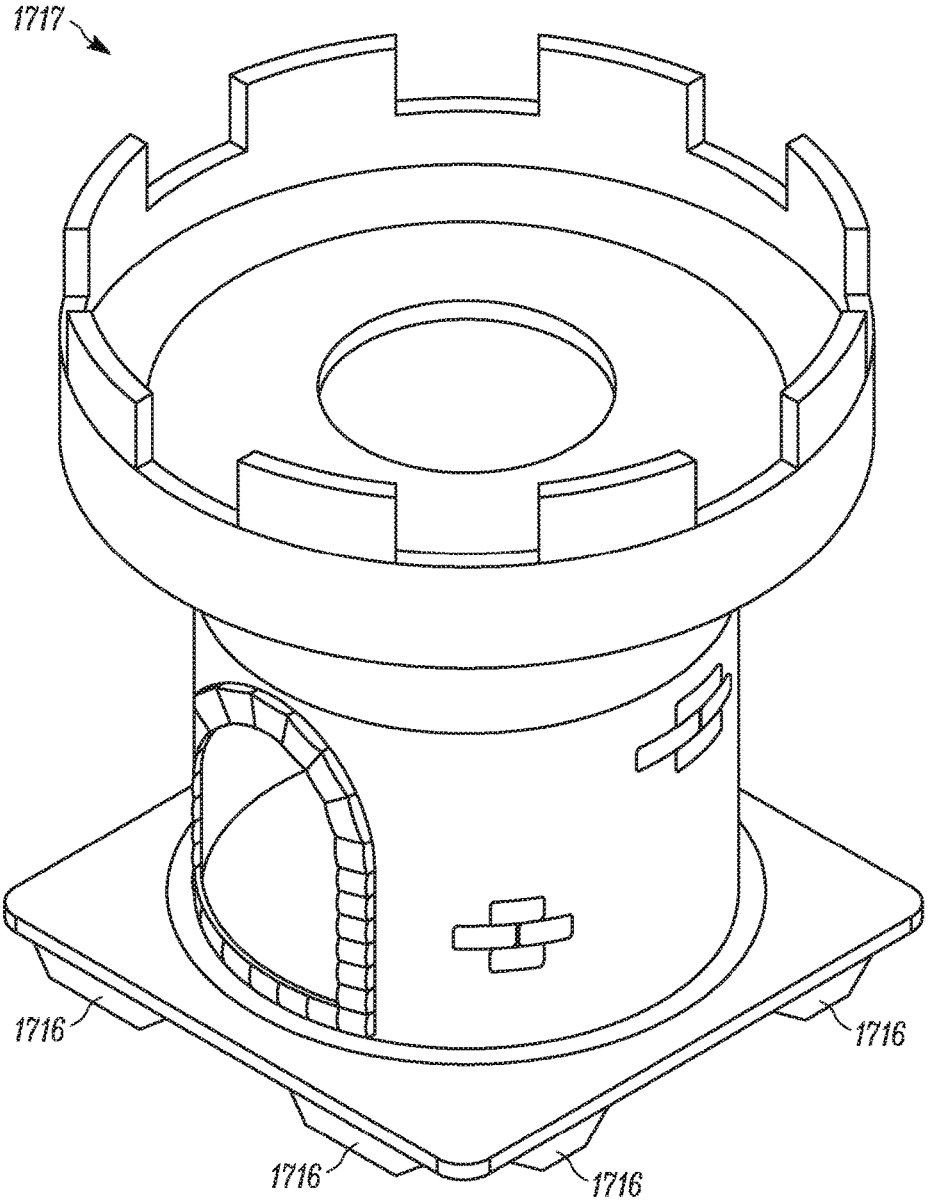
Figure 126:
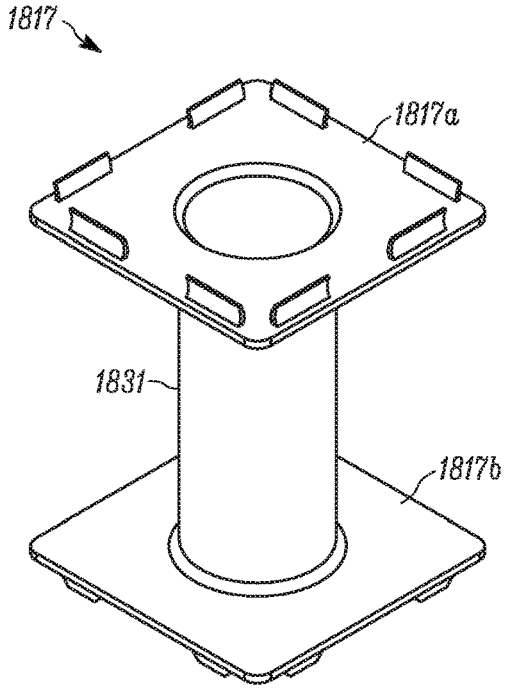
Figure 127:
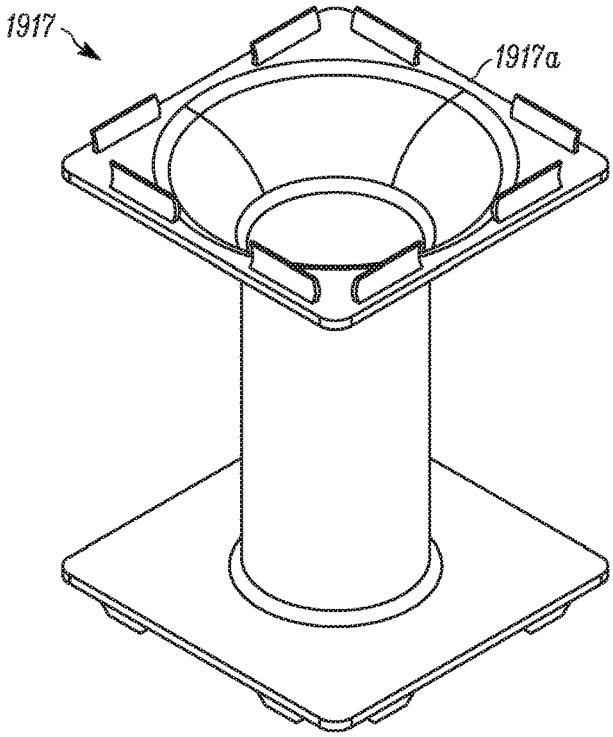
Figure 128:
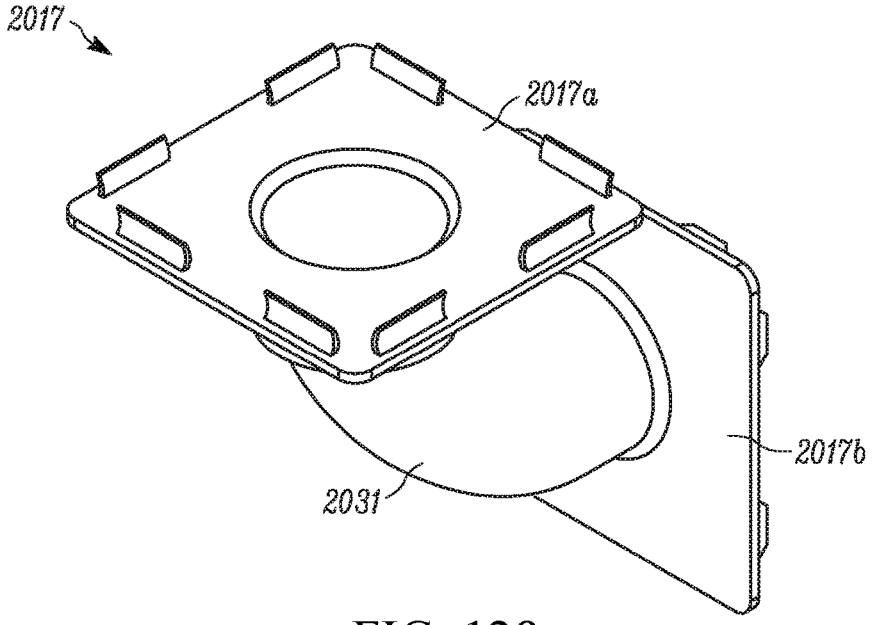

Further examples of three-dimensional castle panels that have a portion thereof that extend beyond the surface of the frame are illustrated in FIGS. 121-125. FIG. 121 illustrates a three-dimensional panel 1317 with a balcony. The balcony panel 1317 may include projections, tabs, or flanges 1316 on the rear side of the panel 1317 that are capable with engaging an inner wall of the frame, such as frame 3312 described above. FIG. 122 also illustrates a three-dimensional panel 1419 that includes a window or balcony. Further, the panel illustrates the projections, tabs, or flanges 1416 that permit the panel 1417 to mate with the frame 3312. Additional castle-themed panels are illustrated in FIGS. 123-125. FIG. 123 illustrates a drawbridge panel 1517 with a panel body 1532 and tabs, projections or flanges 1516 that are configured to mate with the frame 3312 described above. Furthermore, the drawbridge panel 1517 also includes a movable bridge deck 1519 that is hingedly connected to the panel body 1532. FIGS. 124 and 125 are similar to FIGS. 76 and 77, but instead of openings into which the pegs of a frame may extend, the panel 1617 includes tabs, projections, or flanges 1616 that are configured to mate with the frame 3312 described above. Further, similar to the castle tunnel panel 1218, castle tunnel panel 1617 may have a frame attached to the top and bottom of the panel 1617. The castle tower panel 1717 has tabs, projections, or flanges 1716 that may mate with a frame at its lower end.

Figure 81:
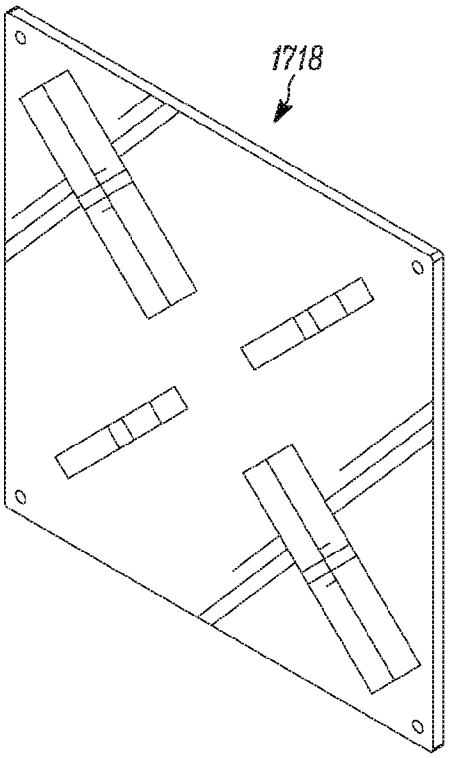
FIG. 81 is a perspective view of another panel.
Figure 80:
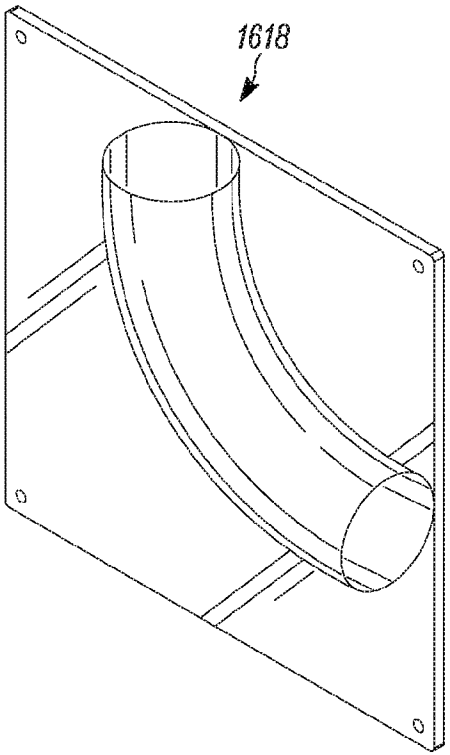
FIG. 80 is a perspective view of another panel.
Figure 79:
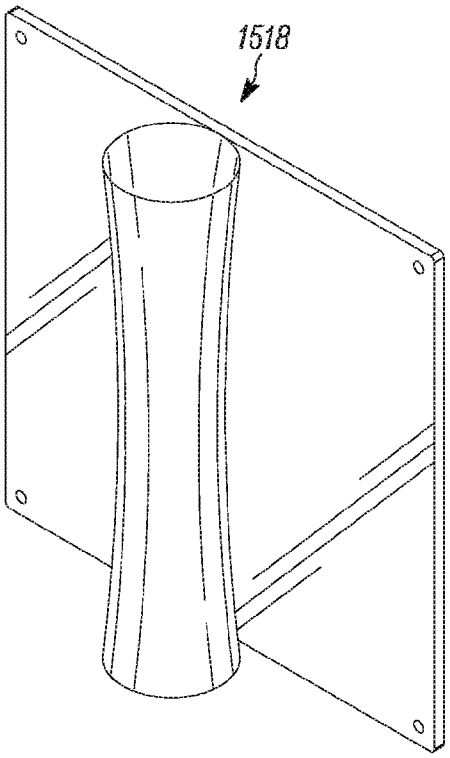
FIG. 79 is a perspective view of another panel.

Though FIGS. 76-78 illustrate various architectural panels, other three-dimensional panels may be employed herewith. FIGS. 79-81 illustrate a plurality of panels 1518, 1618, 1718 that may be incorporated into a maze or ball run. These panels 1518, 1618, 1718 may be combined with frames 1012 and one another to create a path through which a small object can advance or be advanced. FIG. 79 illustrates a panel 1518 having a cylindrical tube shape through which a ball or other smaller object can advance. FIG. 80 illustrates a panel 1618 having a cylindrical tube that is bent such that the ball or smaller object would advance therethrough, but be moved laterally and longitudinally. Finally, FIG. 81 illustrates a panel 1718 that illustrates an X-shape through which a ball or small object could move in a variety of manners. These may be used with a number of other panels such as, for example, a funnel or stepped ball-drop to create a path through which a ball or another small object could be advanced.

Figure 90:
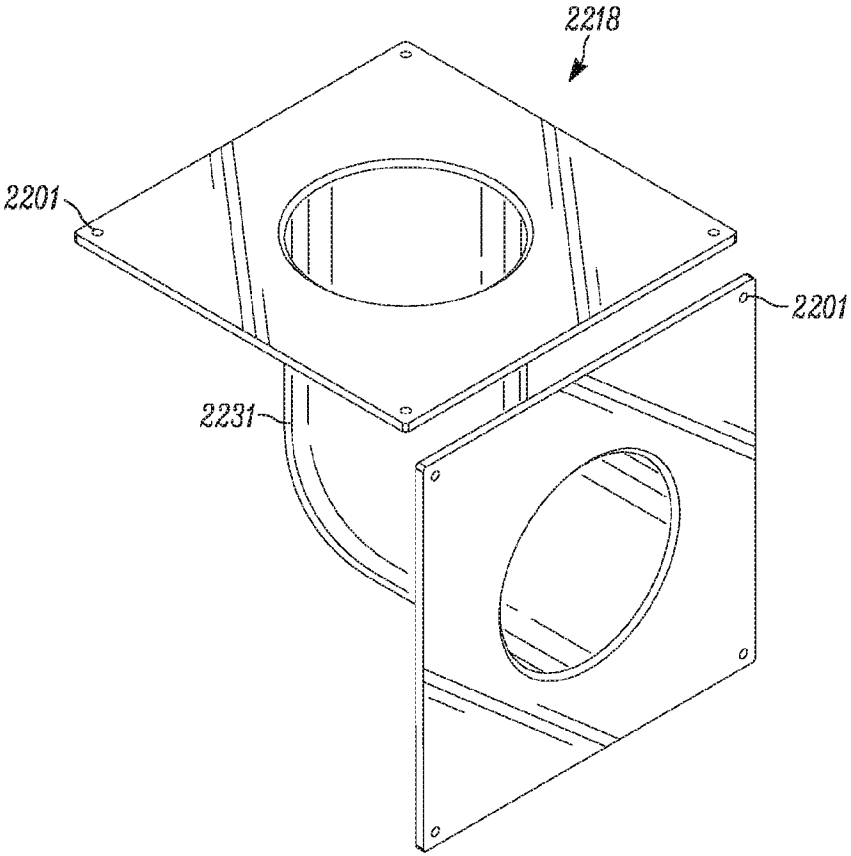
FIG. 90 is a perspective view of another panel.
Figure 89:
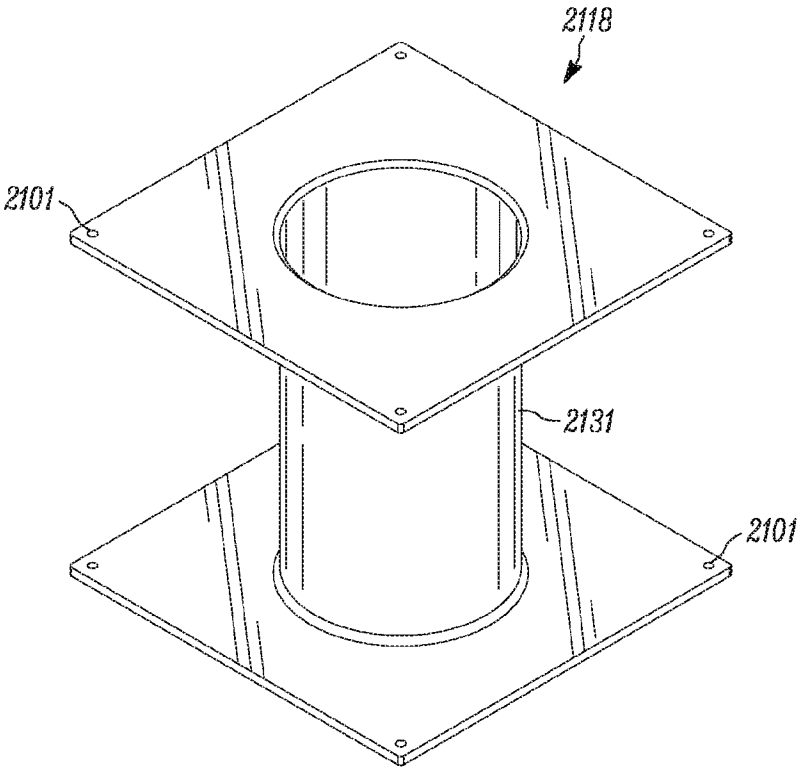
FIG. 89 is a perspective view of another panel.
Figure 91:
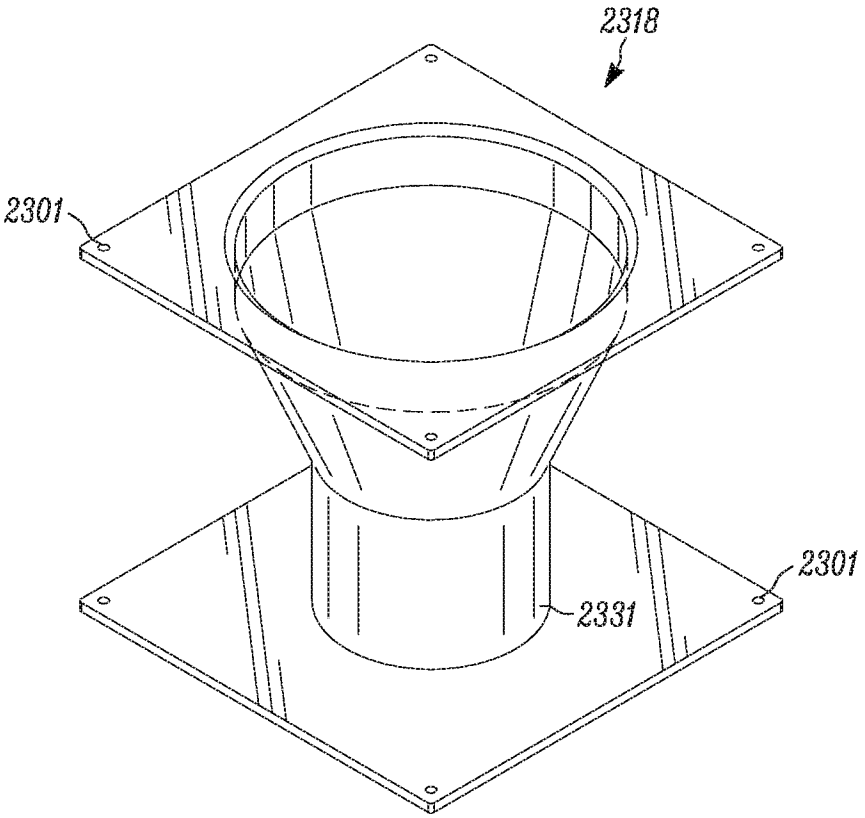
FIG. 91 is a perspective view of another panel.

Another set of panels that may be used to create a ball run or maze can be found in FIGS. 89-91. These panels 2118, 2218, 2318 generally have a first panel or panel section 2118*a*, 2218*a*, 2318*a*, and a second panel or panel section 2118*b*, 2218*b*, 2318*b*. Each of the panel sections has four openings 2101, 2201, 2301 therein. These openings can mate with the plurality of connecting pegs discussed above such that these panels 2118, 2218, 2318 can connect with two of the frames or a number of the mechanical connectors discussed above. Whereas the three-dimensional maze panels illustrated in FIGS. 76-78 may form a ball run or maze adjacent to the frames 1012, the panels in FIGS. 89-91 form a ball run or maze that advances through the panels 2118, 2218, 2318.

In this manner, the three-dimensional panels 2118, 2218, 2318 may be used to form a maze or ball run such that the ball or other object can advance through the maze or ball run and through the frames. To that end, in between the first and second panel sections 2118*a*, 2218*a*, 2318*a*, 2118*b*, 2218*b*, 2318*b*, a center section 2131, 2231, 2331 guides or moves the ball or other object moving through the maze or ball run. For example, in FIG. 89, the panel 2118 includes a straight tunnel section 2131. The center section 2231 of the three-dimensional panel 2218 is a tunnel with a bend. FIG. 91 illustrates a three-dimensional panel 2318 with a funnel section 2331. These three-dimensional panels, and others, can be used with the frames described herein to form a number of maze or ball run configurations.

Figure 129:
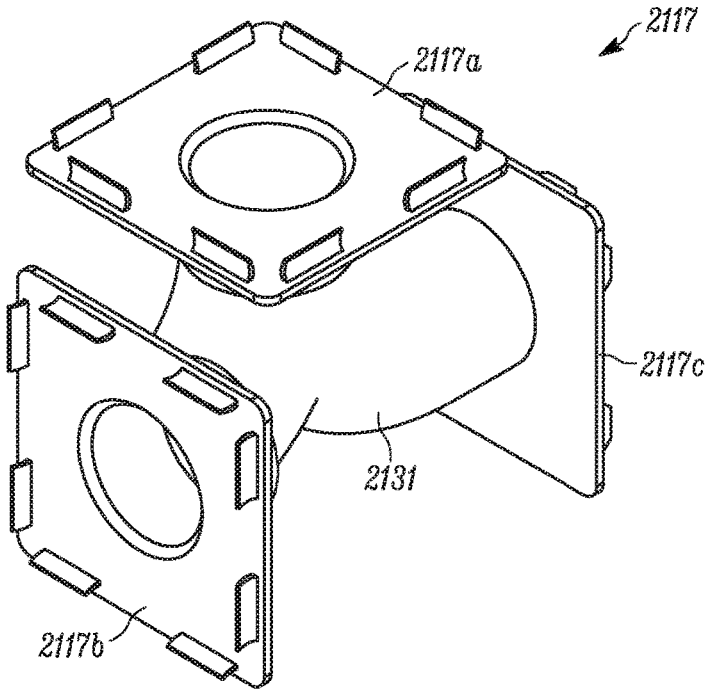
Figure 130:
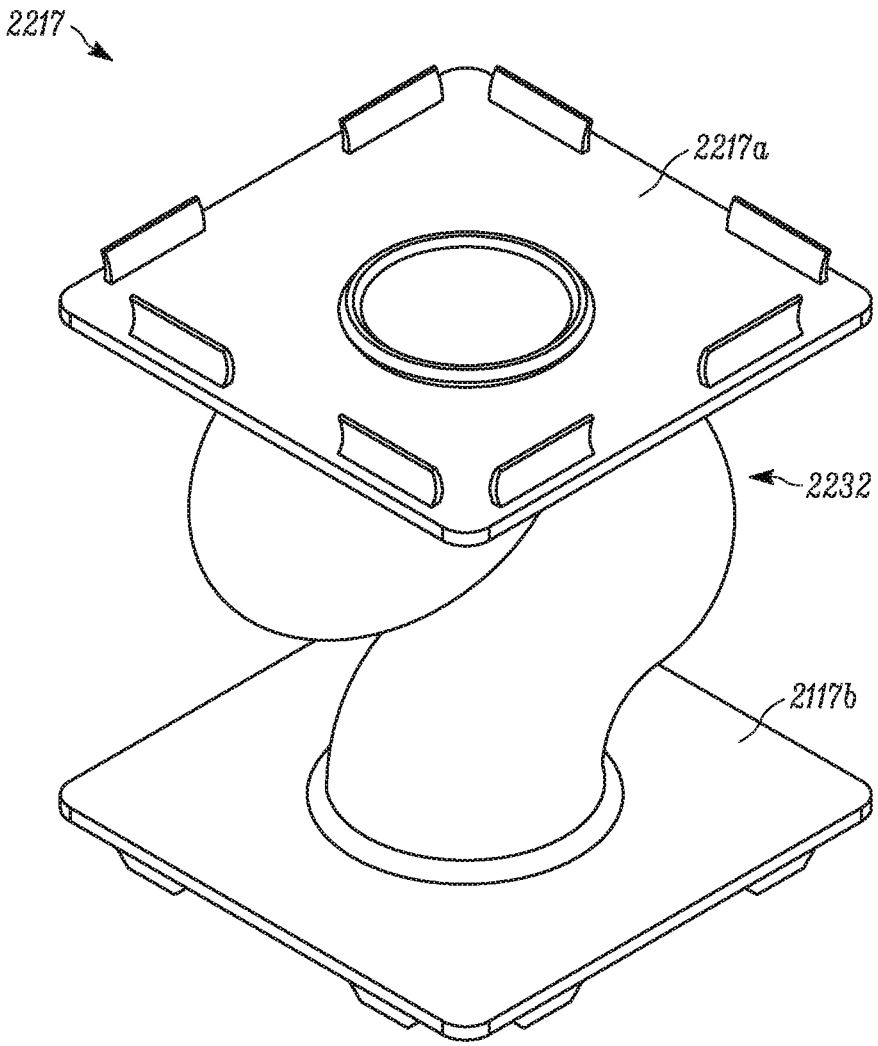
Figure 131:
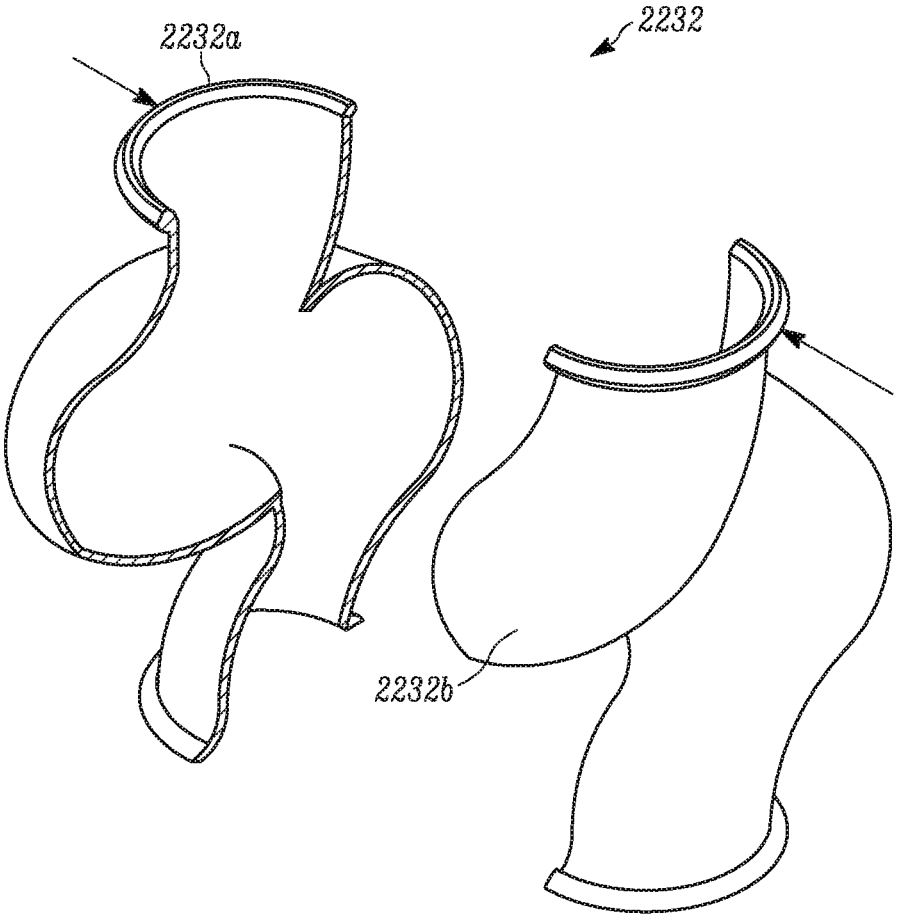
FIG. 131 is a perspective view of a portion of the panel of FIG. 130.

Though these three-dimensional panels have been illustrated with openings to connect to the frame with the connecting pegs, these three-dimensional panels also may have channels or other elements that permit them to easily mate with the other frames described herein. For example, FIGS. 126-131 illustrate panels 1817, 1917, 2017, 2117, 2217, similar to the ball run or maze previously described. The panels are configured to permit a ball or other object to advance through the panels and frames of the maze. The panels 1817, 1917, 2017 have a first panel section 1817*a*, 1917*a*, 2017*a* and a second panel section 1817*b*, 1917*b*, 2017*b* with a center section 1831, 1931, 2031 that guides or moves the ball or other object moving through the maze or ball run. FIG. 129 illustrates a panel 2117 that may connect with three frames along panel portions 2117*a*, 2117*b*, and 2117*c*. The center section 2131 connects the three panel portions 2117 such that the ball or other object may advance through any of the frames connected thereto. FIG. 130 illustrates a panel 2217 with a first and second panel portion 2217*a*, 2217*b* and a center section 2232 therebetween. The center section of FIG. 130 is shown in two portions in FIG. 131 and illustrates how the center portion 2232 may be manufactured in two pieces and attached together to form a portion of the panel 2217

Figure 82:
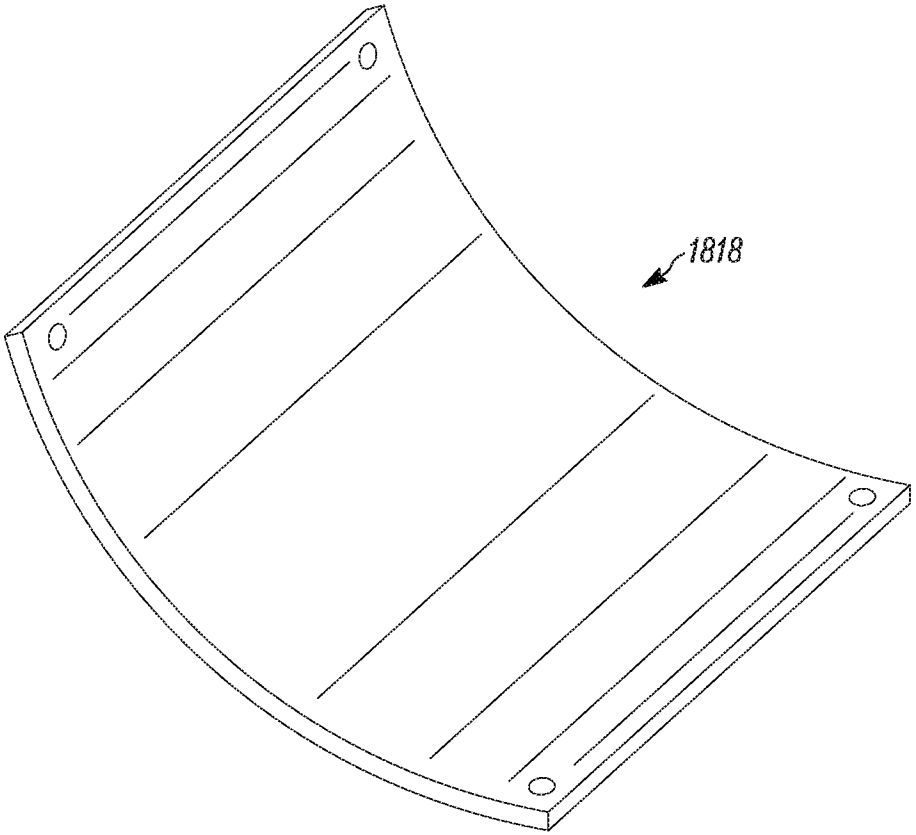
FIG. 82 is a perspective view of another panel.
Figure 83:
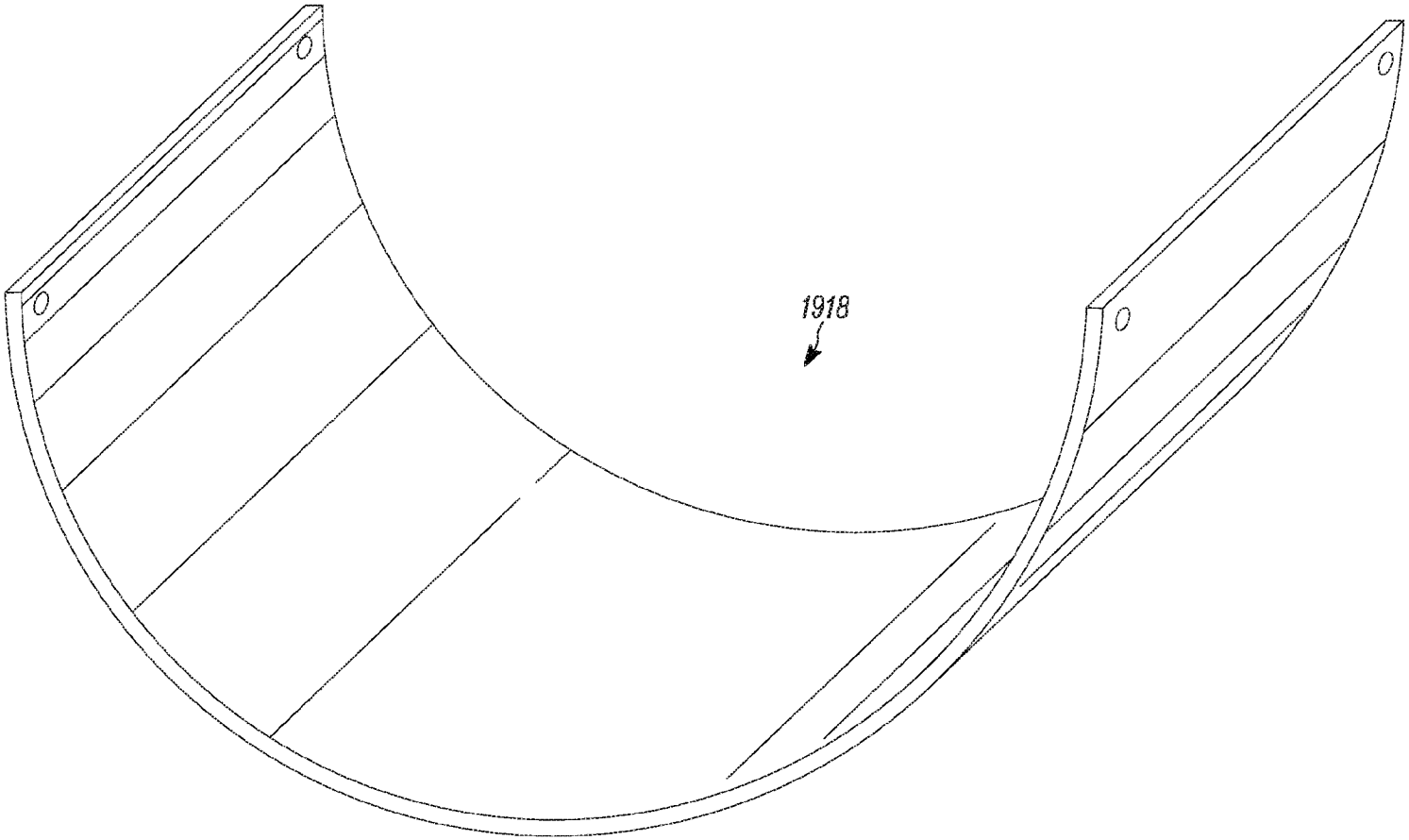
FIG. 83 is a perspective view of another panel.

Other three-dimensional panels may be used to build structures, such as, for example, a race track for vehicles. A number of different panels may be incorporated into a race track including, for example, a ramp panel 1818, as shown in FIG. 82 or a half-pipe panel 1918, shown in FIG. 83. These and other panels, such as an arcuate or bridge panel 2018, may be used together to provide a road, course, or race track for users to move toy vehicles, such as cars or trucks.

Figure 84:
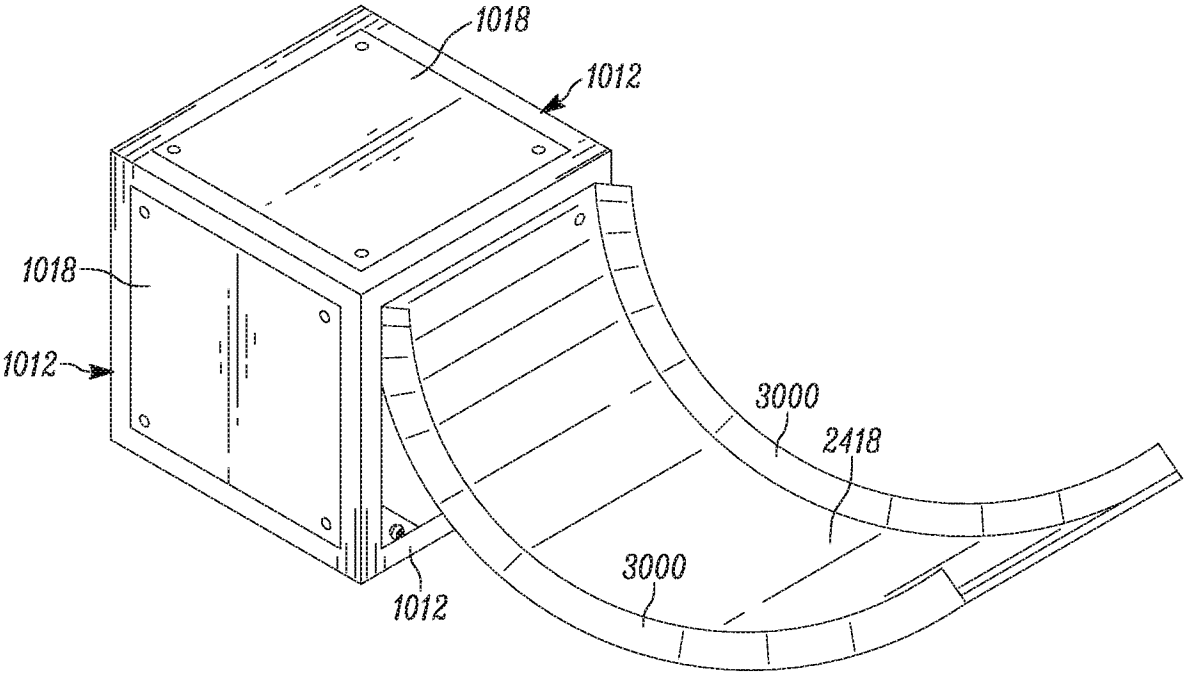
FIG. 84 is a perspective view illustrating magnetic building tiles, frames, and panels arranged together.
Figure 85:
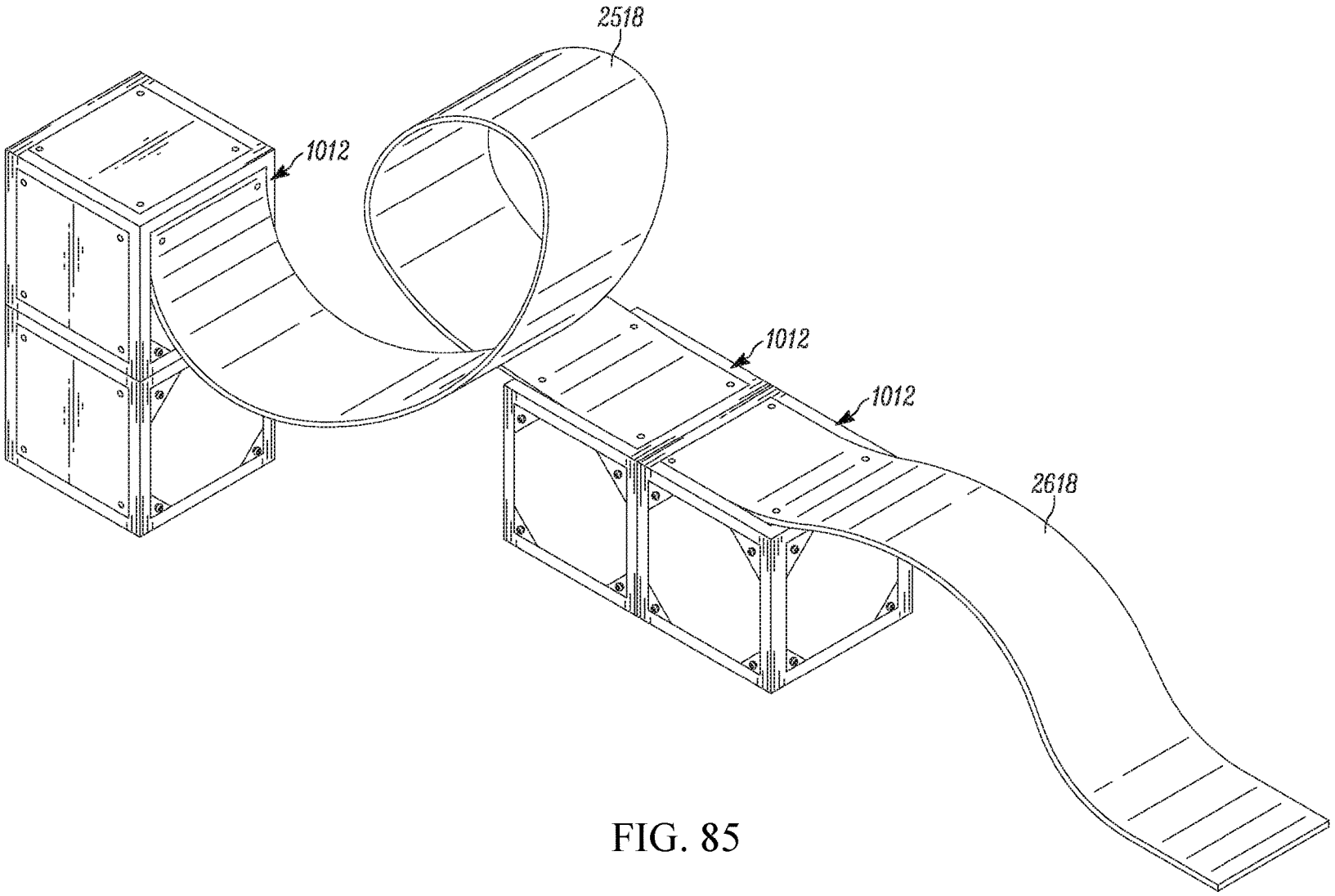
FIG. 85 is a perspective view illustrating magnetic building tiles, frames, and panels arranged together.
Figure 86:
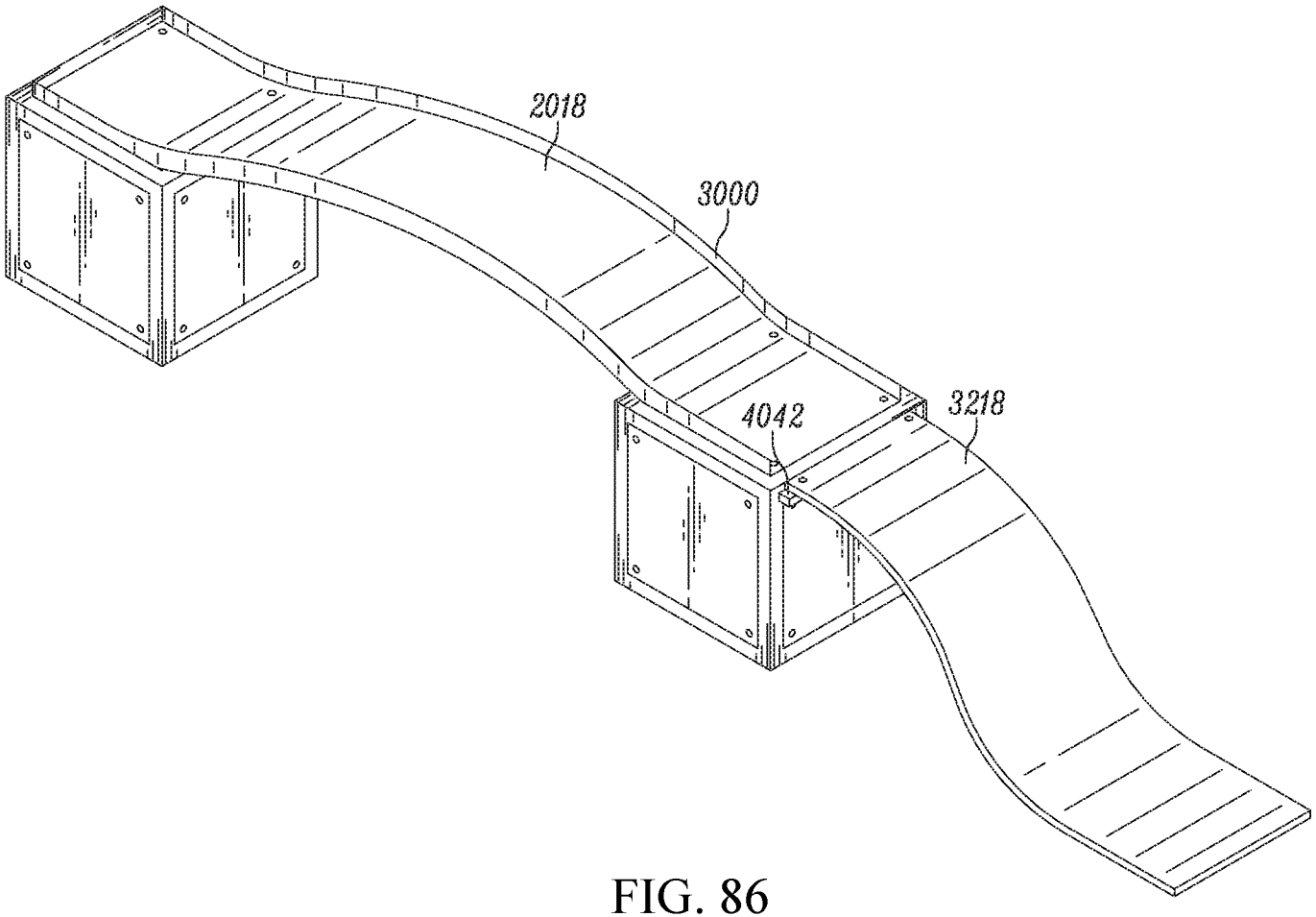
FIG. 86 is a perspective view illustrating magnetic building tiles, frames, and panels arranged together.
Figure 87:
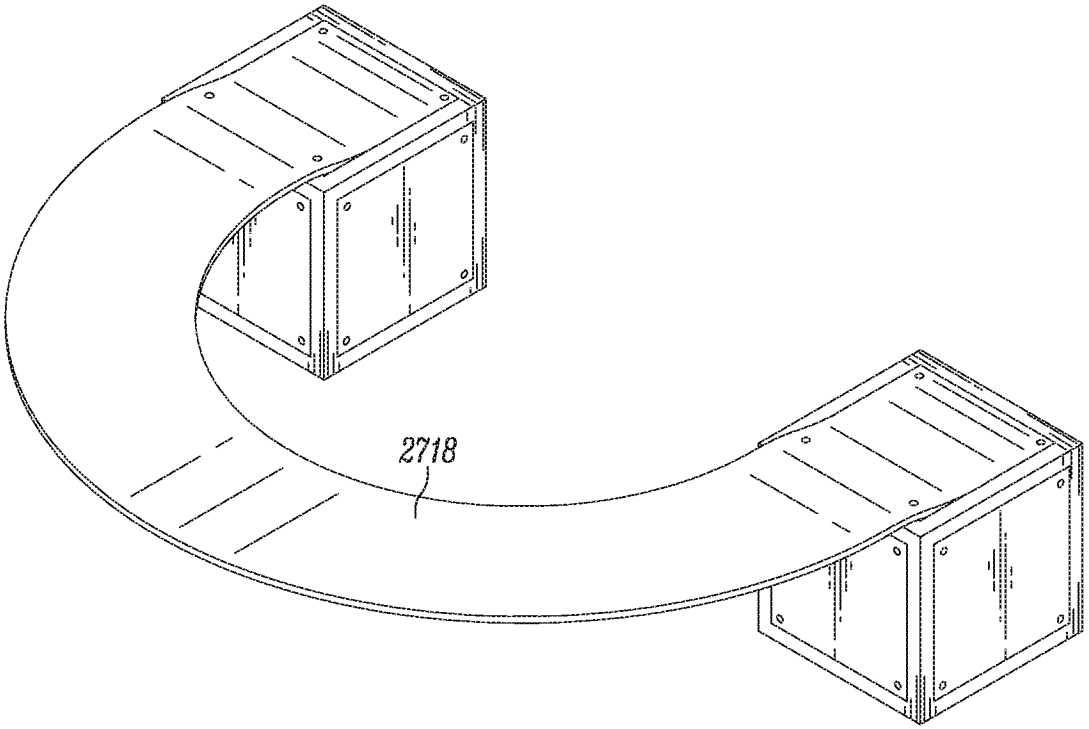
FIG. 87 is a perspective view illustrating magnetic building tiles, frames, and panels arranged together.
Figure 88:
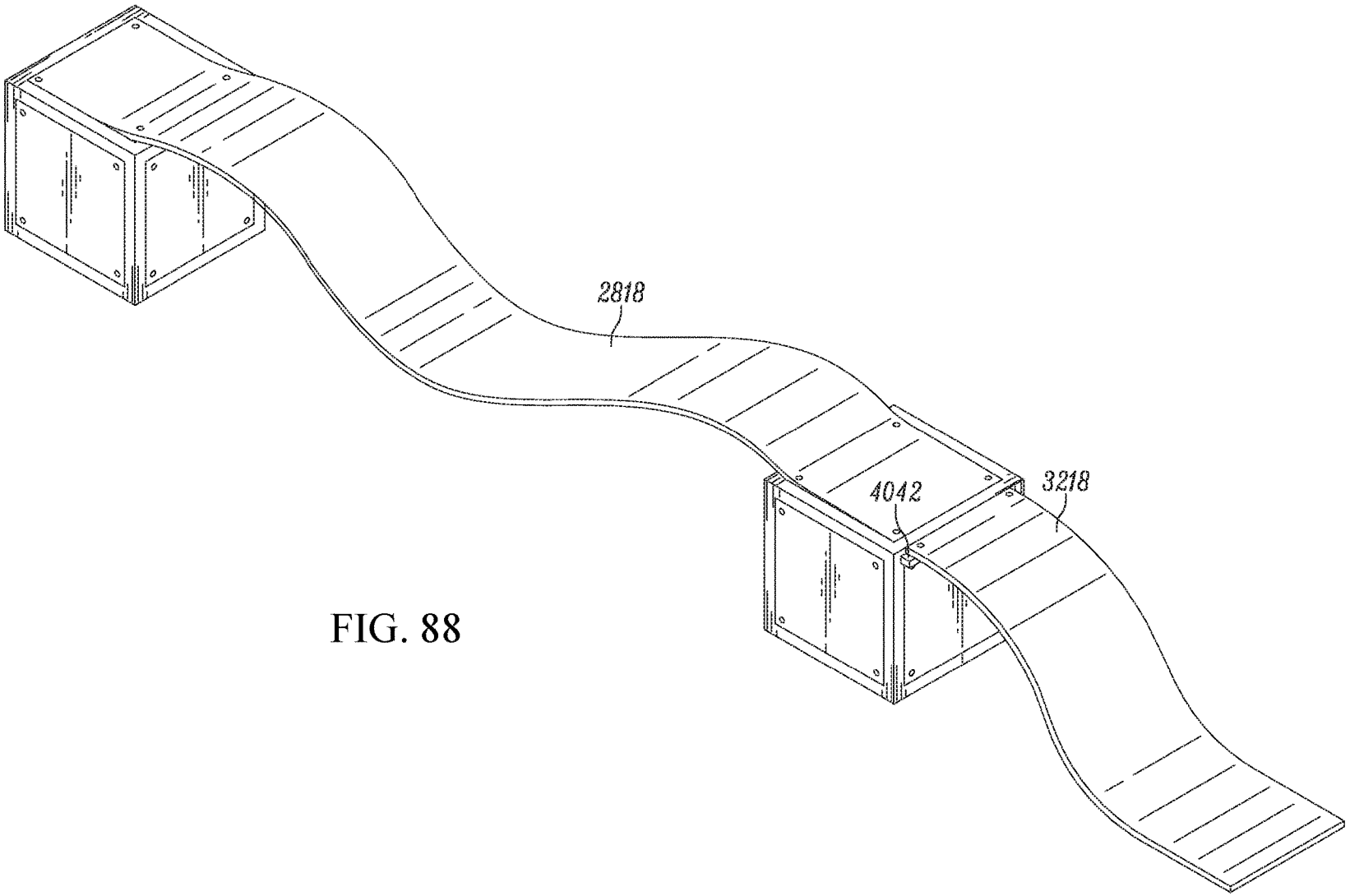
FIG. 88 is a perspective view illustrating magnetic building tiles, frames, and panels arranged together.

FIGS. 84 to 88 illustrate a few illustrative track formations. FIG. 84 illustrates a ramp 2418 attached to a plurality of tile panels 1012. FIG. 85 illustrates loop panel 2518 and an exit ramp 2618. FIG. 86 illustrates a bridge panel 2018 that may be used to connect two distinct groups of tiles 1010 or frames 1012. FIGS. 87 and 88 illustrate two additional three-dimensional panels 2718, 2818, respectively. Each of the panels 2718, 2818 has a curved section around which a plurality of vehicles may travel. Each of the three-dimensional panels includes openings through which the panel may be mated with the pegs of the frames described herein. The panels may have a number of different openings and opening configurations. In one illustrative embodiment, the three-dimensional panels include four openings therein (see, e.g., panel 2618 of FIG. 85) to permit the panels to attach to a frame with four fasteners. Further, such panels may include a variable thickness to help secure the panel to the fasteners of the frame. In another approach, the three-dimensional panels may include two openings therein (see, e.g., panel 3218 that attaches to the mechanical connector 4042 in FIGS. 86 and 88). The three-dimensional panels with two openings may easily connect with the mechanical connectors described herein, which themselves may attach other magnetic frames and tiles.

The three-dimensional race track panels described herein also may include a lip, flange, ledge, or guardrail to assist a user with keeping the vehicles on the track. As illustrated in FIGS. 84 and 86, the guard rail 3000 may merely be one-piece raised rim. In other configurations, the guardrail may include a number of pieces such as posts and rails.

Figure 132:
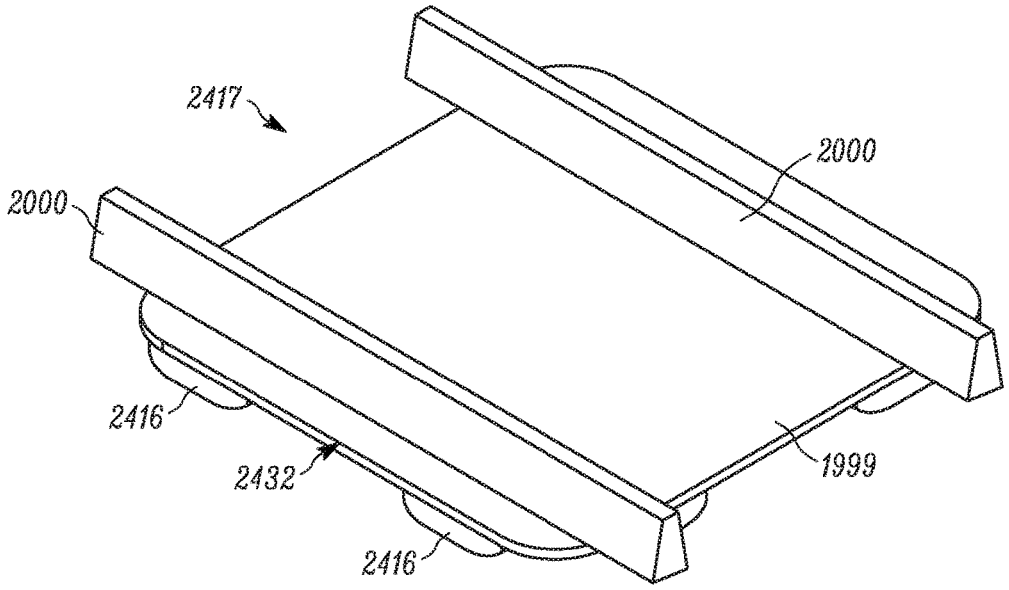
FIGS. 132 to 148 are perspective views of additional panel embodiments.
Figure 133:
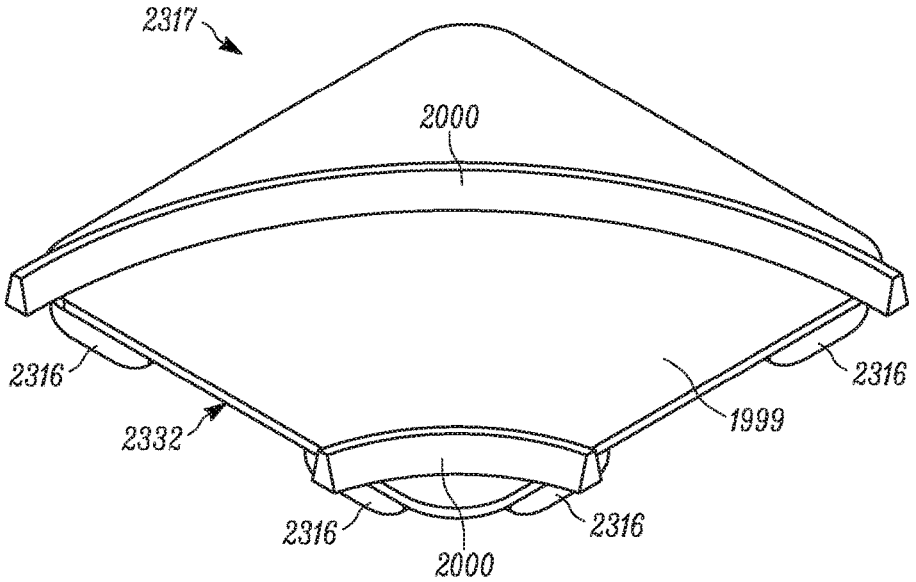
Figure 134:
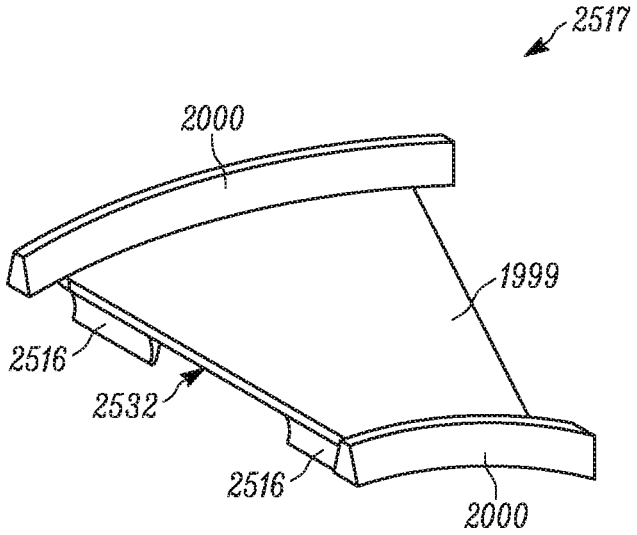
Figure 136:
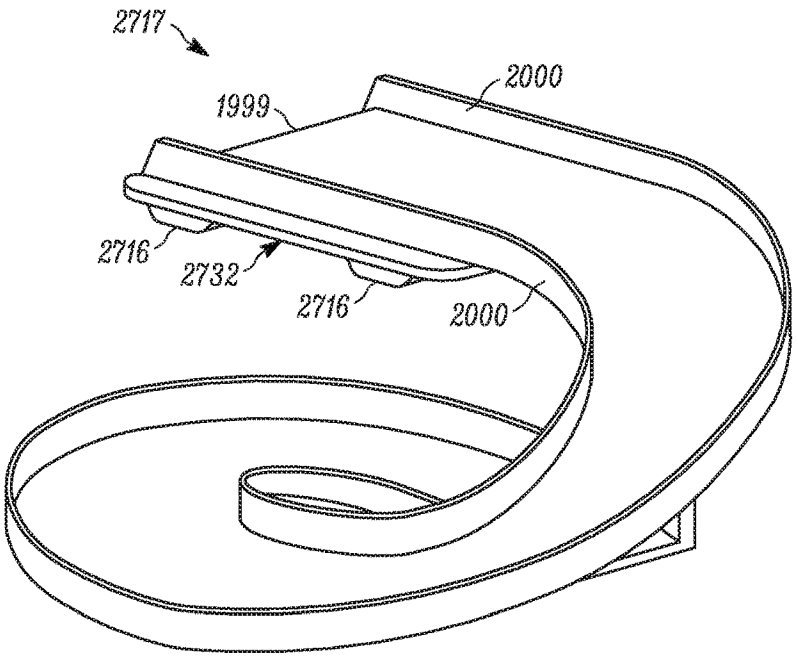
Figure 135:
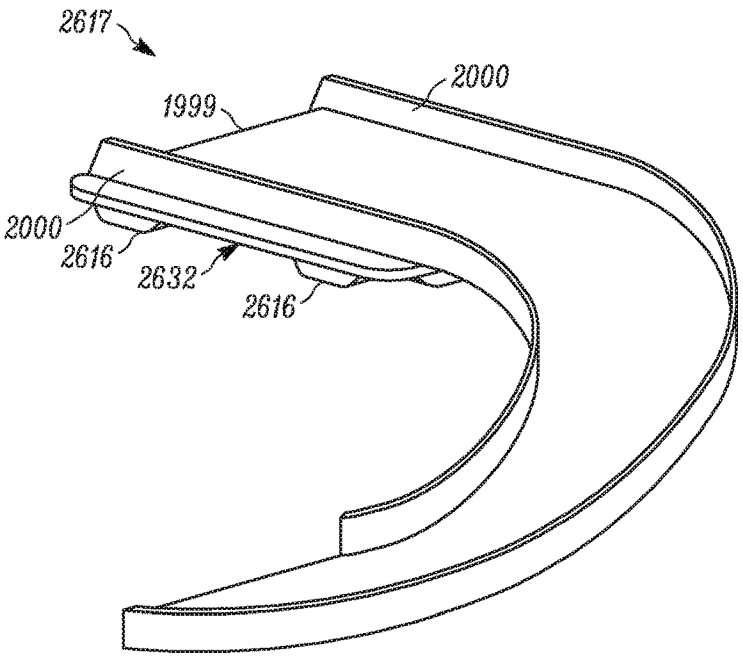
Figure 137:
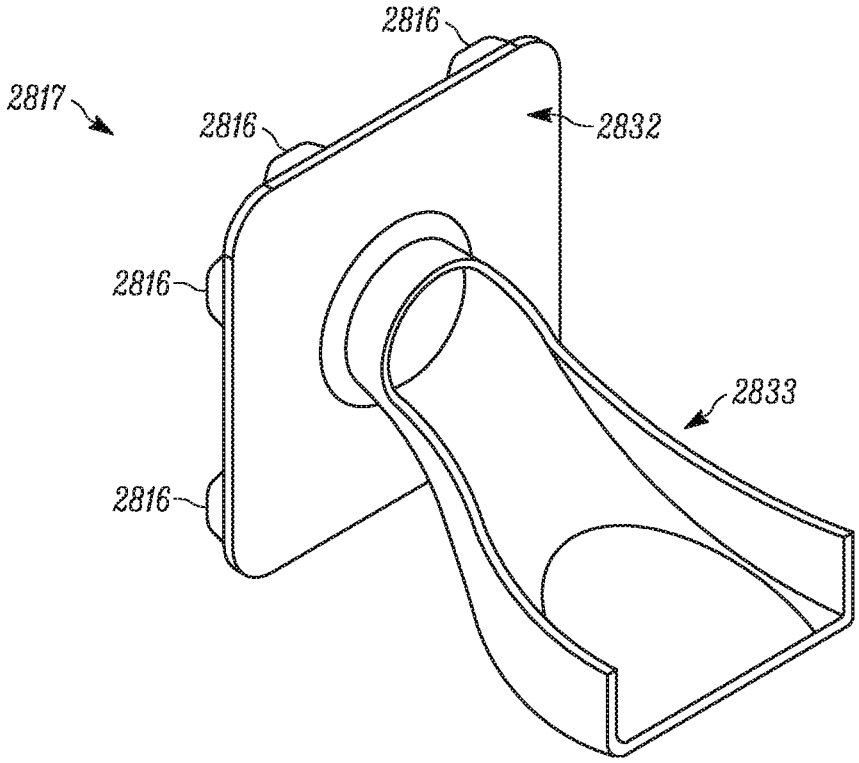
Figure 138:
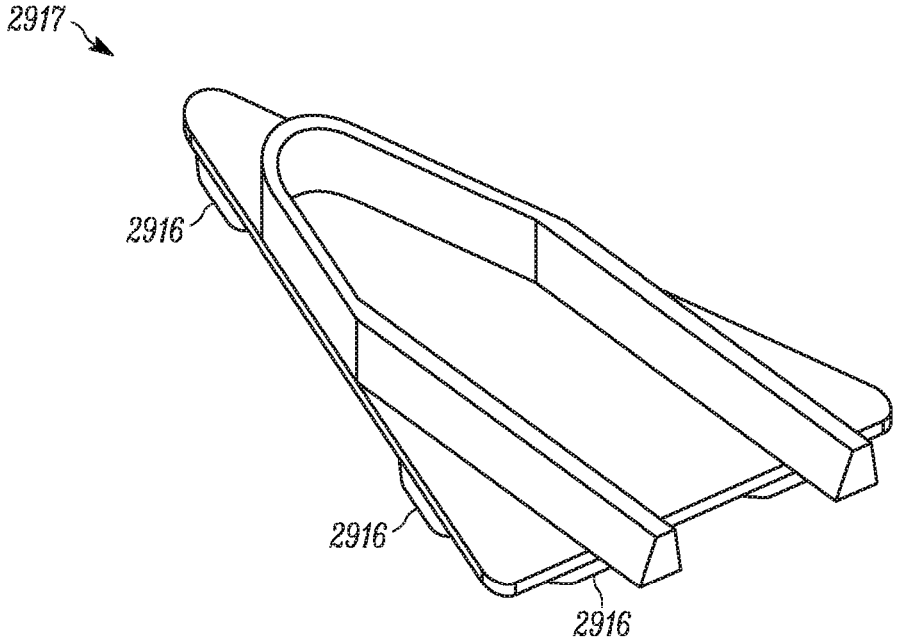
Figure 139:
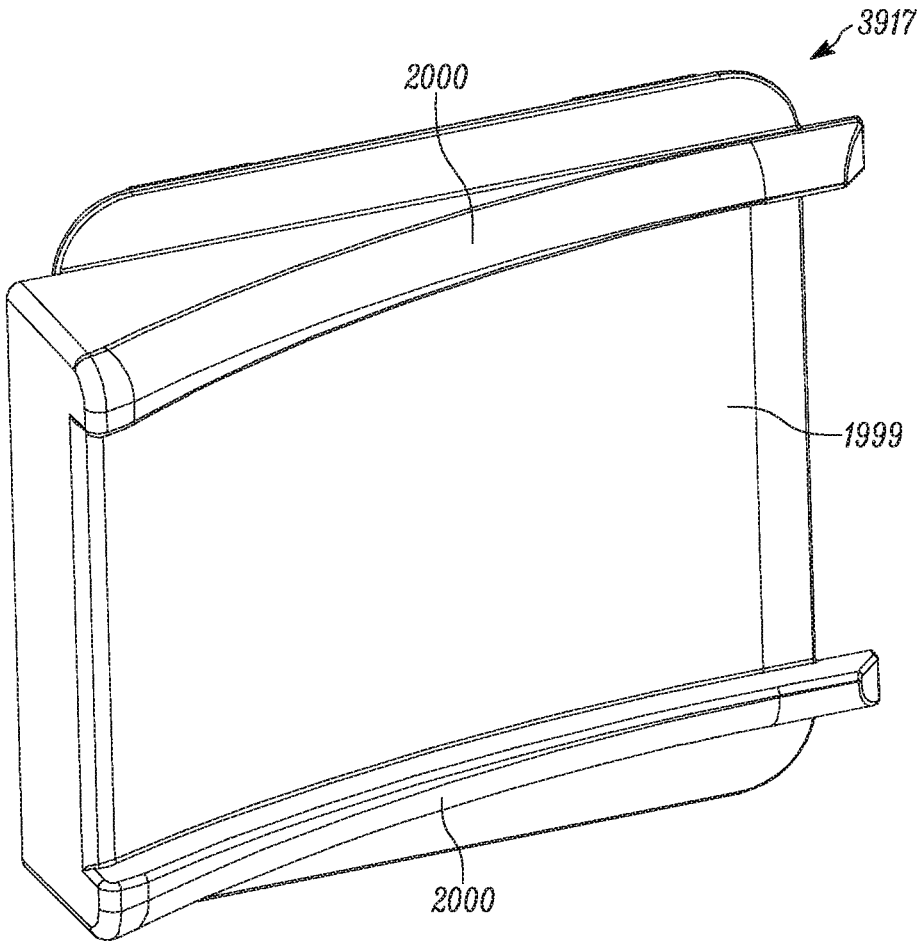

FIGS. 132-139 also illustrate various road or track formation panels that may be secured to the frames, such as frames 3312 discussed above. FIGS. 132-134 illustrate a straight panel 2417 and curved panels 2317, 2517 with different degrees of curvature. These race track panels have guardrails 2000 along the sides of the center portion 1999 to retain the cars thereon. The panels 2317, 2417 have a square shaped panel body 2332, 2432 and projections, tabs, or flanges 2316, 2416 extending therefrom to connect the panels to a frame such as those described above. The panel 2517, shown in FIG. 134, has a triangular shaped body 2532 and flanges 2516 that permit the panel 2517 to make with a triangular frame such as frame 3412. FIGS. 135 and 136 illustrate two road or track turn panels 2617, 2717 with 180° and 360° turns, respectively. Further, the panels have panel body portions 2632, 2732 with flanges 2616, 2717 that are configured to mate with frames such as some of those discussed above. FIG. 137 illustrates a panel 2817 with a sloping section 2833, a panel body 2832, and flanges 2816 permitting attachment to a frame. The panel 2817 may be used by children as a transition panel between other ball run and race track panels. FIG. 138 illustrates a panel 2917 that may be attached to an isosceles triangle frame, such as frame 3512, and is likely to find many uses by children playing with both ball run and race track building tiles. The panel 3917, which is shown in FIG. 139, may be used as a ramp or bridge approach. The panel 3917 includes a center portion for the vehicles 1999 and guardrails 2000, similar to those previously discussed.

Figure 140:
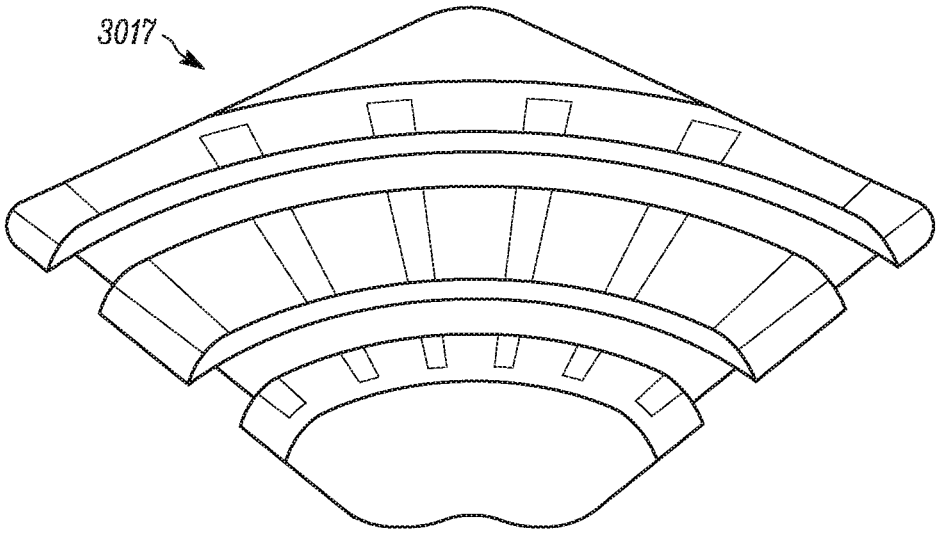
Figure 141:
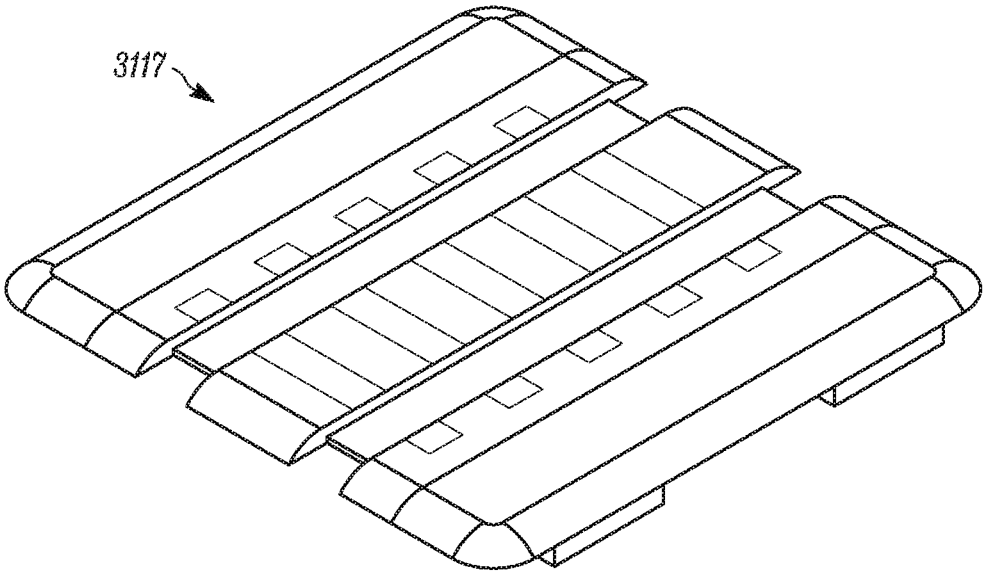
Figure 142:
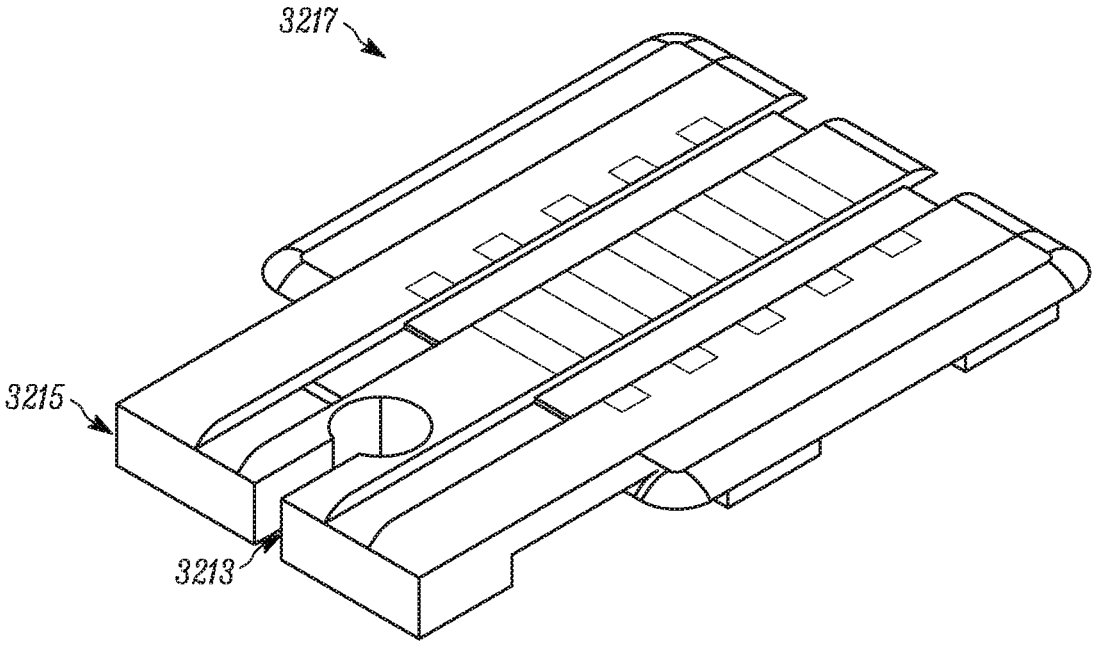
Figure 143:
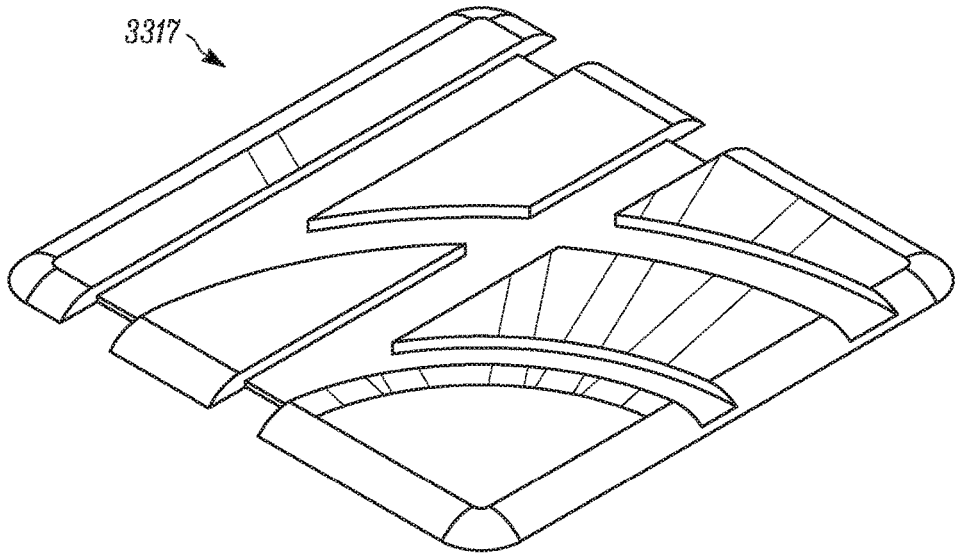
Figure 144:
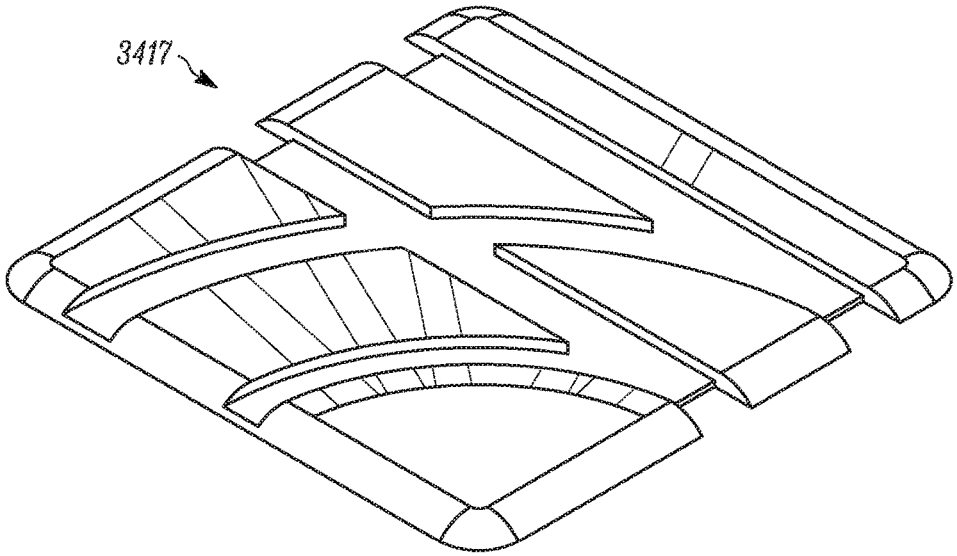
Figure 145:
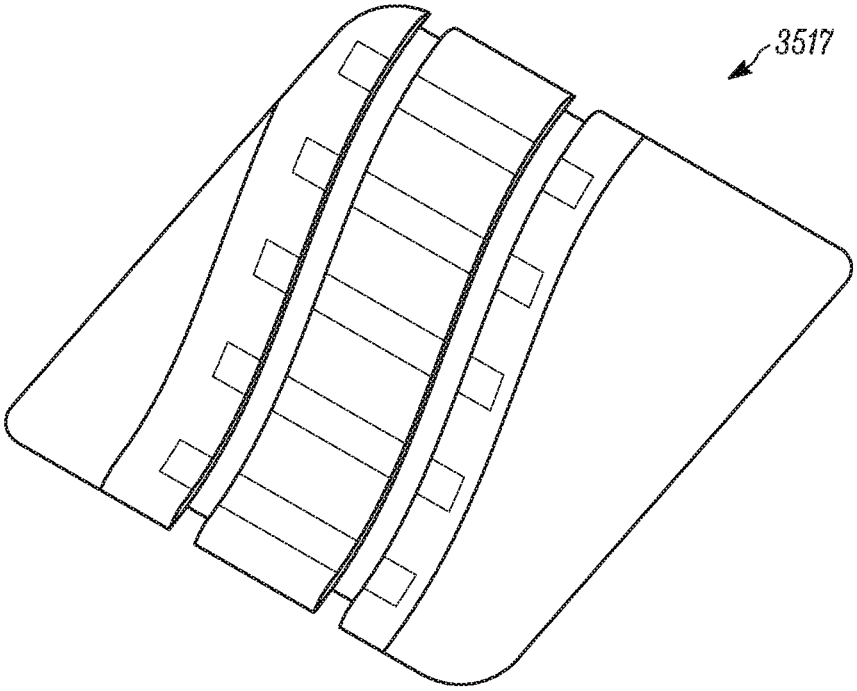
Figure 146:
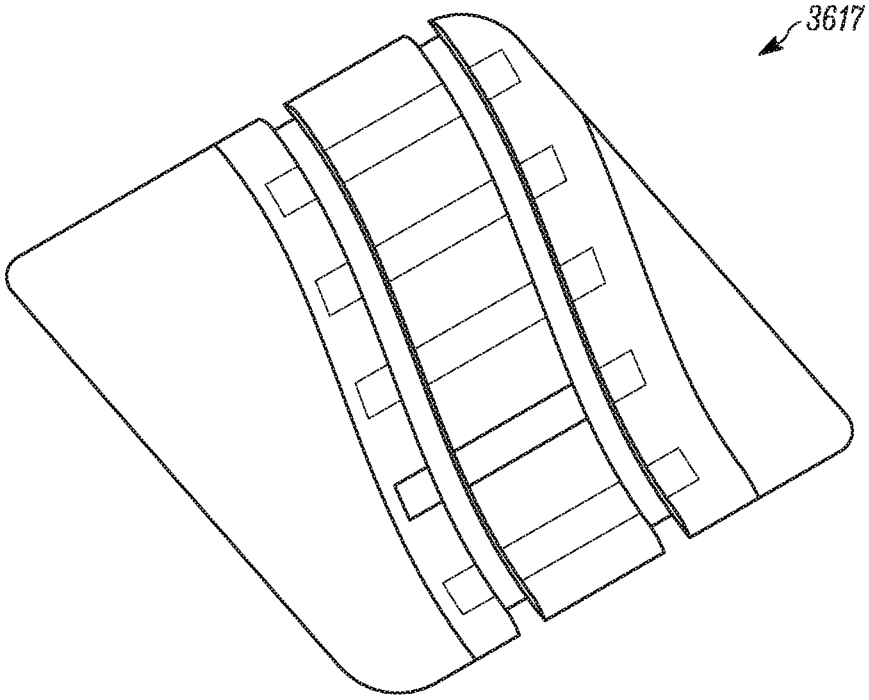
Figure 147:
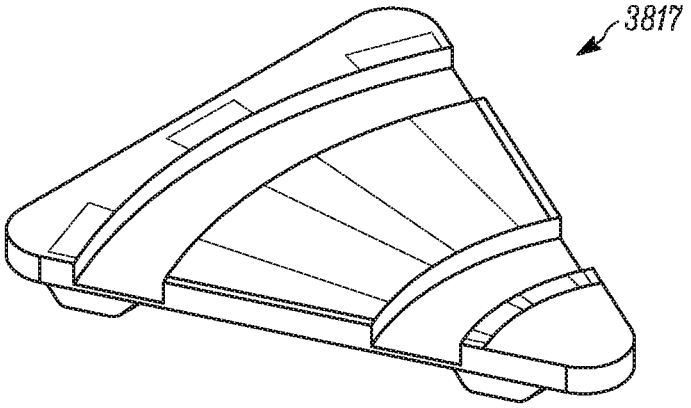

In yet another embodiment, the panels may have a railroad track configuration, as shown in FIGS. 140-148. FIGS. 140 and 141 illustrate a curved railroad track panel 3017 and a straight railroad track panel 3117, respectively. The railroad track panels 3017, 3117 have flanges thereon that permit attachment to panel 3312 discussed above. FIG. 142 illustrates a straight railroad track panel 3217 that a thicker edge 3215 with an opening therein 3213, which can couple with wooden railroad tracks. FIGS. 143 and 144 illustrate a y-track or merge railroad track panels 3317, 3417. FIGS. 145 and 146 illustrate railroad track panels 3517, 3617 that provide for moving the tracks to a position offset from a center of the panel. FIG. 147 illustrates a railroad track panel 3817 that is connectable with the triangular tile frame 3412.

Figure 148:
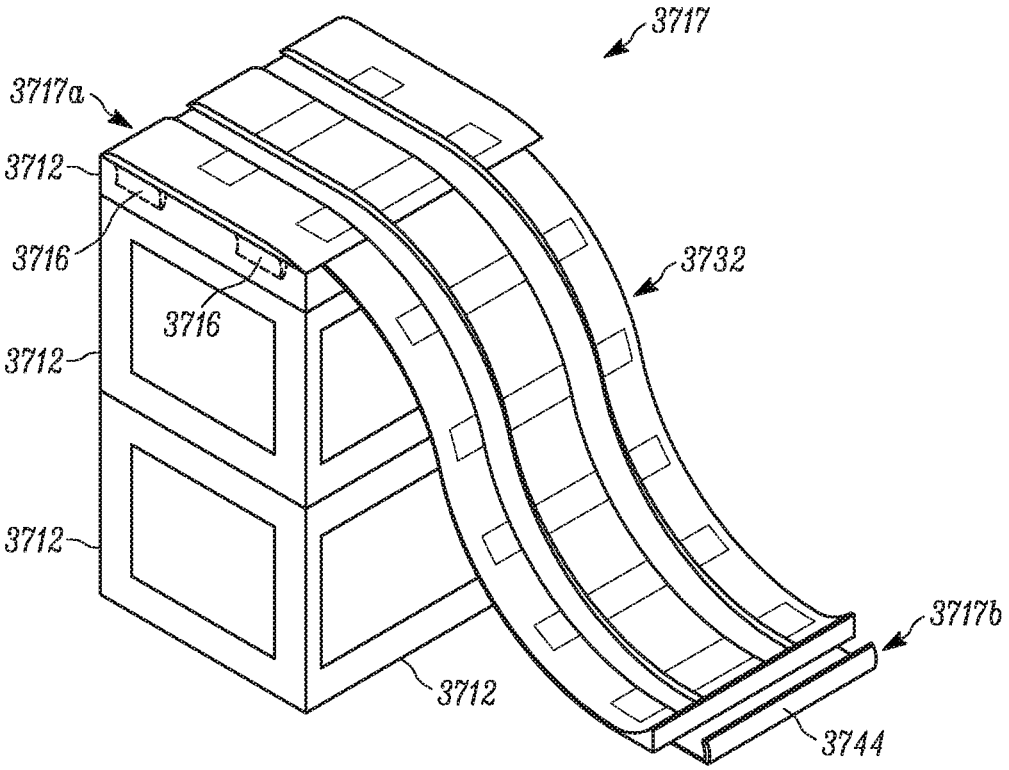

FIG. 148 illustrates a railroad train track panel 3717 that can be attached to two frames 3312 at the same time and provide an inclined section or ramp. The first panel portion 3717*a* has flanges 3716 that are configured to connect to a tile frame, and the second panel portion 3717*b* includes a flange 3744 that faces in the opposite direction as the flanges 3716 and engages a different tile frame.

Figure 150:
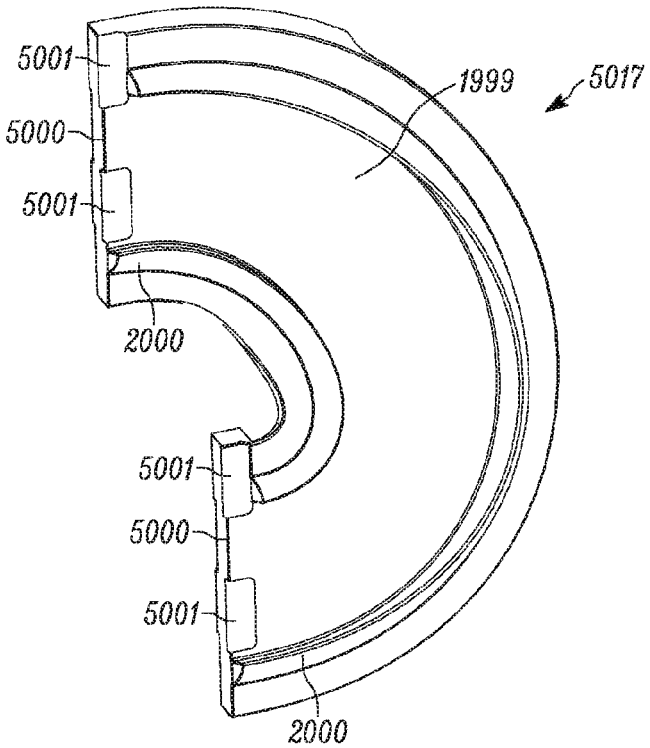
FIGS. 150-155 are perspective views of additional panel embodiments.

In addition, other panels and connectors may be employed to form a downhill section or ramp. For example, FIG. 150 illustrates a ramp panel 5017 from above. The panel 5017 may be attached to two connectors, such as connectors 142, 242, 342, 2042, 7042. In use, the panel 5017 will have a connector attached to each end 5000 of the panel, and these connectors may thereby connect the panel 5017 to other magnetic frames described herein. Further, in one illustrative configuration, the end 5000 may have alternating openings or depressions 5001 therein that are configured to receive portions of the mechanical connector 7042, such as the flexible connector wings 7056, 7058 and the friction elements 7066 that are offset from one another. In this manner, the mechanical connector 7042 may be connected or joined to the ramp panel 5017 such that one of the extension elements 7052, 7054 are disposed flush with the center portion 1999 upon which toy cars may be driven and balls or other objects may be advanced. The panel 5017 may further include guardrails 2000 that may assist in retaining the cars and other toys within the center portion 1999.

Figure 149:
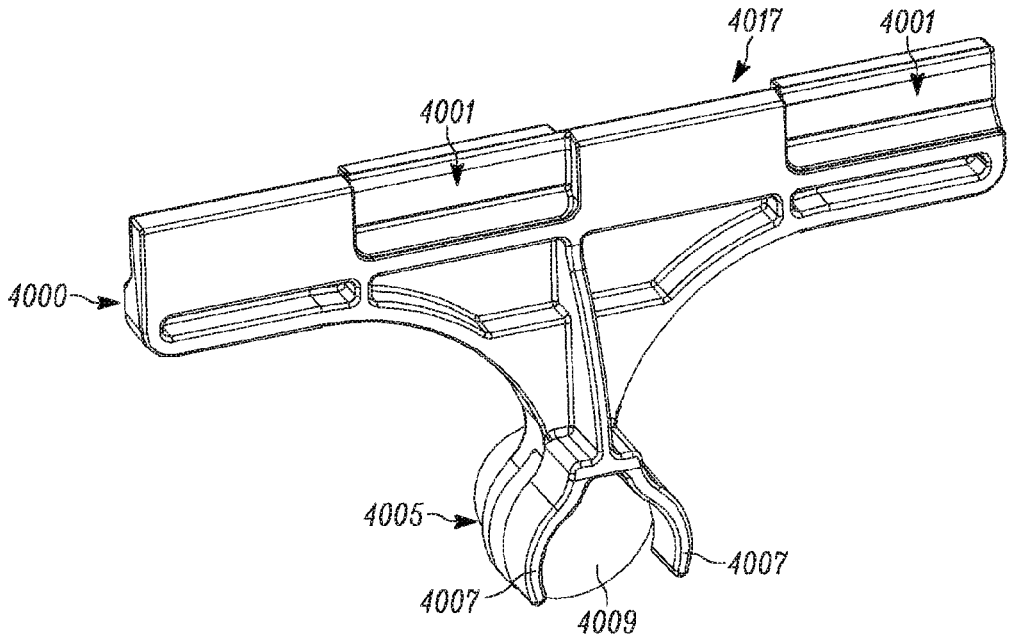
FIG. 149 is perspective of a train connector.

FIG. 149 illustrates a train connector 4017 that is configured to couple or mate with another train connector 4017. The train connector 4017 includes a connector portion 4000 that may mate with a mechanical connector 7042, which permits the train connector 4017 to be magnetically connected to other tiles and frames discussed herein. To that end, the connecting portion 4000 has alternating openings or depressions 4001 that permit the mechanical connector 7042 to securely mate therewith such that the outer surfaces of the extension elements 7052, 7054 of mechanical connector 7042 may be arranged are generally flush with a portion of the train connector 4017. Further, the train connector 4017 includes a hitch or coupling portion 4005 that includes a pair of prongs 4007 and a reinforcing portion 4009. The train connector 4017 may be connected to another train connector 4017 by flipping one of the connectors 4017 upside-down or 180° and coupling the prongs 4007 of the adjacent coupling portions 4005 to one another.

Figure 151:
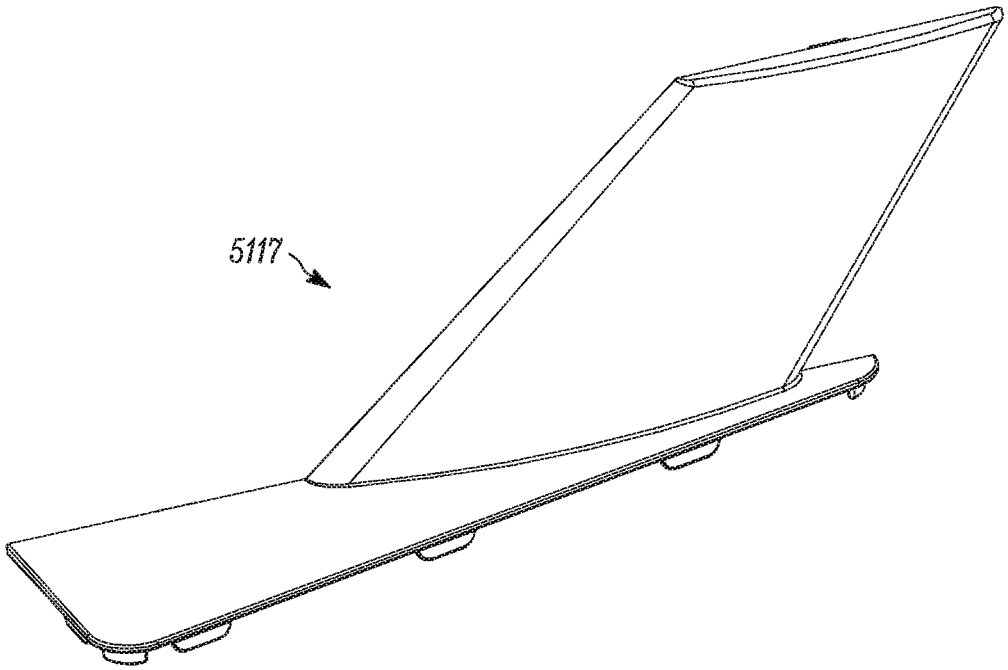
Figure 152:
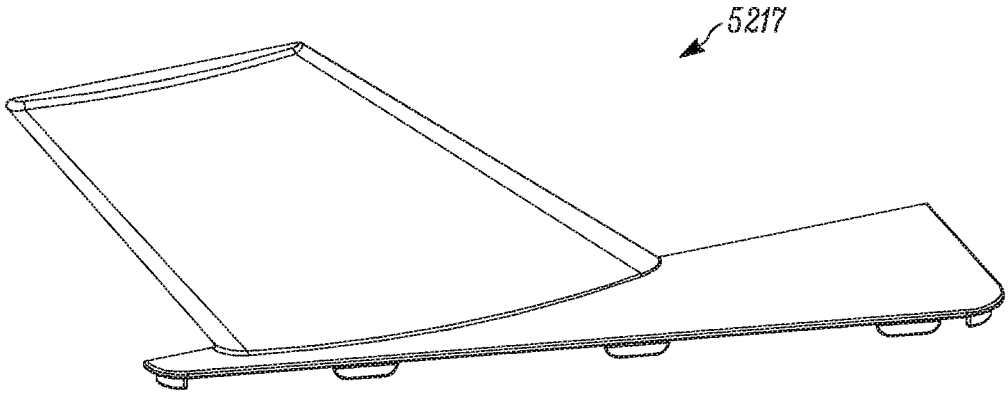
Figure 153:
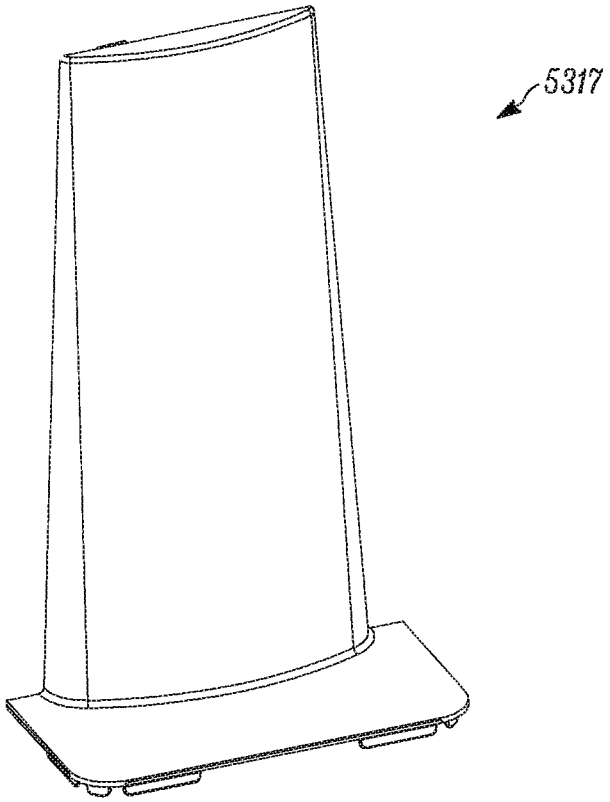
Figure 154:
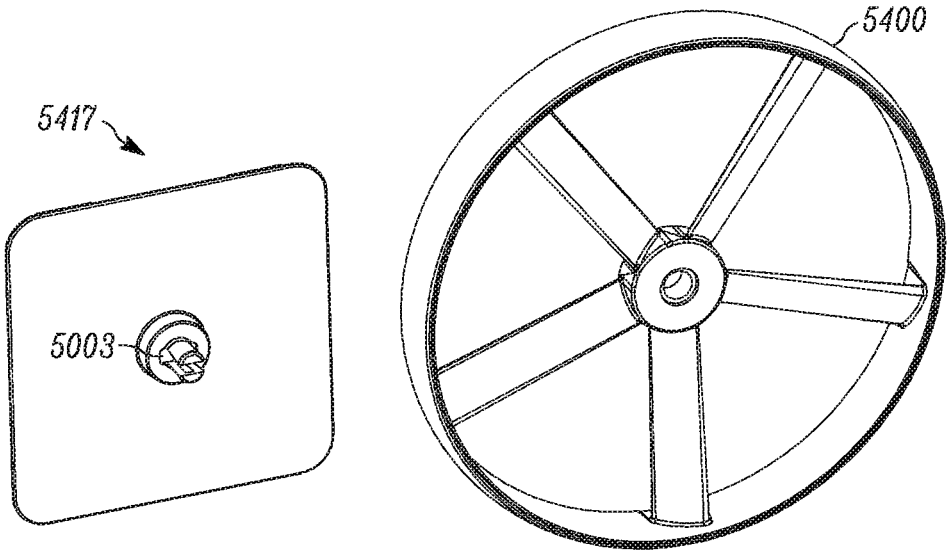

Additional three-dimensional panels are illustrated in FIGS. 150-155. For example, FIGS. 151-153 illustrate wing panels 5117, 5217, 5317 that may be incorporated into an airplane or other structure. FIGS. 151 and 152 illustrate wing panels 5117, 5217 that may be connected with the isosceles triangular frames 3512 discussed above, and FIG. 153 illustrates a wing panel 5317 that may be connected to the square frames, such as frame 3312. Another illustrative three-dimensional panel is illustrated in FIG. 154, which shown panel 5417 with an axel 5003 to which a wheel or fan 5400 may connect. Similar to panels previously described, the panels 5117, 5217, 5317, and 5417 may include flanges that permit the panels to connect to frames.

Figure 155:
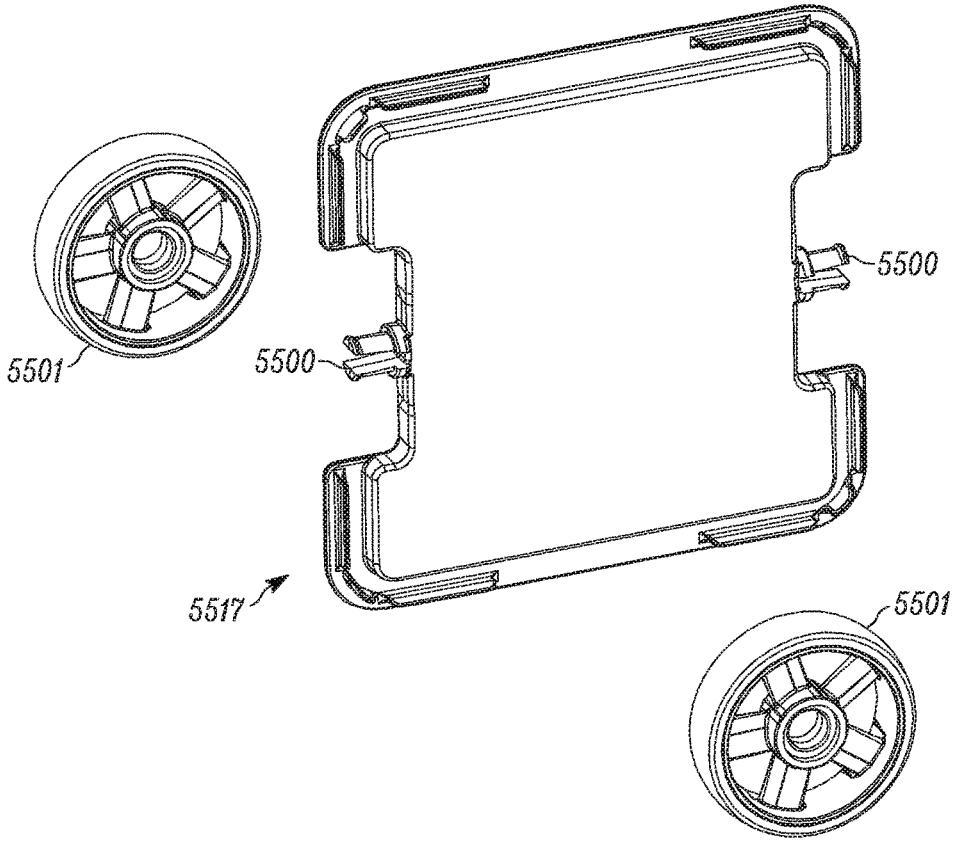

Another configuration, illustrated in FIG. 155, includes a chassis panel 5517. The chassis panel 5517 may include one or more axels to which a wheel 5501 may attach thereto. As illustrated in FIG. 155, the chassis panel 5517 includes two axels 5500 that may each accommodate a wheel 5501. Further, the chassis panel 5517 has edges that may connect with mechanical connectors, such as those described herein, to attach the chassis panel 5517 to magnetic frames.

As mentioned above, a building set or kit 50 may be comprised of a number of different magnetic building tiles, frames, panels, and/or connectors. The building set 50, shown in FIG. 31, may include a number of building tiles, e.g., 10, 13, 25, that have a frame disposed in the channel of the panel and/or building tiles, e.g., 100, 207, that have a frame disposed around and outward of the edges of the panel. Whether a channel is disposed on the frame or the panel or whether another connection mechanism, such as peg fasteners, friction, or snap-fit connectors, are employed, the building tiles are all magnetically connectable to one another along their edges and faces. In addition, the building tiles can be magnetically connected to connectors, for example, as shown in FIG. 31. In addition, two mechanical connectors (such as connectors 142, 242, 342, 2042, 6042, 4042, 5042, 6042, 7042) may be magnetically connected to one another such that two cardboard pieces 348 and 349 may be secured adjacent to one another.

Additional illustrative building kits 70, 80 are illustrated in FIGS. 32 and 33, and these kits also may include a number of magnetic tiles, frames, panels, connectors, and panel pieces, which may be arranged to form a variety of structures, such as a fort or vehicle. With a variety of building elements, a user can assemble or arrange the elements in a myriad of different configurations. For example, the structure created with the kit 70 shown in FIG. 32 employs a variety of building tiles 10, 25, and a variety of mechanical connectors 142, 242. In addition, a number of differently shaped panel pieces 448, 449, 450, which may be comprised of cardboard, may interface with the mechanical connectors and building tiles. FIG. 33 illustrates a kit 80 used to create a structure with a variety of building tiles including square building tiles 10, 100, rectangular building tiles 13, 113, and triangular building tiles 25, 125. In the illustrative structure of FIG. 33, pieces 548, 590 have been incorporated into the structure with mechanical connectors 142.

Figure 34A:
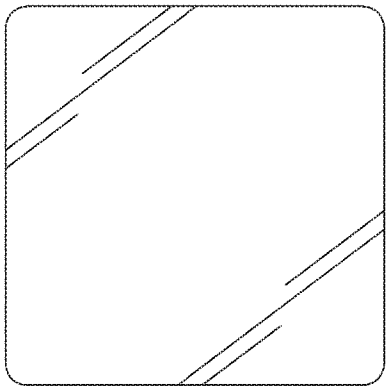
FIGS. 34A-34G are front views illustrating various embodiments of panels.
Figure 34B:
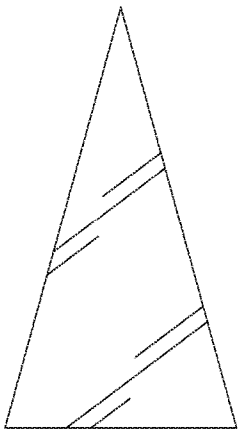
Figure 34C:
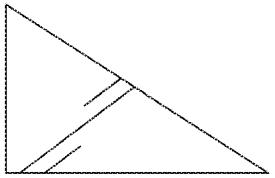
Figure 34D:
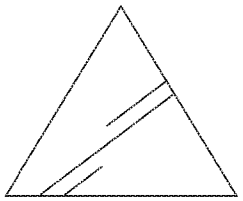
Figure 34E:
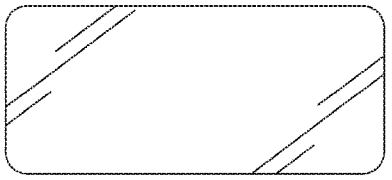
Figure 34F:
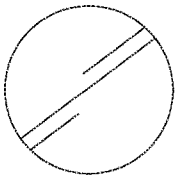
Figure 34G:
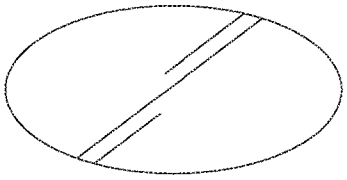

To provide the user with a variety of building tiles usable to create different structures, the kits may include panels and frames of different shapes and configurations. FIGS. 34A-34G illustrate a few of the numerous options for the panel shape. FIG. 34A illustrates a square panel and FIGS. 34B-D illustrate different triangular panels. FIG. 34E illustrates a rectangular panel and FIG. 34F illustrates a circular panel. FIG. 34G illustrates an oval panel. These panels are illustrated for exemplary purposes and different panel shapes are anticipated. Further, these panels can be incorporated into any of the tile or frame configurations discussed above, i.e., a panel with a channel or a frame with a channel. Furthermore, as noted above, three-dimensional panels such as panels 1218, 1317, 1318, 1417, 1418, 1517, 1518, 1617, 1618, 1717, 1718, 1817, 1818, 1917, 1918, 2017, 2018, 2117, 2118, 2217, 2218, 2317, 2318, 2417, 2418, 2517, 2518, 2617, 2618, 2717, 2718, 2817, 2818, 2917, 3017, 3117, 3217, 3218, 3317, 3417, 3517, 3617, 3717, 3817, and 3917 may be incorporated into the kits or tiles.

Figure 35A:
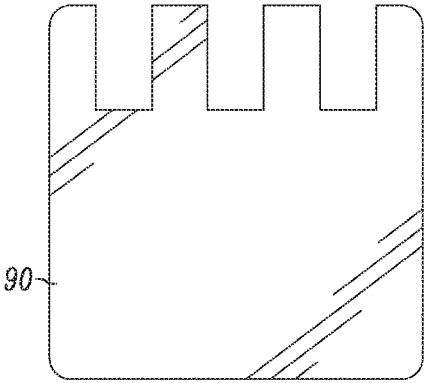
FIGS. 35A-35E are front views illustrating various embodiments of cardboard cutouts.
Figure 35B:
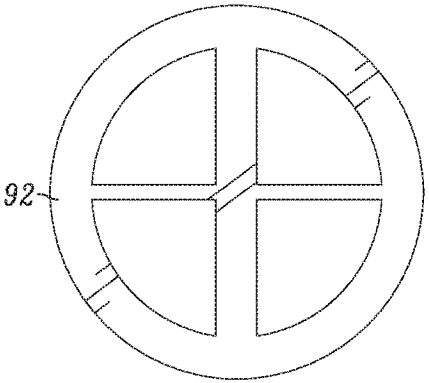
Figure 35C:
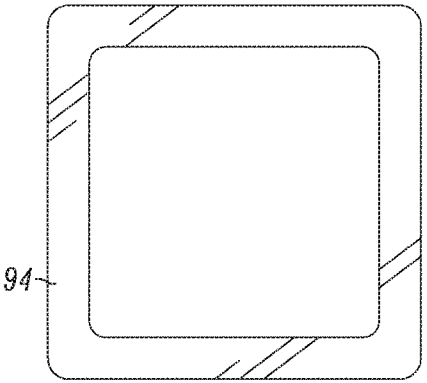
Figure 35D:
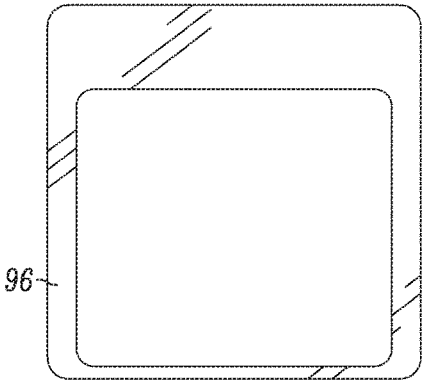
Figure 35E:
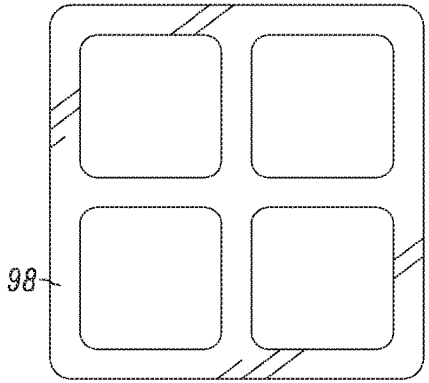

A kit also may include a plurality of panel pieces, such as cardboard or plastic cutouts, that may be assembled together with one another and with tiles, such as with the use of the mechanical connectors 142, 242, 342, 2042, 6042, 4042, 5042, 6042. By one approach, these cardboards or plastic pieces may be formed from a sheet of cardboard or plastic having lines of weakness formed therein, wherein the lines of weakness create a plurality of discrete tiles resembling building elements. Once separated from the sheet of cardboard or plastic these discrete cardboard or plastic pieces may be secured to one another to form a variety of structures. These cardboard pieces may have a variety of details that correspond to known architectural features. For example, FIG. 35A shows a cutout piece 90 having a notched configuration that could be used to depict portions of a castle or an element of a car, or various other elements of a structure. Panel or cutout pieces 92, 94, 96, 98 of FIGS. 35B-E depict various window configurations, though these may be repurposed into many alternative elements. Indeed, cutout piece 92 was rotated in FIG. 20 to depict a railroad crossing sign. These pieces may include a plastic portion in the center of the open portion, or may not have any material disposed in the openings. These configurations are not an exhaustive representation, but are merely examples of the various optional pieces that may be used herewith. Also, some of these cutout pieces may be formed into magnetic tiles with a corresponding frame. For example, the cutout 90 may be engaged with a frame such as tile frame 112 to create a magnetic tile having openings therein. Other panels that may be incorporated into the kit includes panels 1048, 1148 that can be employed to build various shapes.

Figure 109:
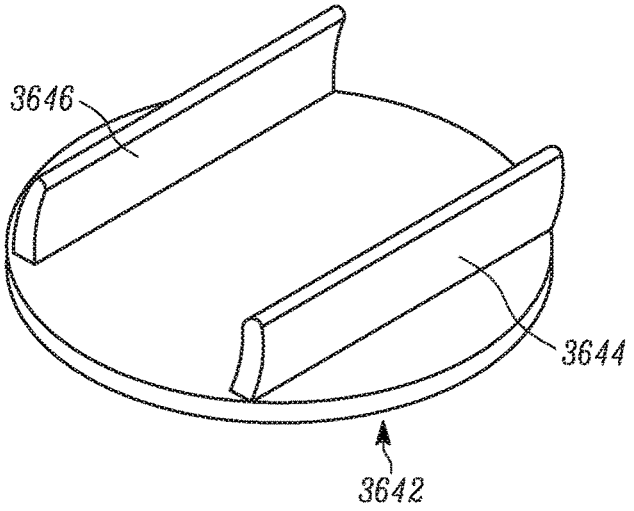
FIG. 109 is a bottom perspective view of a clip for connecting two adjacent magnetic frames.
Figure 110:
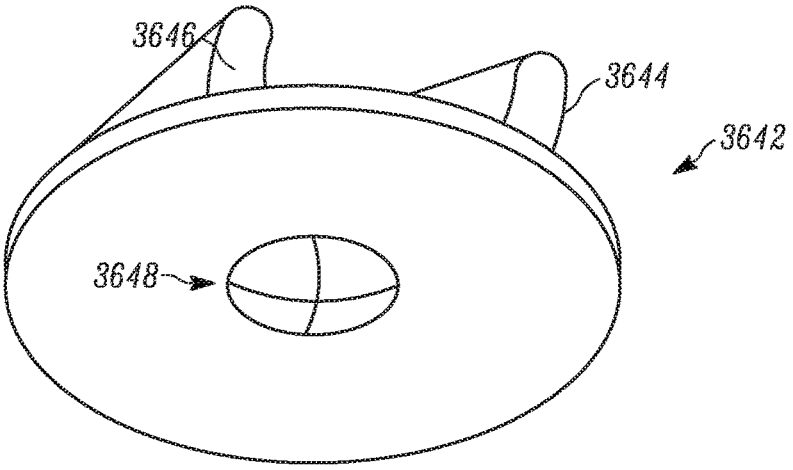
FIG. 110 is a top perspective view of the clip of FIG. 109.

The building tiles described herein may be used to build a variety of structures, both large and small. For some structures, such as particularly large structures or those with unusual or unstable configurations, a bridge or support clip may be employed to strengthen the magnetic connection between magnetic tiles, and specifically to strengthen the connection between adjacent frames. FIGS. 109 and 110 illustrate an exemplary clip 3642. The clip 3642 has a body 3648 with projections or flanges 3644, 3646 extending therefrom. The flanges 3644, 3646 of the clip 3642 are configured to engage the interior walls 3314 of two different, adjacent building tiles 3310, 3410, 3510 to strengthen the connection between the adjacent building tiles. The inward facing surfaces of the flanges 3644, 3646 have a configuration that corresponds to or cooperates with the protuberance 3322 of the interior frame wall 3314. By one illustrative approach, the flanges 3644, 3646 are parallel extensions that are disposed sufficiently far apart to accommodate a leg of two adjacently disposed building tiles therebetween. In the embodiment of FIGS. 109 and 110, the clip 3642 has a body 3648 with a rounded center portion opposite the side of the clip 3642 with the flanges 3644, 3646 extending therefrom.

Figure 111:
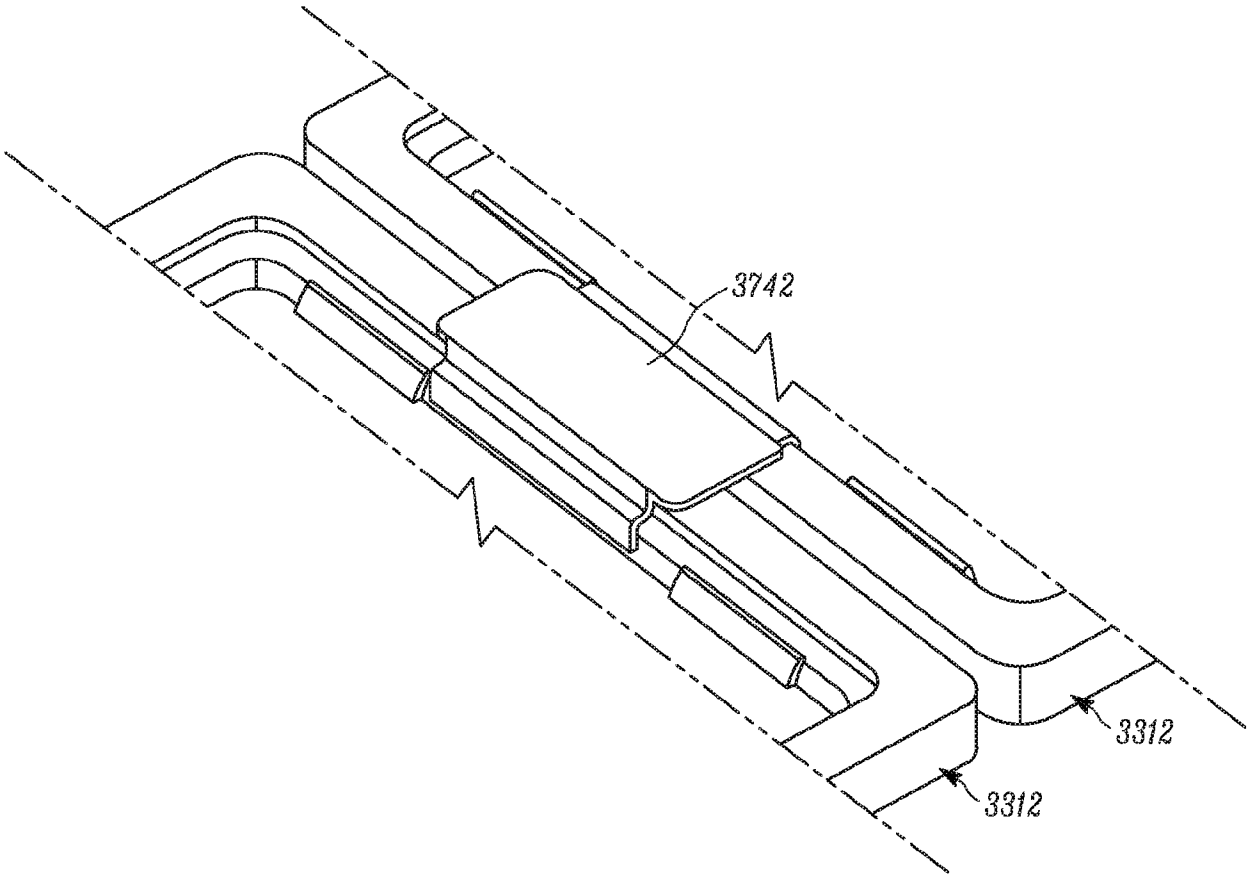
FIG. 111 is a top perspective view of another clip connecting two adjacent magnetic frames with panels connected thereto.
Figure 112:
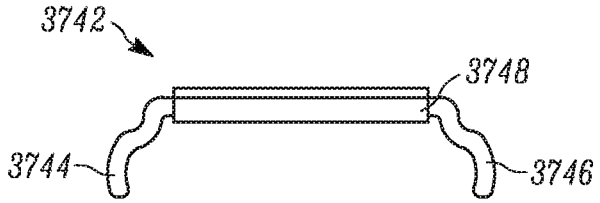
FIG. 112 is an end view of the clip of FIG. 111 without the frames engaged therewith.
Figure 113:
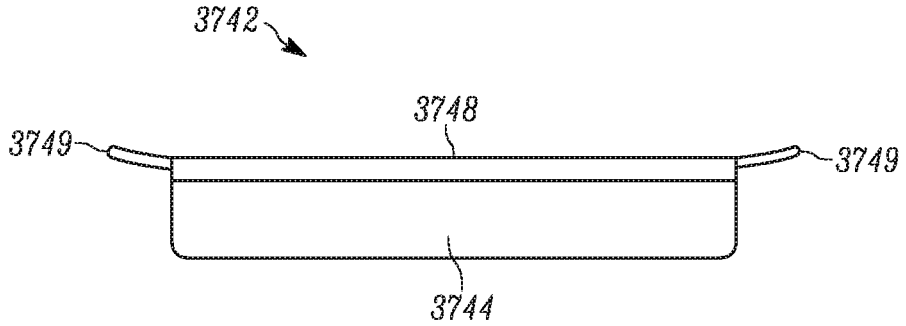
FIG. 113 is a side view of the clip of FIG. 112.
Figure 114:
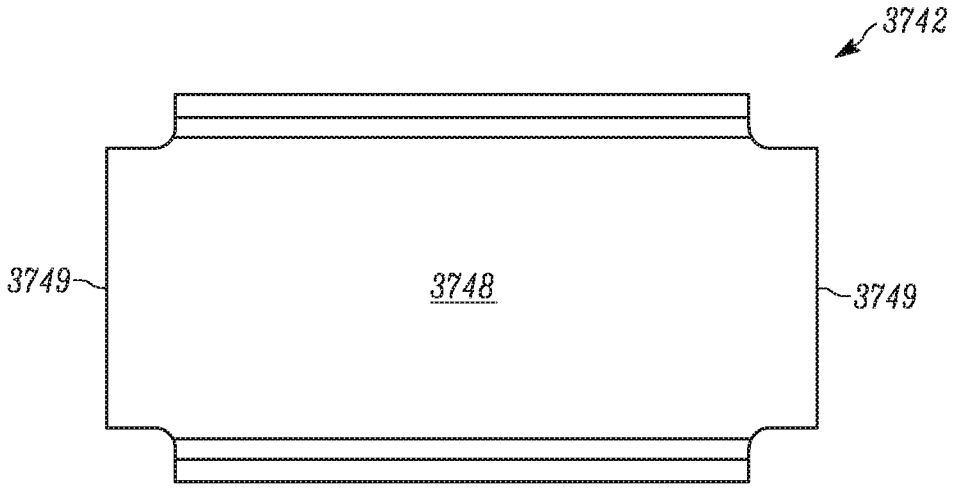
FIG. 114 is a bottom view of the clip of FIG. 112.

Another illustrative clip 3742 is illustrated in FIGS. 111-114. FIG. 111 illustrates the clip 3742 attached to two frames 3312. FIG. 111 shows the clip 3742 with a body portion 3748 from which two flanges 3744, 3746 extend. As shown in FIG. 113, the flanges 3744, 3746 do not extend the entire length of the body 3748. Furthermore, the body 3748, as shown in FIG. 113, also includes has wings 3749 that extend outward of the flanges 3744, 3746. These wings 3749 permit a user to pull upward on the clip 3742 to disengage the clip from the tile frames.

A wide variety of modifications, alterations, and combinations can be made with respect to the above described embodiments without departing from the scope of the invention, and are within the ambit of the inventive concept. For example, there are numerous variations on the size and shape of the building tiles disclosed herein.

What is claimed:

1. A building system comprising:

a plurality of magnetically-connectable frames that include magnetic elements to enable each frame to be magnetically attracted to another frame, at least two frames including an outer frame wall, a first wall, a second wall opposite the first wall, and an interior frame wall encasing the magnetic elements within the frames, the first and second walls connecting the outer frame wall and the interior frame wall;

the at least two frames further including a protuberance centrally disposed along the interior frame wall, the protuberance having a predetermined height and being disposed a distance from first and second walls thereby forming a first and a second shelf, the first shelf facing the first wall and defining a first inset distance between the first shelf and the first wall and a second inset distance between the second shelf facing the second wall, the first and second inset distances being approximately equal;

a plurality of interchangeable panels, each of the panels having a thickness and being capable of being releasably and stably mounted in one of the frames to form a building tile, at least two panels including a panel face and a rear panel wall opposite the panel face, the rear panel wall having at least one flange with curvature angled toward an edge of the panel, the curvature configured to mate with the protuberance on the frame from either the first wall or the second wall of the frame;

wherein each of the panels can be placed in a position of stable equilibrium within either of the two frames or removed therefrom simply by manually applying pressure to the panels and frames without disassembling or permanently deforming any part of either the frame or the panel and without the use of tools.

2. The building system of claim 1 wherein the panel face is flush with the first wall or the second wall when the panel is mounted into the frame such that the panel thickness is equal to the first inset distance between the first wall and the first shelf and the second inset distance between the second wall and the second shelf.

3. The building system of claim 2 wherein the at least one flange of the panel includes a plurality of discrete flanges and at least one discrete flange is disposed adjacent each edge of the panel, wherein the discrete flange has a height that is approximately equal to the height of the protuberance.

4. The building system of claim 1 wherein each frame has a front corresponding to the first wall and a rear corresponding to the second wall, and each panel is configured to mate with the frame from the front or rear of the frame.

5. The building system of claim 4 wherein the at least one flange is disposed in a configuration that prohibits a first panel being mounted from a front of the frame and a second panel being mounted from a rear of the frame at the same time.

6. The building system of claim 4 wherein the panel includes a plurality of flanges disposed in a configuration that prohibits a first panel being mounted from the front of the frame and a second panel being mounted from the rear of the frame at the same time.

7. The building system of claim 1 where the panel is a three dimensional panel.

8. The building system of claim 1 further comprising a lip at a junction between the first wall and the interior frame wall defining a groove below the lip.

9. The building system of claim 8 wherein a plurality of interchangeable substrates are capable of being retained within the frame in between the first shelf of the protuberance and the lip.

10. The building system of claim 1 further comprising a mechanical connector with a frame having magnets disposed therein and two extension elements extending from the frame, the extension elements having openings therein.

11. The building system of claim 10 wherein the openings of the extension elements are disposed such that body portions of the extension elements are at least partially offset from one another.

12. The building system of claim 1 further comprising a retaining clip configured to strengthen connections between adjacently disposed frames, the retaining clip having a body and two flanges extending from the body in a substantially parallel arrangement, wherein inward facing surfaces of the flanges have a configuration that cooperates with the protuberance of the frame.

13. The building system of claim 1 further comprising at least one three-dimensional panel with a three-dimensional portion that extends beyond the first wall or second wall of the frame when the three-dimensional panel is mated with the frame, wherein the three-dimensional panel portion is configured to facilitate movement of objects through the three-dimensional panel or thereover.

* * * * *